US008365834B2

(12) United States Patent
Liess et al.

(10) Patent No.: US 8,365,834 B2
(45) Date of Patent: Feb. 5, 2013

(54) TUBULAR HANDLING APPARATUS

(75) Inventors: Martin Liess, Seelze (DE); John D. Hooker, II, Langenhagen (DE); Reinhard Grosch, Geisa OT Otzbach (DE); Thomas Kotschy, Burgdorf (DE); Andreas Carlsson, Sehnde (DE)

(73) Assignee: Weatherford/Lamb, Inc., Houston, TX (US)

( * ) Notice: Subject to any disclaimer, the term of this patent is extended or adjusted under 35 U.S.C. 154(b) by 377 days.

(21) Appl. No.: 12/435,346

(22) Filed: May 4, 2009

(65) Prior Publication Data

US 2009/0274545 A1 Nov. 5, 2009

Related U.S. Application Data

(60) Provisional application No. 61/050,121, filed on May 2, 2008, provisional application No. 61/126,223, filed on May 2, 2008, provisional application No. 61/126,301, filed on May 2, 2008.

(51) Int. Cl.
*E21B 19/16* (2006.01)
*E21B 19/08* (2006.01)
*E21B 19/06* (2006.01)

(52) U.S. Cl. ..... 166/382; 166/77.4; 166/77.52; 166/85.5

(58) Field of Classification Search ..... 166/380, 166/382, 77.1, 77.4, 77.51, 77.52, 85.1, 85.5
See application file for complete search history.

(56) References Cited

U.S. PATENT DOCUMENTS

| | | | | |
|---|---|---|---|---|
| 3,766,991 | A | 10/1973 | Brown | |
| 3,964,552 | A | 6/1976 | Slator | |
| 4,621,974 | A * | 11/1986 | Krueger | 414/800 |
| 6,691,801 | B2 * | 2/2004 | Juhasz et al. | 175/27 |
| 6,742,596 | B2 * | 6/2004 | Haugen | 166/380 |
| 6,938,697 | B2 * | 9/2005 | Haugen | 166/380 |
| 7,182,133 | B2 * | 2/2007 | Webre et al. | 166/250.01 |
| 7,228,913 | B2 * | 6/2007 | Folk et al. | 166/380 |
| 7,281,587 | B2 * | 10/2007 | Haugen | 166/380 |
| 7,370,707 | B2 * | 5/2008 | McDaniel et al. | 166/380 |
| 7,654,325 | B2 * | 2/2010 | Giroux et al. | 166/291 |
| 7,984,757 | B1 * | 7/2011 | Keast et al. | 166/77.1 |
| 8,100,187 | B2 | 1/2012 | Begnaud et al. | |
| 2002/0043403 | A1 * | 4/2002 | Juhasz et al. | 175/40 |
| 2002/0074132 | A1 | 6/2002 | Juhasz et al. | |
| 2002/0170720 | A1 * | 11/2002 | Haugen | 166/379 |
| 2003/0066654 | A1 * | 4/2003 | Juhasz et al. | 166/379 |
| 2004/0069500 | A1 * | 4/2004 | Haugen | 166/380 |
| 2004/0173358 | A1 * | 9/2004 | Haugen | 166/380 |
| 2005/0000696 | A1 * | 1/2005 | McDaniel et al. | 166/379 |
| 2005/0279507 | A1 * | 12/2005 | Folk et al. | 166/378 |
| 2006/0005962 | A1 * | 1/2006 | Juhasz et al. | 166/77.1 |
| 2006/0118293 | A1 * | 6/2006 | Juhasz et al. | 166/77.51 |
| 2006/0124293 | A1 * | 6/2006 | Juhasz et al. | 166/77.1 |
| 2006/0169461 | A1 * | 8/2006 | Haugen | 166/380 |

(Continued)

OTHER PUBLICATIONS

PCT Search Report for International Application No. PCT/US2009/042753 dated Apr. 19, 2011.

(Continued)

*Primary Examiner* — Jennifer H Gay
(74) *Attorney, Agent, or Firm* — Patterson & Sheridan, LLP

(57) ABSTRACT

In one embodiment, a tubular gripping assembly for use with a top drive to handle a tubular includes a tubular gripping tool having a mandrel and gripping elements operatively coupled to the mandrel; and a link assembly attached to the mandrel, wherein a load of the link assembly is transferred to the mandrel. In another embodiment, the tubular gripping assembly includes a swivel having selectively actuatable seals. In yet another embodiment, the tubular gripping assembly includes a thread compensator to facilitate tubular make-up. In yet another embodiment, the tubular gripping assembly includes a wedge lock release apparatus to facilitate the release of gripping elements from the tubular.

23 Claims, 57 Drawing Sheets

U.S. PATENT DOCUMENTS

| | | | | |
|---|---|---|---|---|
| 2007/0131416 | A1 | 6/2007 | Odell et al. | |
| 2008/0059073 | A1 | 3/2008 | Giroux et al. | |
| 2008/0083540 | A1* | 4/2008 | Haugen | 166/380 |
| 2008/0110637 | A1* | 5/2008 | Snider et al. | 166/380 |
| 2008/0149326 | A1* | 6/2008 | Angelle et al. | 166/77.52 |
| 2008/0264648 | A1* | 10/2008 | Pietras et al. | 166/380 |
| 2009/0151934 | A1* | 6/2009 | Heidecke et al. | 166/250.01 |
| 2009/0274545 | A1* | 11/2009 | Liess et al. | 414/800 |
| 2010/0200215 | A1* | 8/2010 | Juhasz et al. | 166/77.51 |
| 2010/0314100 | A1* | 12/2010 | Tepavac et al. | 166/77.51 |
| 2011/0017474 | A1* | 1/2011 | Pietras et al. | 166/380 |
| 2011/0174483 | A1* | 7/2011 | Odell et al. | 166/250.01 |

OTHER PUBLICATIONS

International search report and written opinion for application No. PCT/US2009/042753 dated Sep. 22, 2011.

* cited by examiner

A–A

TUBULAR HANDLING APPARATUS

CROSS-REFERENCE TO RELATED APPLICATIONS

This application claims benefit of U.S. Provisional Patent Application Ser. No. 61/050,121, filed on May 2, 2008; U.S. Provisional Patent Application Ser. No. 61/126,223, filed on May 2, 2008; and U.S. Provisional Patent Application Ser. No. 61/126,301, filed on May 2, 2008. Each of the above referenced patent applications is incorporated herein by reference in its entirety.

BACKGROUND OF THE INVENTION

1. Field of the Invention

The present invention relates to methods and apparatus for handling tubulars using top drive systems. Particularly, the invention relates to methods and apparatus for adapting a top drive for use with running and rotating tubulars. More particularly still, the invention relates to a tubular handling apparatus for engaging with a tubular and rotating the same.

2. Description of the Related Art

It is known in the industry to use top drive systems to rotate a drill string to form a borehole. Top drive systems are equipped with a motor to provide torque for rotating the drilling string. The quill of the top drive is typically threadedly connected to an upper end of the drill pipe in order to transmit torque to the drill pipe. Top drives may also be used in a drilling with casing operation to rotate the casing.

In order to drill with casing, most existing top drives require a threaded crossover adapter to connect to the casing. This is because the quill of the top drives is not sized to connect with the threads of the casing. The crossover adapter is designed to alleviate this problem. Typically, one end of the crossover adapter is designed to connect with the quill, while the other end is designed to connect with the casing.

However, the process of connecting and disconnecting a casing is time consuming. For example, each time a new casing is added, the casing string must be disconnected from the crossover adapter. Thereafter, the crossover must be threaded into the new casing before the casing string may be run. Furthermore, this process also increases the likelihood of damage to the threads, thereby increasing the potential for downtime.

There is a need, therefore, for methods and apparatus for adapting the top drive for engaging and rotating a tubular such as casing.

SUMMARY OF THE INVENTION

The present invention generally relates to a method and apparatus for drilling with a top drive system. Particularly, the present invention relates to methods and apparatus for handling tubulars using a top drive system.

In one embodiment, a tubular gripping assembly for use with a top drive to handle a tubular includes a tubular gripping tool having a mandrel and gripping elements operatively coupled to the mandrel; and a link assembly attached to the mandrel, wherein a load of the link assembly is transferred to the mandrel.

In another embodiment, a thread compensator for use with a tubular gripping assembly includes an inner ring member rotatably coupled to an outer ring member and a cylinder for coupling the outer ring member to a non-rotating portion of the tubular gripping assembly, wherein the inner ring member is rotatable with a rotating portion of the tubular gripping assembly.

In another embodiment, a tubular handling assembly includes a gripping tool having a carrier movably coupled to a mandrel, wherein the carrier includes a gripping element; a link assembly coupled to the gripping tool; and a thread compensator. The thread compensator may have an inner ring member rotatably coupled to an outer ring member and a cylinder for coupling the outer ring member to the link assembly, wherein the inner ring member is rotatable with the carrier.

In another embodiment, a tubular handling assembly for use with a top drive includes a mandrel coupled to the top drive; an actuator for moving gripping elements between a tubular gripping position and a tubular releasing position; and a tubular engagement member for engaging a tubular. The assembly may also include a clamping indicator coupled to the gripping elements for indicating the position of the gripping elements and a coupling indicator coupled to the engagement member for indicating a position of the tubular.

In another embodiment, a swivel for use with a tubular gripping assembly includes an outer housing; an inner housing concentrically disposed within the outer housing; a fluid channel for fluid communication between the outer housing and the inner housing; a seal bushing coupled to the outer housing and axially movable between a first position and a second position relative to the inner housing; a plurality of seals movable with the seal bushing and sealingly engageable with the inner housing for preventing leakage from the fluid channel; and a plurality of grooves disposed on the inner housing, wherein when the seal bushing is in the first position, the plurality of seals are sealingly engaged with the inner housing, and in the second position, the plurality of seals are aligned with the plurality of grooves, thereby disengaging from the inner housing.

In another embodiment, a release apparatus for releasing a gripping element of a tubular gripping apparatus includes an anchor attached to the tubular gripping apparatus; an engagement member movably coupled to the anchor; and a connection member coupling an abutment device to the anchor, wherein connecting or disconnecting the connection member from the anchor causes engagement member to move relative to the anchor.

In another embodiment, a method of handling a tubular includes providing a gripping assembly having a carrier movably coupled to a mandrel, wherein the mandrel has a load collar adapted to couple to a shoulder of the carrier; a gripping element movable relative to the carrier; a thread compensator adapted to move the carrier; an engagement member movable relative to the carrier; and a stop member adapted to limit movement of the engagement member. The method includes lowering the gripping assembly until the engagement member contacts the tubular; lowering the carrier relative to the engagement member until the engagement member contacts the stop member; lowering the mandrel relative to the carrier such that a gap exists between the load collar and the shoulder; threadedly connecting the tubular to a second tubular; and actuate the thread compensator to move the carrier to compensate for threaded connection.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 8A is a perspective view of the link support housing of the link assembly shown in FIG. 1. FIGS. 8B-8D are partial cross-sectional views of the link support housing shown in FIG. 8A. FIG. 8E shows the mandrel 110, the swivel 105, and the link assembly 112, 113 prior to assembly to the mandrel of the external gripping tool shown in FIGS. 2A-2B.

FIG. 23 shows the position of the carrier during a pick up operation. FIG. 24 shows the position of the carrier under normal operations. FIG. 25 shows the position of the carrier when the external gripping tool is on the ground.

FIG. 47 shows the tubular engaged with the bumper plate.

FIG. 48 shows the carrier being lowered relative to the bumper plate.

FIG. 49 shows the mandrel being moved relative to the carrier.

FIG. 50 shows the mandrel in contact with the bumper plate.

DETAILED DESCRIPTION OF THE PREFERRED EMBODIMENT

Figure 1:
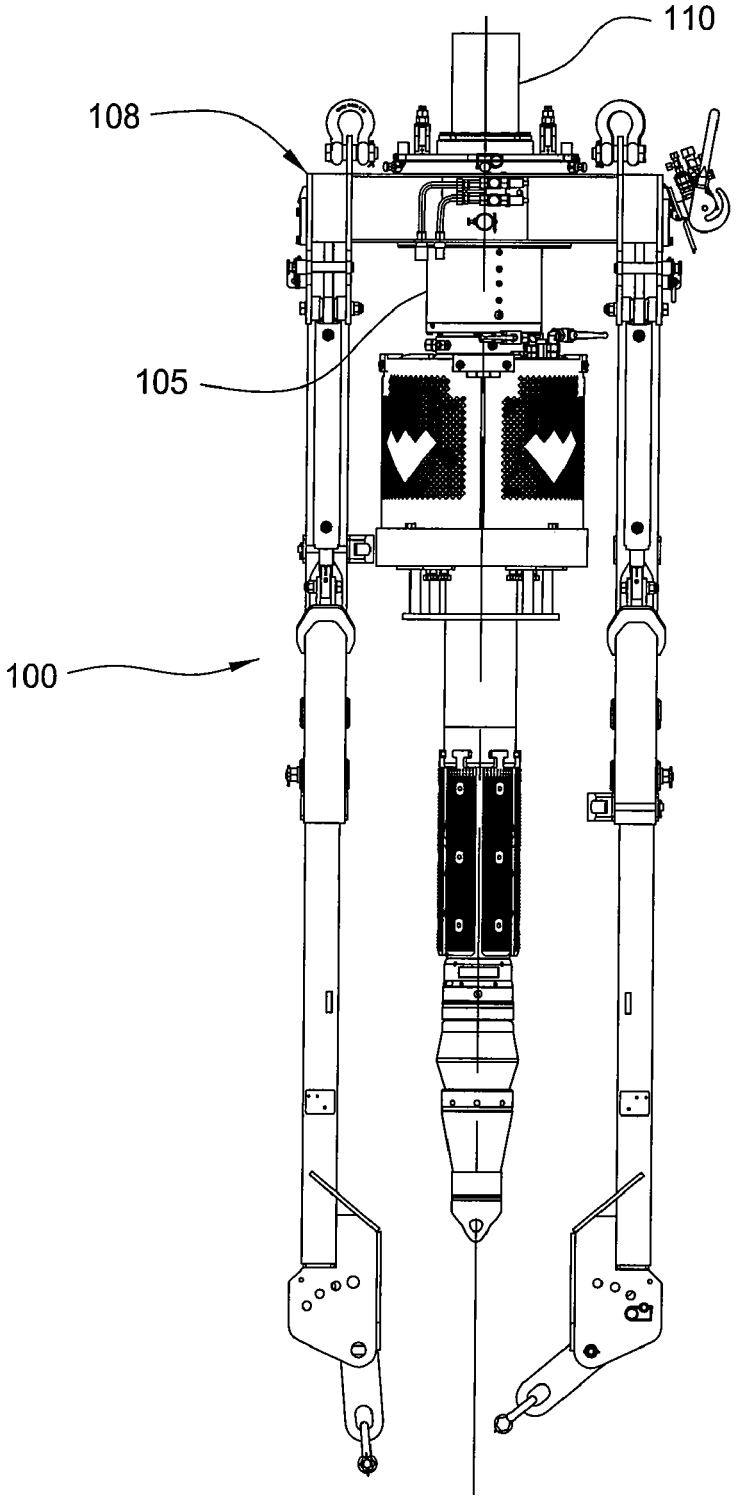
FIG. 1 shows an exemplary tubular handling apparatus adapted to engage an internal surface of the tubular.
Figure 2A:
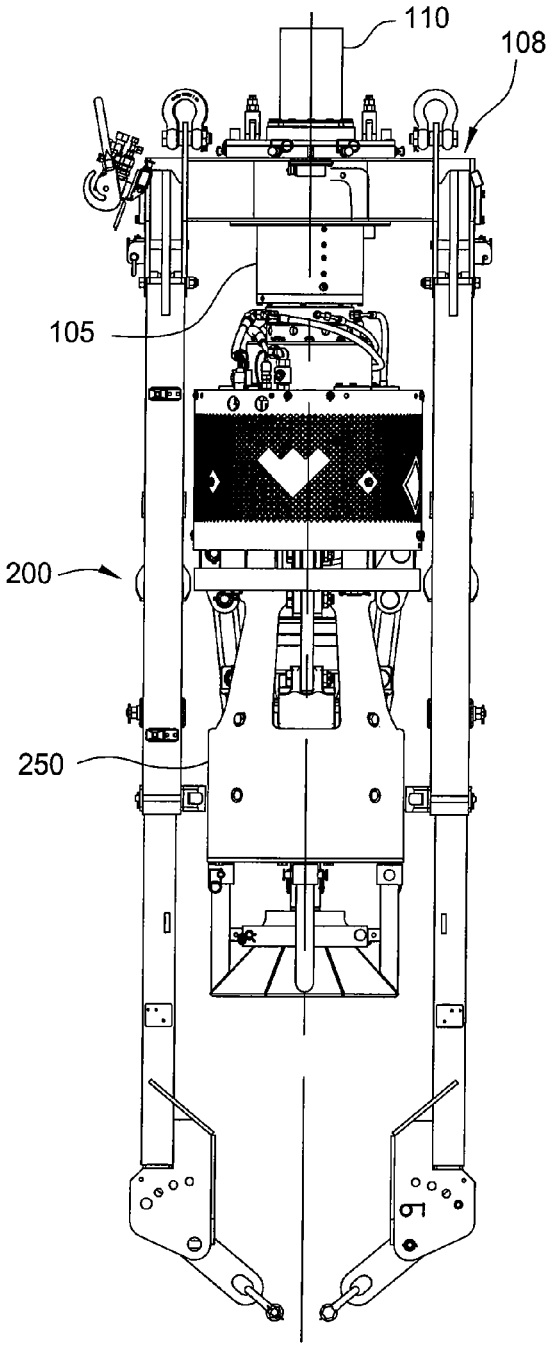
FIGS. 2A and 2B shows an exemplary tubular handling apparatus adapted to engage an exterior surface of the tubular.
Figure 2B:
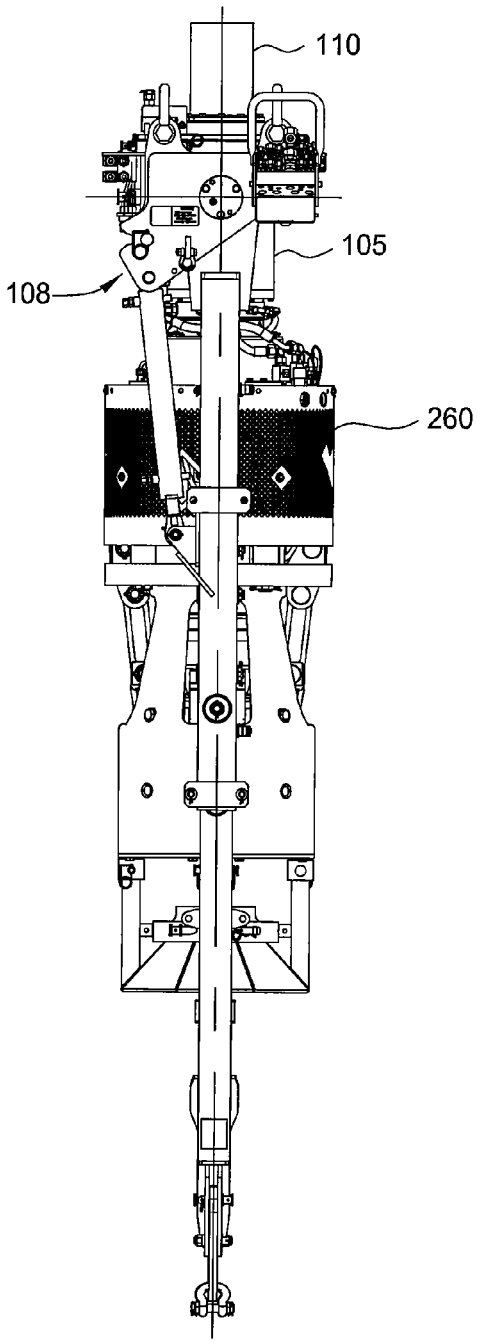

Embodiments of the present invention provide a tubular handling apparatus for use with a top drive to engage and rotate a tubular such as casing. FIG. 1 shows an exemplary tubular handling apparatus adapted to engage an internal surface of the tubular. The apparatus will be referred to herein as an internal gripping tool 100. The internal gripping tool 100 includes gripping elements 155 and an actuator 160 for actuating the gripping elements 155. FIGS. 2A and 2B shows an exemplary tubular handling apparatus adapted to engage an exterior surface of the tubular. The apparatus will be referred to herein as an external gripping tool 200. The external gripping tool 200 includes a carrier 250 for interacting with gripping elements and an actuator for actuating the gripping elements 260. The internal gripping tool 100 and the external gripping tool 200 are equipped with a swivel 105 and a link assembly 108.

Figure 3:
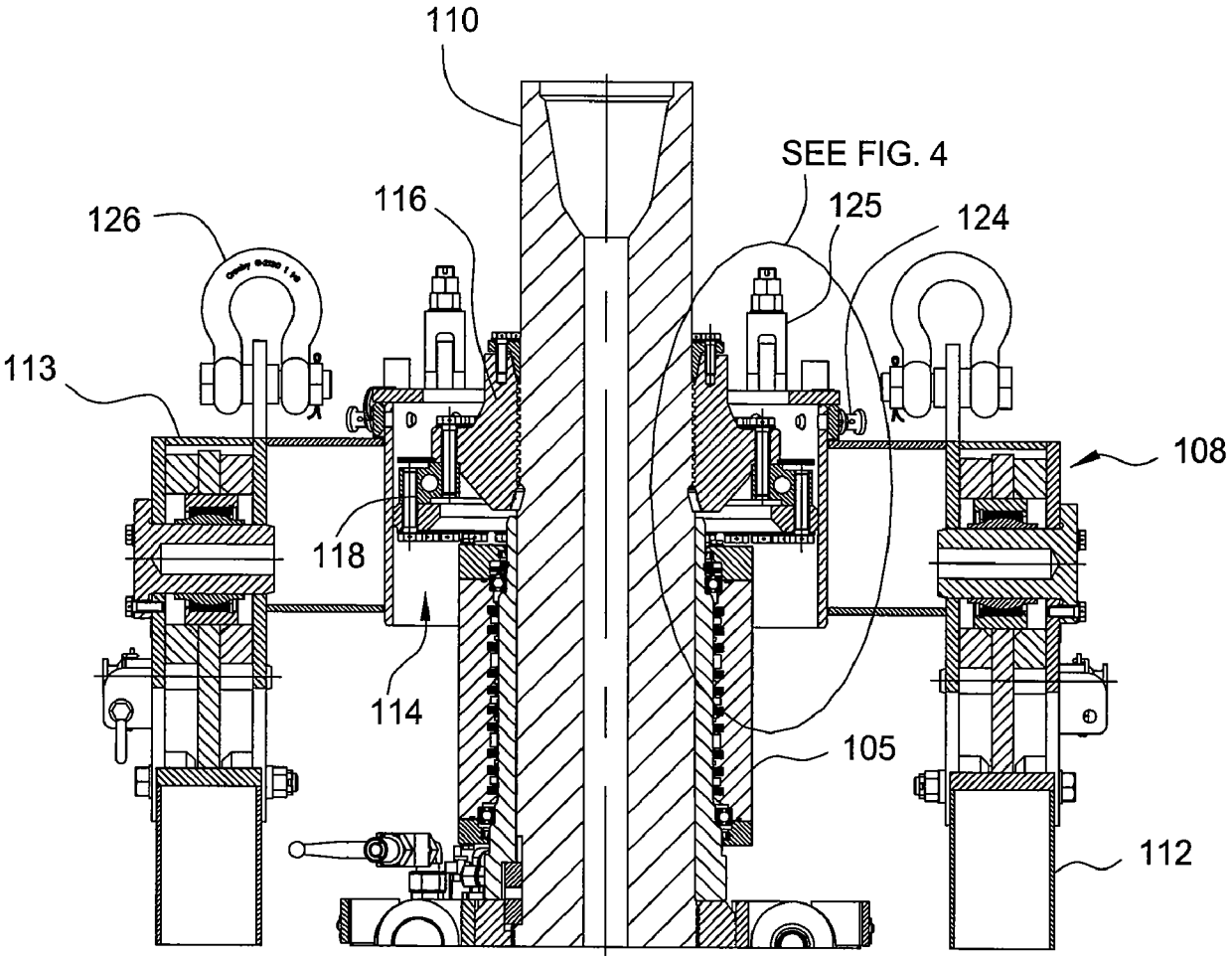
FIG. 3 shows a cross-sectional view of a swivel and a link assembly attached to the internal gripping tool of FIG. 1.

FIG. 3 shows a cross-sectional view of the swivel 105 and the link assembly 108 attached to the mandrel 110 of the internal gripping tool 100. The mandrel 110 may be connected directly or indirectly to the quill disposed below the top drive. The link assembly 108 includes links 112 connected to a link support housing 113. In one embodiment, the links 112 may be extendable. Additionally, hydraulic actuation cylinders may be connected to the links 112 to tilt the links 112 to and away from a centerline of the mandrel 110. The link support housing 113 has a central opening 114 for receiving the mandrel 110. A coupling ring 116 disposed in the opening 114 is used to connect the link assembly 108 to the mandrel 110. The coupling ring 116 may be a nut which threadedly attaches to an exterior surface of the mandrel 110. The coupling ring 116 is coupled to the link support housing 113 using a bearing connection 118, for example, a ball bearing. An exemplary ball bearing is a four point ball bearing having balls disposed between two rings and the balls are guided by two points on each ring. The coupling ring 116 is attached to one ring of the ball bearing, while the link support housing 113 is attached to the other ring of the ball bearing. The bearing connection 118 allows the coupling ring 116 to rotate with the mandrel 110 while the link support housing 113 remains non-rotational. Also, the bearing connection 118 allows axial loads from the links 112 to be transferred to the mandrel 110.

Figure 4:
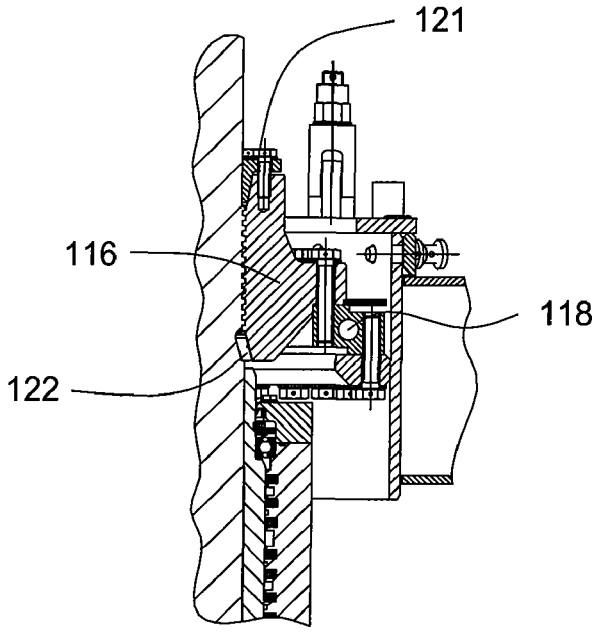
FIGS. 4-6 are partial views of the link assembly shown in FIG. 3.
Figure 5:
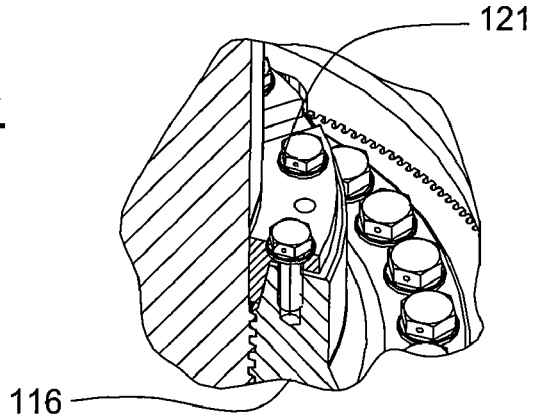
Figure 6:
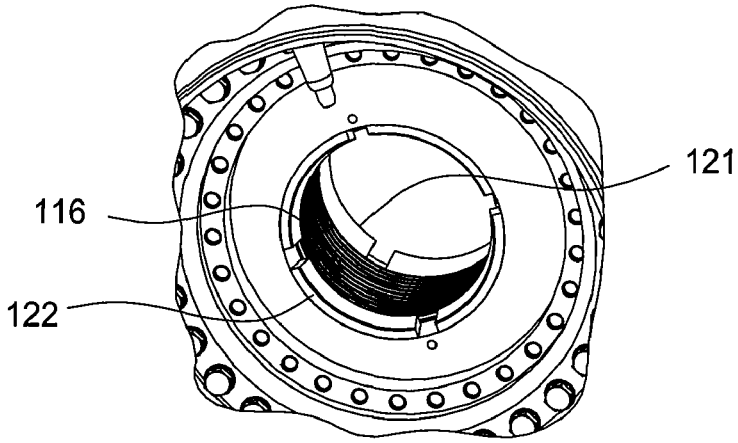

FIGS. 4-6 are different views of the coupling ring 116 or nut. As shown, one or more arcuate clamping segments 121 may be disposed in an upper portion of the coupling ring 116 and between the coupling ring and the mandrel. The segments 121 may be attached to the coupling ring 116 using a fastener such as a bolt or screw. The clamping segments 121 minimize the clearance and relative movement with the links 112 during rotation of the coupling ring 116. One or more tapered ring segments 122 may also be disposed in a lower portion of the coupling ring 116 to reduce radial clearance. In one embodiment, four clamping segments 121 and two ring segments are coupled to the coupling ring 116. FIG. 5 is a partial view showing the clamping segments 121 attached to the coupling ring 116. FIG. 6 a partial bottom view of the coupling ring 16 without the mandrel 110. The view shows the threads of the coupling ring 116 and the clamping segments 121 and ring segments 122.

Referring again to FIG. 3, the link assembly 108 may include a retainer 125 for connection to a torque reaction bracket ("TRB"). The retainer 125 may be connected to an upper portion of the link support housing 113 using fasteners such as bolts 124. In use, one end of the torque reaction bracket couples to the retainer 125 and another end couples to a rotationally fixed location, such as a rail on a drilling derrick or part of the top drive. This arrangement helps maintain the link support housing 113 in a non-rotational position when the mandrel 110 and the coupling ring 116 are rotated by the top drive or motor.

In addition to the coupling ring 116, the link assembly 108 may also include a secondary retention device, such as shackles 126, for coupling with the top drive. In one embodiment, four shackles 126 may be connected to the top portion of the link support housing 113. An elongated member such as a rope, link, or chain may connect the shackles 126 to the link ears on the top drive. In this respect, the link assembly 108 may be supported by the top drive.

Figure 8:
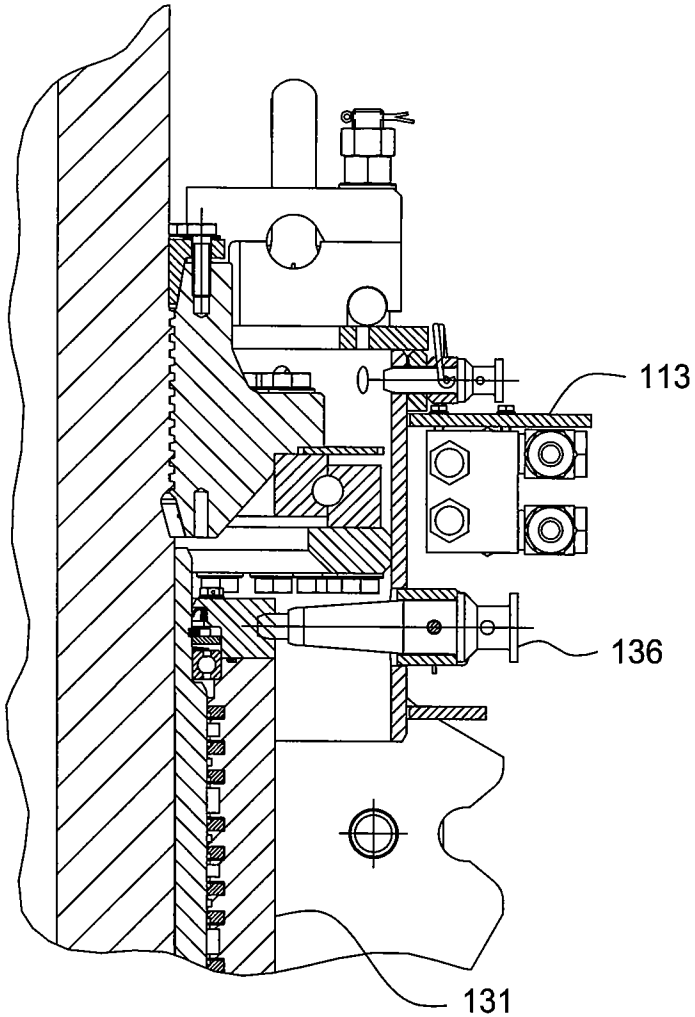
FIG. 8 is a partial cross-sectional view of the swivel and the mandrel shown in FIG. 3.
Figure 7:
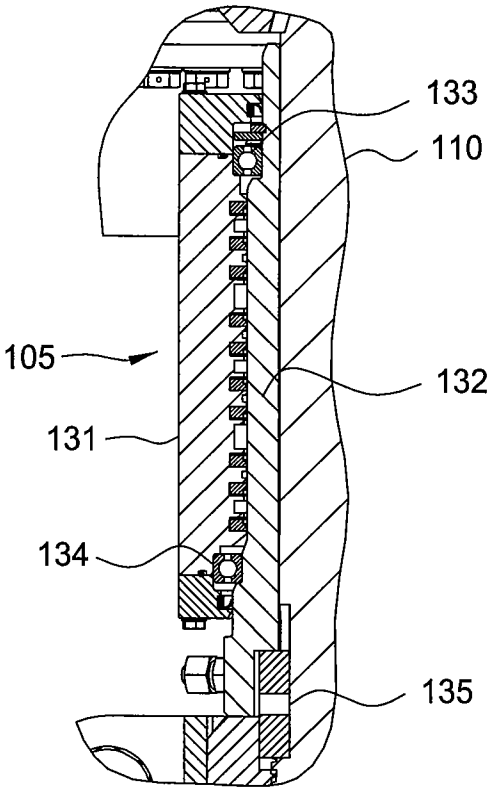
FIG. 7 is a partial cross-sectional view of the swivel shown in FIG. 3.

FIGS. 7 and 8 are partial cross-sectional views of the swivel 105 and the mandrel 110. The swivel includes an outer body 131, an inner body 132, and upper and lower bearings 133, 134 for relative rotational movement between the outer body 131 and the inner body 132. The inner body 132 is connected to the mandrel 110 using a spline connection 135 or other suitable mechanisms such as a pin connection. In this respect, the inner body 132 may rotate with the mandrel 110. The outer body 131 is coupled to the link support housing 113 using a torque bolt 136. In this respect, the outer body 131 may remain stationary with the link support housing 113 during rotation of the mandrel 110 and the inner body 132. In this embodiment, the swivel 105 does not carry any axial load from the links 112. This axial load free arrangement allows other suitable swivel designs known to a person of ordinary skill in the art to be used with the link assembly 108. The swivel may be used to supply fluid such as hydraulic fluid to the tubular handling apparatus for operation thereof. In another embodiment, the swivel may include one or more sensors for measuring the torque applied to the mandrel during its rotation.

Figure 8A:
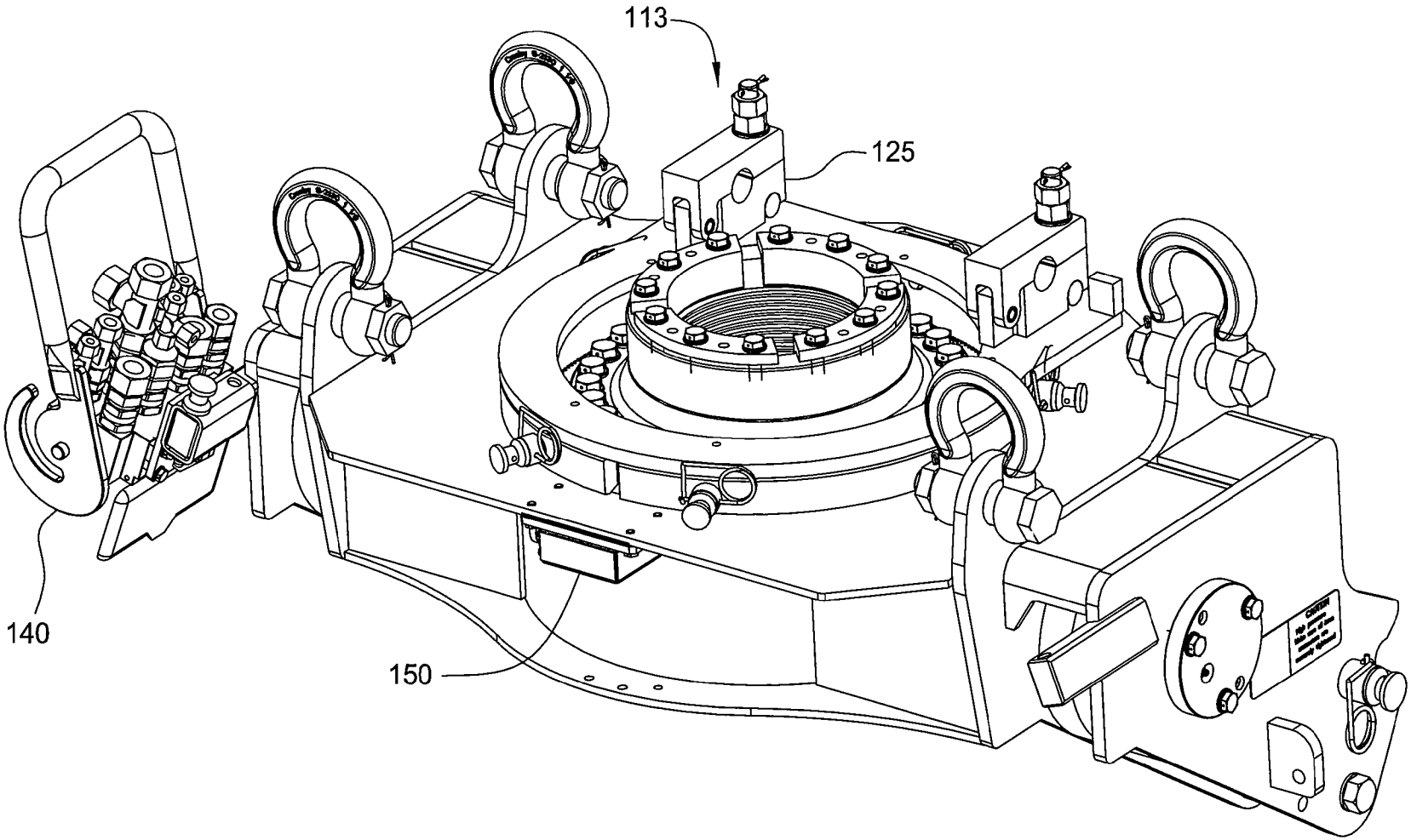
FIGS. 8A-8E are additional views of the link assembly shown in FIGS. 1 and 2.
Figure 8B:
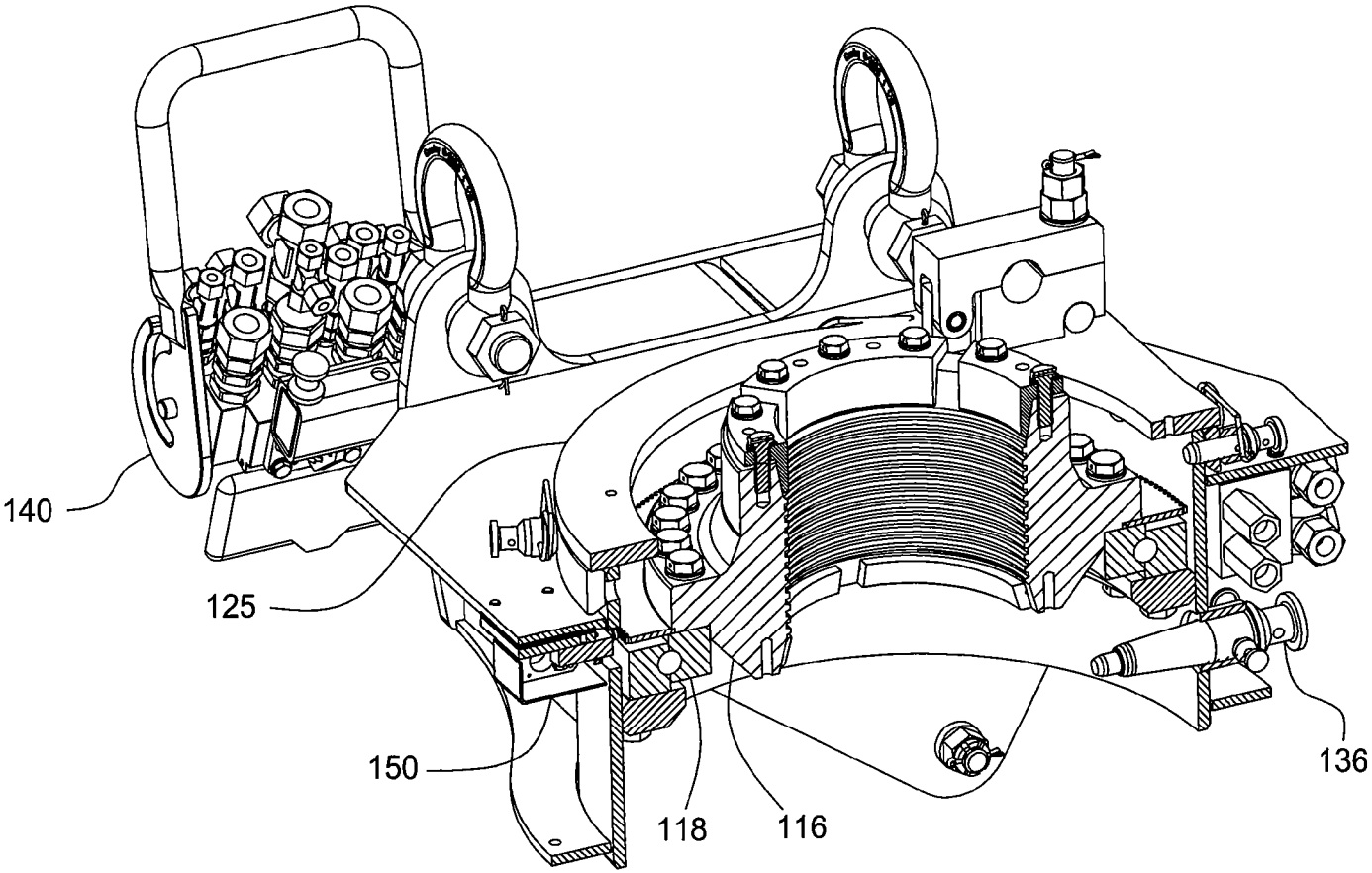
Figure 8C:
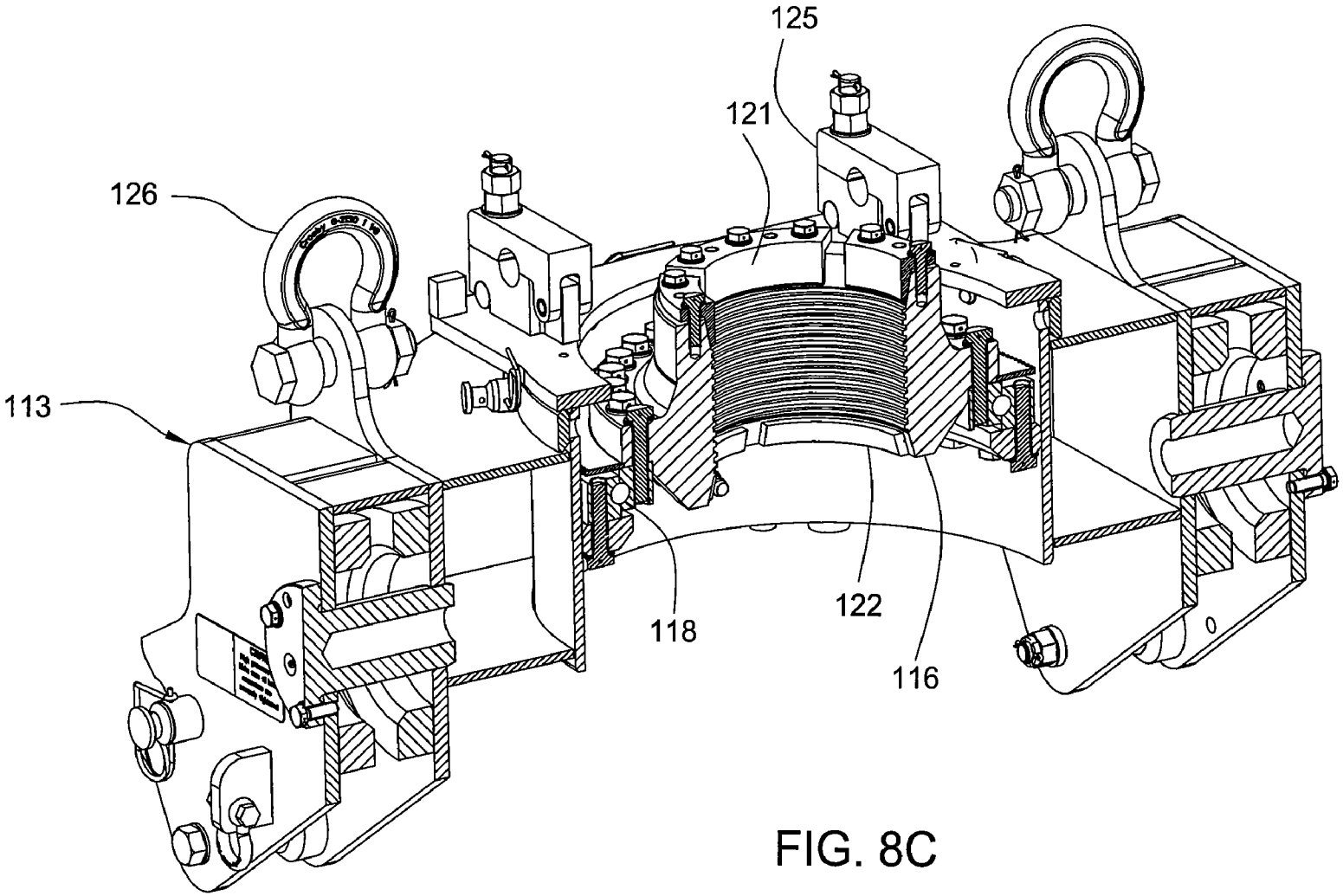
Figure 8D:
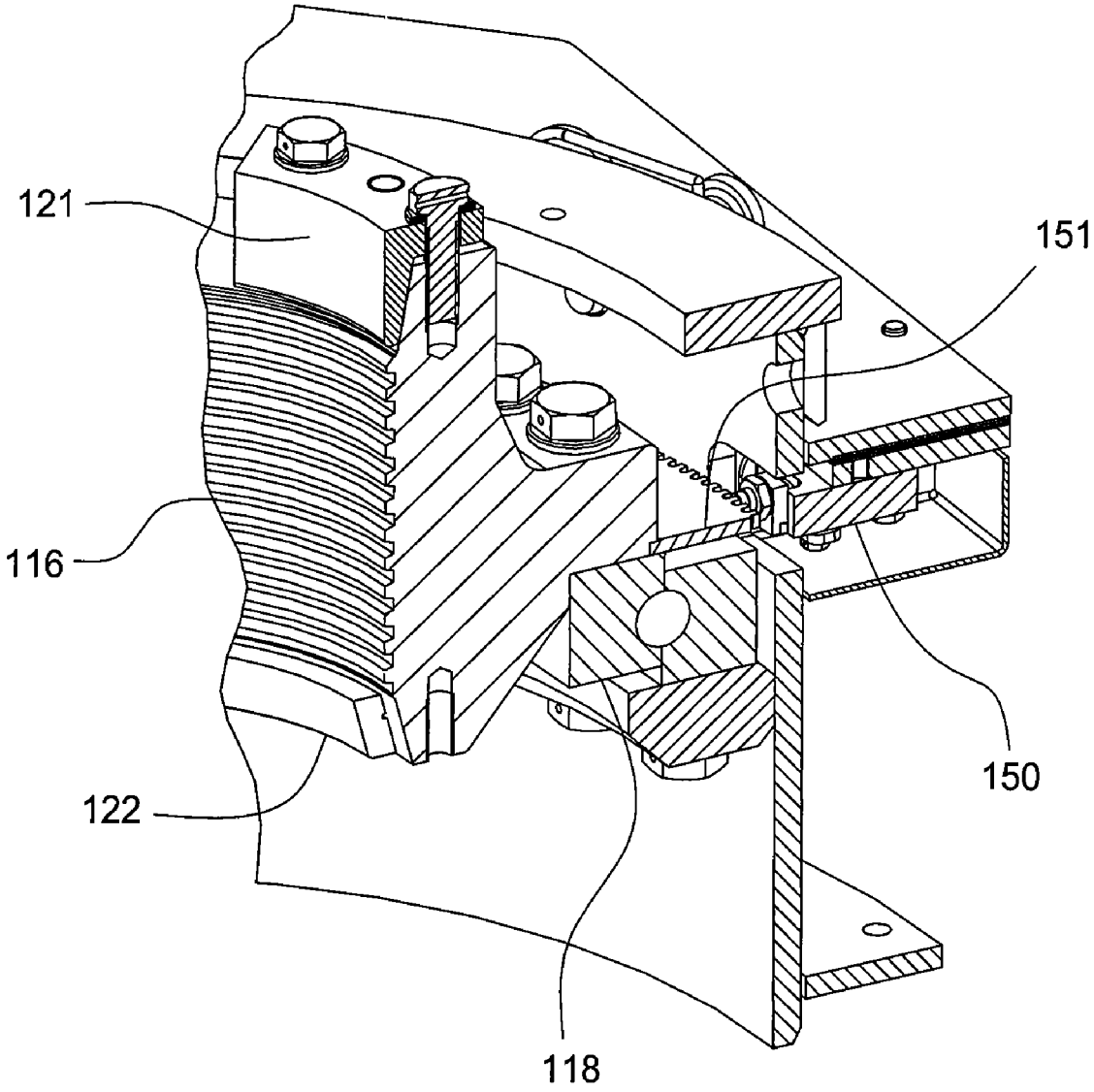
Figure 8E:
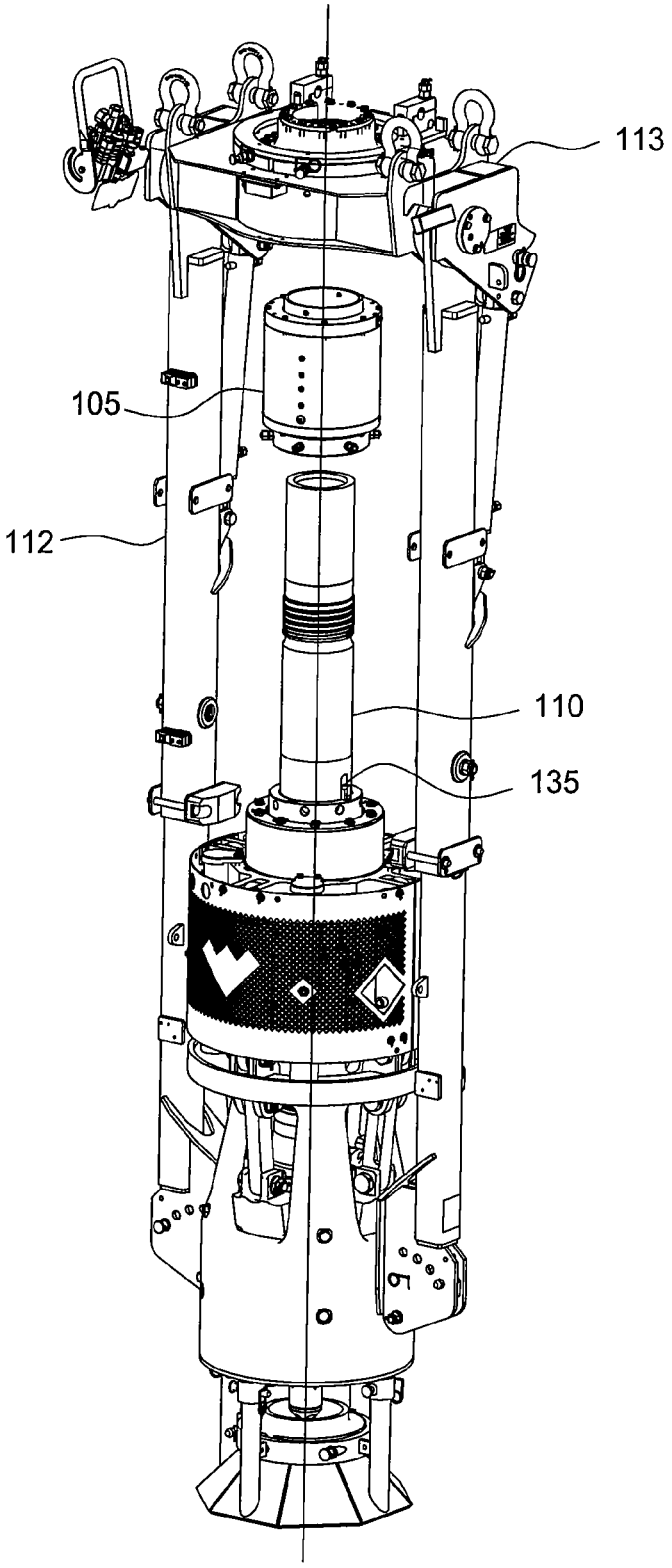

FIGS. 8A-8E are additional views of the link assembly. FIG. 8A is a perspective view of the link support housing 113. In one embodiment, the link assembly may include a multi-coupling 140 for connection to one or more control lines. Also, a torque counter 150 is attached to the link support housing 113. FIGS. 8B-8D are partial cross-sectional views of the link support housing. FIG. 8B is a cross-sectional view of the coupling ring 116, the bearing 118, the retainer 125, and the turn counter 150. FIG. 8C is a cross-sectional view of the link support housing 113, coupling ring 116, the bearing 118, the clamping segments 121, and ring segments 122. FIG. 8*d* is a cross-sectional view of the coupling ring 116, the bearing 118, the clamping segments 121, and ring segments 122, the turn counter 150, and the rotating plate 151. FIG. 8E shows the mandrel 110, the swivel 105, and the link assembly 112, 113 prior to assembly to the mandrel of an external gripping tool. To assembly to tool, the swivel 105 is inserted over the mandrel 110 and the inner body 132 is positioned into engagement with the spline 135. Thereafter, the link support housing 113 inserted over mandrel 110 and threadedly attaches to the threads on the mandrel 110 above the swivel 105. It must be noted that the swivel and/or the link assembly are usable with the internal gripping tool 100 or the external gripping tool 200.

Figure 9:
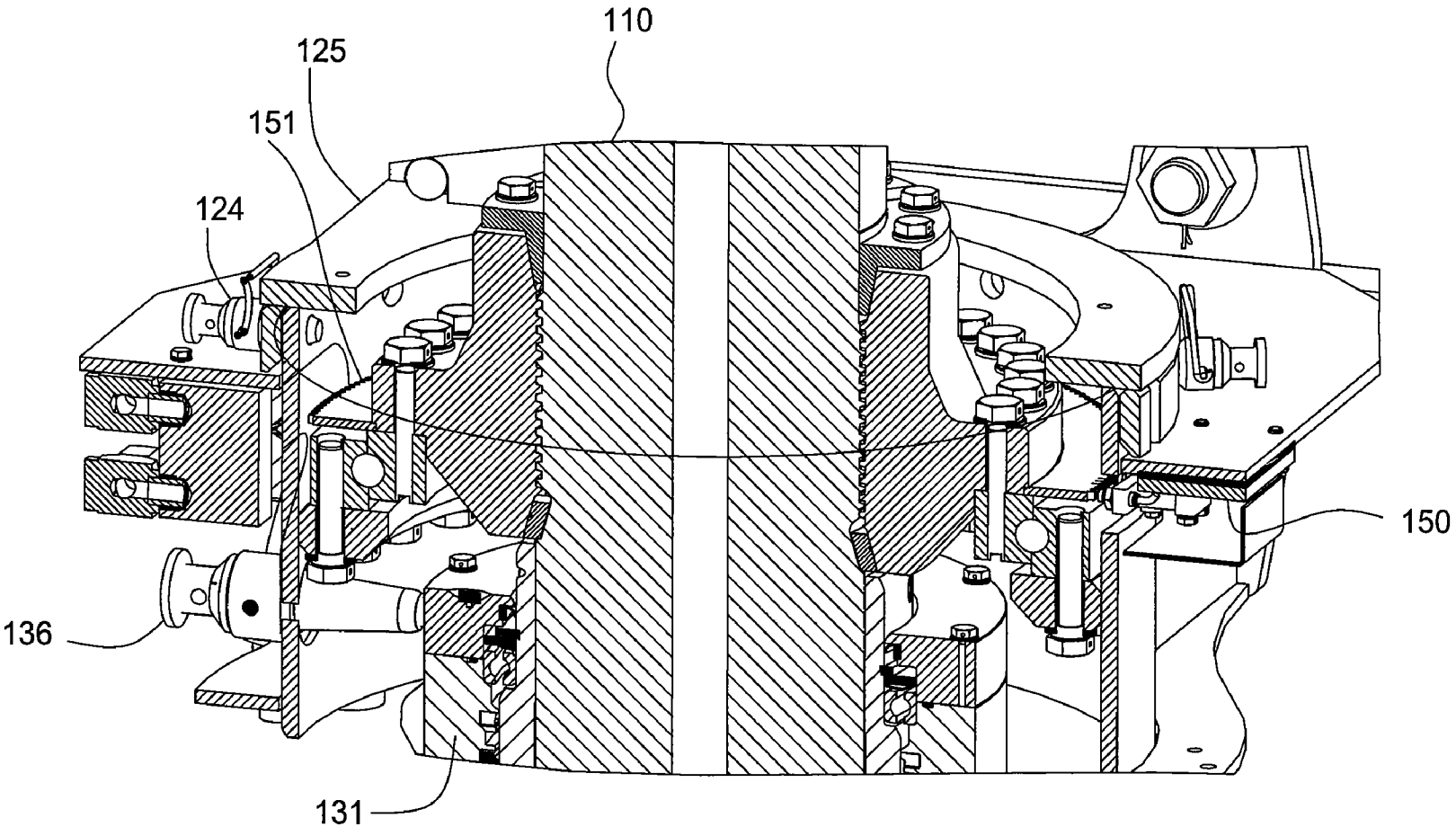
FIG. 9 is a cross-sectional of the link assembly of FIG. 1 attached to the mandrel. The link assembly is shown equipped with a turn counter.
Figure 10:
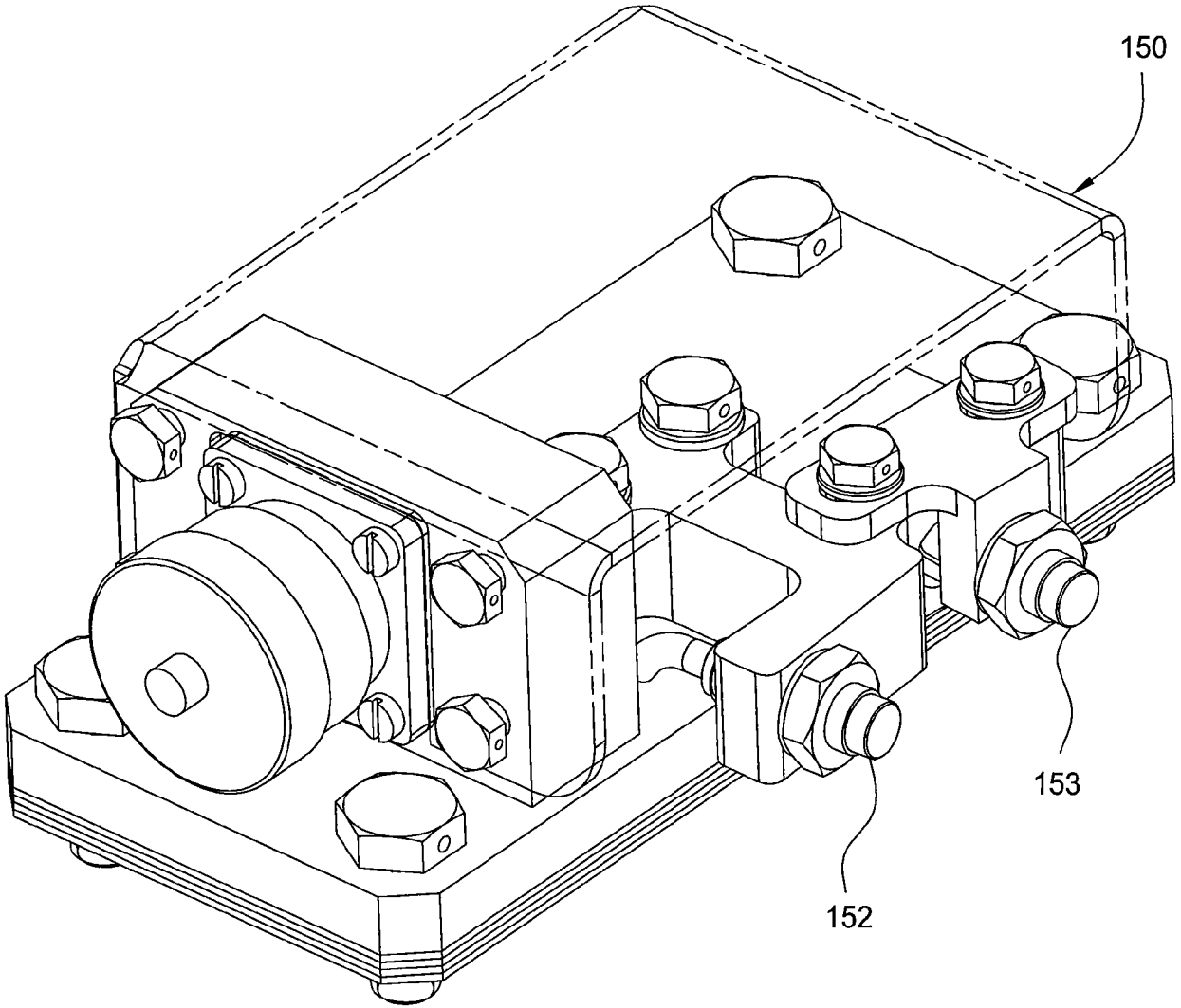
FIG. 10 shows an exemplary turn counter suitable for use with the link assembly shown in FIG. 1.

FIG. 9 shows the link assembly 108 equipped with a turn counter 150. FIG. 10 shows an exemplary turn counter 150 usable with the link assembly 108. The turn counter 150 may include a rotating plate 151 attached to the coupling ring 116 and rotatable therewith. The plate 151 has a plurality of teeth disposed on its outer perimeter. The turn counter 150 also includes one or more sensors 152, 153 mounted to the non-rotational portion of the link support housing 113. The sensors 152, 153 are positioned adjacent the plurality of teeth and are adapted to detect the passing of each tooth. In one embodiment, the sensors 152, 153 detect the teeth using magnetic or inductive signals. Each sensor 152, 153 is adapted to detect the presence or absence of the teeth. In an example of a plate having 250 teeth, each of the two sensors may generate a signal for the presence of the teeth and a signal for the absence of the teeth for a total combined 1,000 signals for each turn of the plate. Unlike prior known turn counters that use a gear for counting rotations, embodiments of the turn counter 150 directly measure the number of rotations of the mandrel 110. The use of two signals allows the direction of the plate to be measured. However, it is contemplated that the link assembly 108 may use one or more sensors to count the number of rotations of the plate or mandrel. In another embodiment, the sensors 152, 153 may be adjustable for proper positioning relative to the plate 151. For example, one or both of the sensors 152, 153 may be threadedly attached to the turn counter 150, and thus, rotated to adjust its position. Additionally, the turn counter 150 may be mounted to the link support housing 113 using an adjustable mounting plate, which may be moved relative to the rotating plate 151. In another embodiment, the turn counter 150 may be equipped with a gear for engaging the rotating plate 151, whereby rotation of the gear may be used to calculate rotation of the tubular.

Figure 10B:
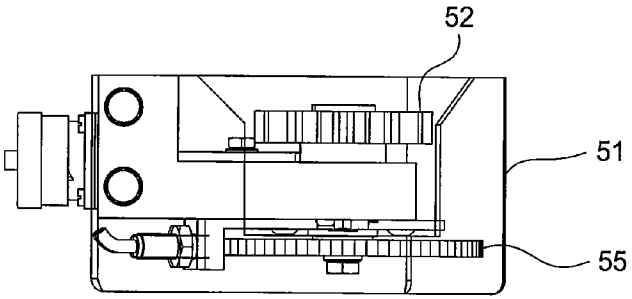
FIGS. 10A-10D show another embodiment of a turn counter suitable for use with the link assembly shown in FIG. 1.
Figure 10D:
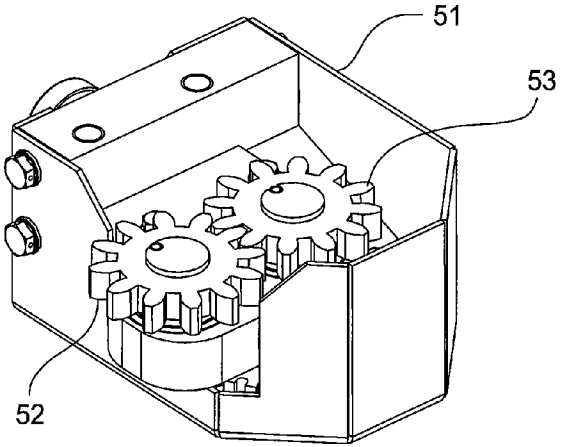
Figure 10A:
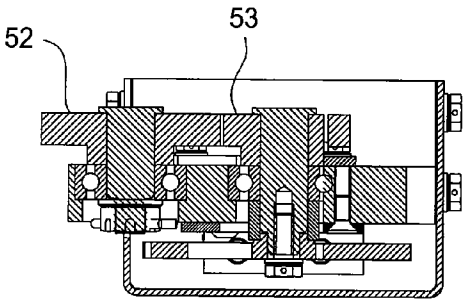
Figure 10C:
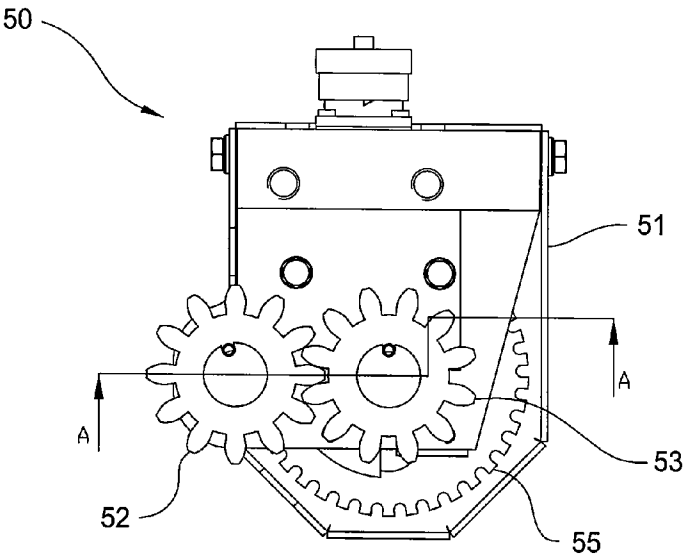

FIGS. 10A-10D show another embodiment of a turn counter suitable for use with the link assembly 108 or other gripping tools. FIG. 10A is a cross-sectional view of the turn counter along line A-A in FIG. 10C. FIG. 10B is a side view of the turn counter. FIG. 10C top view of the turn counter. FIG. 10D is a perspective view of the turn counter. The turn counter 50 may include a rotating plate attached to the coupling ring 116 and rotatable therewith. The plate has a plurality of teeth disposed on its outer perimeter. The turn counter 50 includes an engagement gear 52 coupled to a transfer gear 53. The engagement gear 52 is adapted to engage the teeth of the rotating plate. Rotation of the engagement gear 52 is transferred to the transfer gear 53 which is coupled to a counting gear 55. The counting gear 55 shares the same rotational axis as the transfer gear 53. In one embodiment, one or more sensors may be used to measure rotation of the counting gear 55 to determine the number of rotations of the tubular. The turn counter 50 may include a housing 51 to facilitate installation of the turn counter to the tubular handling apparatus.

The turn counter 150 also includes one or more sensors 152, 153 mounted to the non-rotational portion of the link support housing 113. The sensors 152, 153 are positioned adjacent the plurality of teeth and are adapted to detect the passing of each tooth. In one embodiment, the sensors 152, 153 detect the teeth using magnetic or inductive signals. Each sensor 152, 153 is adapted to detect the presence or absence of the teeth. In an example of a plate having 250 teeth, each of the two sensors may generate a signal for the presence of the teeth and a signal for the absence of the teeth for a total combined 1,000 signals for each turn of the plate. Unlike prior known turn counters that use a gear for counting rotations, embodiments of the turn counter 150 directly measure the number of rotations of the mandrel 110. The use of two signals allows the direction of the plate to be measured. However, it is contemplated that the link assembly 108 may use one or more sensors to count the number of rotations of the plate or mandrel. In another embodiment, the sensors 152, 153 may be adjustable for proper positioning relative to the plate 151. For example, one or both of the sensors 152, 153 may be threadedly attached to the turn counter 150, and thus, rotated to adjust its position. Additionally, the turn counter 150 may be mounted to the link support housing 113 using an adjustable mounting plate, which may be moved relative to the rotating plate 151. In another embodiment, the turn counter 150 may be equipped with a gear for engaging the rotating plate 151, whereby rotation of the gear may be used to calculate rotation of the tubular.

Figure 11:
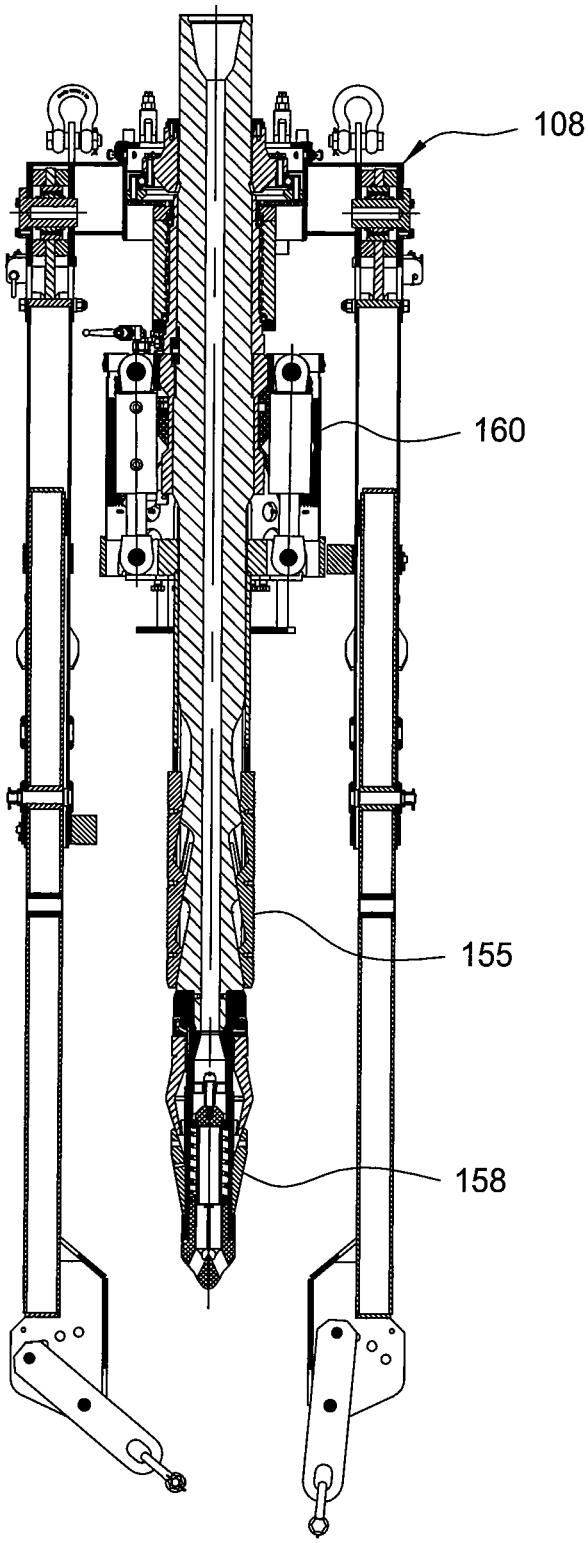
FIG. 11 is a cross-sectional view of an exemplary internal gripping tool.

FIG. 11 is a cross-sectional view of an exemplary internal gripping tool 100. The internal gripping tool includes the mandrel 110, gripping elements 155, and a hydraulic actuator 160 for actuating the gripping elements 155. As shown, the gripping elements 155 are wedge type slips disposed on a mating wedge surface of the mandrel 110. Axial movement of the slips relative to the mandrel 110 urges the slips to move radially outward or inward. The internal gripping tool 100 may optionally be equipped with a fill-up tool 158.

Figure 12:
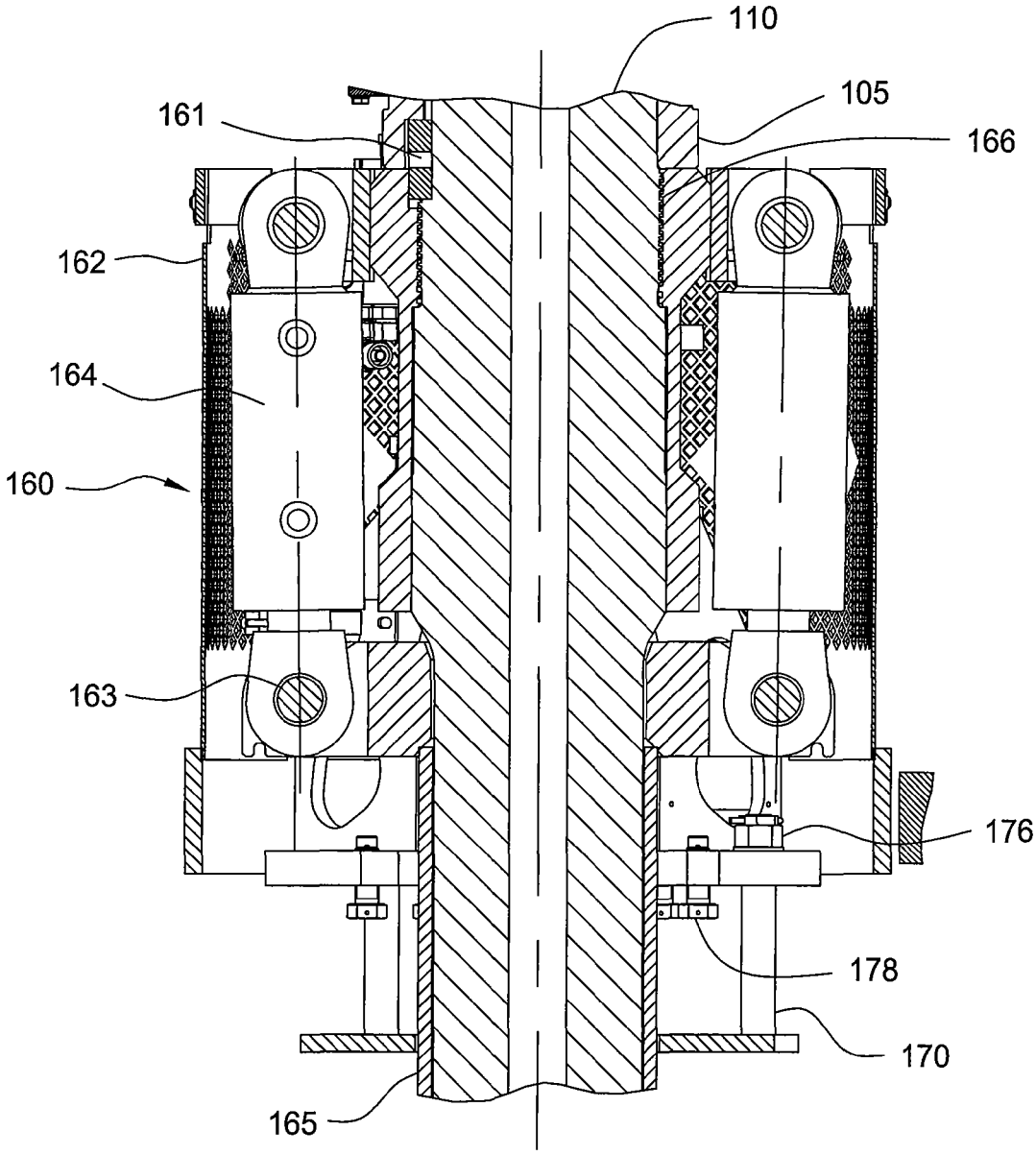
FIG. 12 is a cross-sectional view of an exemplary hydraulic actuator suitable for use with the internal gripping tool shown in FIG. 11.

FIG. 12 is an enlarged view of an exemplary hydraulic actuator 160. The actuator 160 includes a housing 162 having a threaded connection 166 to the mandrel 110. The housing 162 may also be secured to the mandrel 110 using a spline connection 161 or other suitable mechanisms such as a pin connection. One or more actuator cylinders 164 attached to the housing 162 using bolts 163 are coupled to an actuator pipe 165. The actuator pipe 165 is connected to the gripping elements 155. Activation of the actuator cylinder 164 urges axial movement of the gripping elements 155 relative to the mandrel 110. A coupling engagement plate (or bumper plate 170) may also be attached to the hydraulic actuator 160. In one embodiment, the engagement plate 170 is movable relative to the actuator 160. Contact with the casing coupling may cause axial movement of the engagement plate 170. A stop member 178 may be provided to limit the travel of the engagement plate 170.

Figure 13:
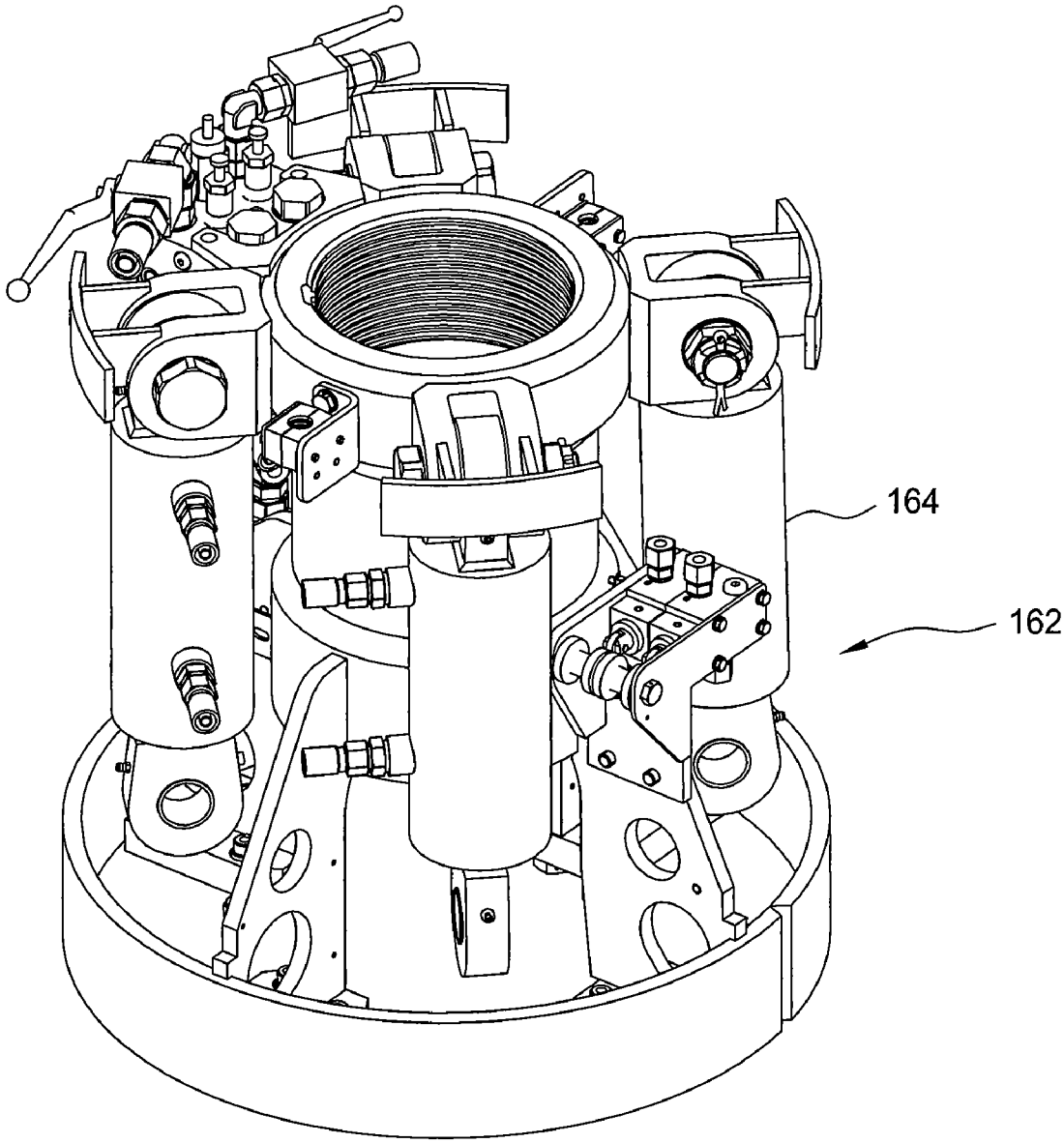
FIG. 13 shows a housing of the hydraulic actuator shown in FIG. 12.

In one embodiment, the hydraulic actuator 160 may be removed from the internal gripping tool as one assembly. Referring to FIG. 12, after removal of the swivel, the crown nut 176 is removed. The engagement plate 170 is then removed. Then, the bolts 163 to the hydraulic cylinder 164 are removed to disengage the actuator pipe 165 for removal. The engagement plate 170 and the actuator pipe 165 are removed from the bottom of the internal gripping tool 100. The spline connection is then removed so that the housing 162 may be unthreaded from the mandrel 110. FIG. 13 shows the housing 162 after removal. It must be noted that one or more of these steps may be performed in any suitable order. For example, the bolts 163 may be removed before the engagement plate 170.

Figure 14:
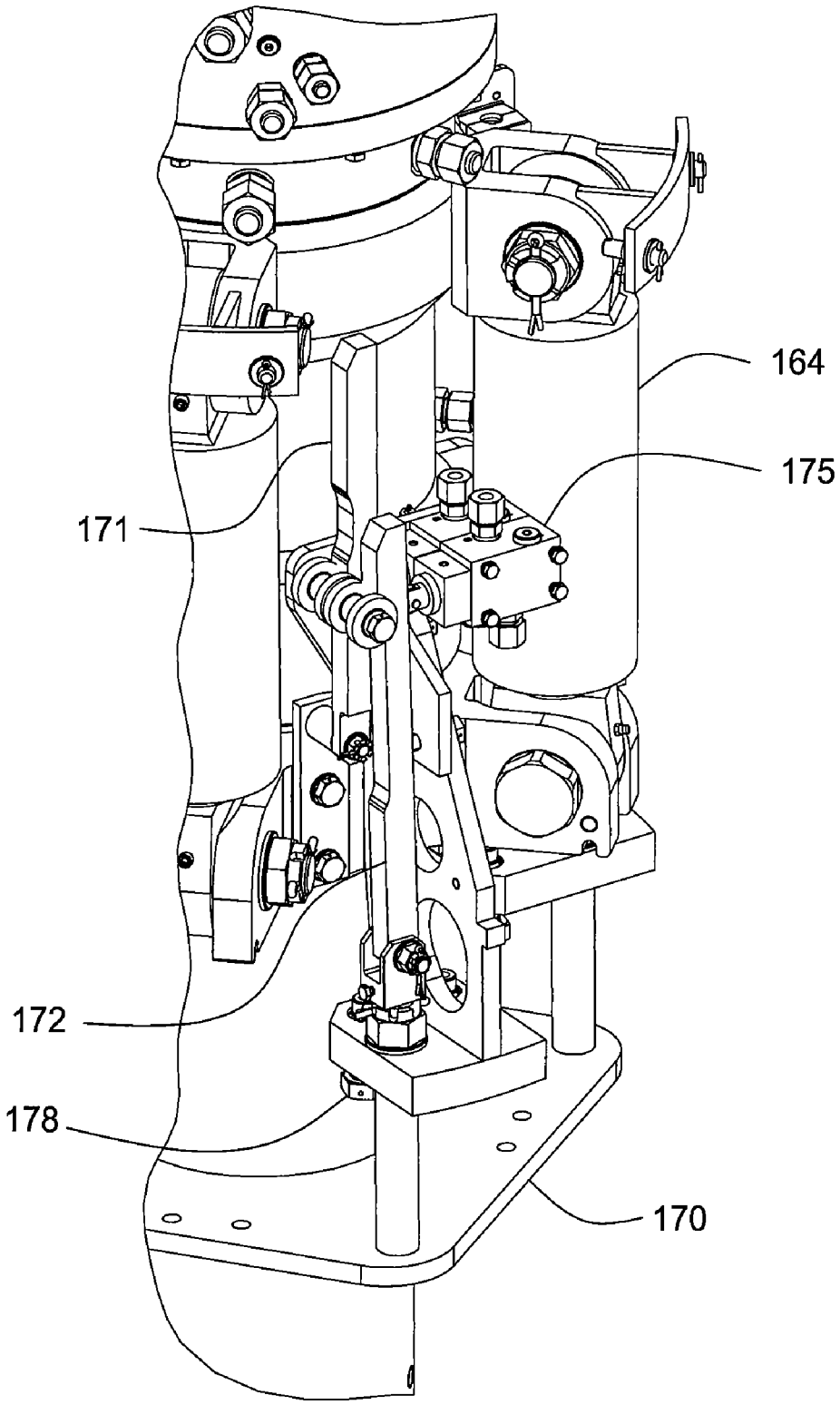
FIGS. 14-15 are partial views of an internal gripping tool of FIG. 1.
Figure 15:
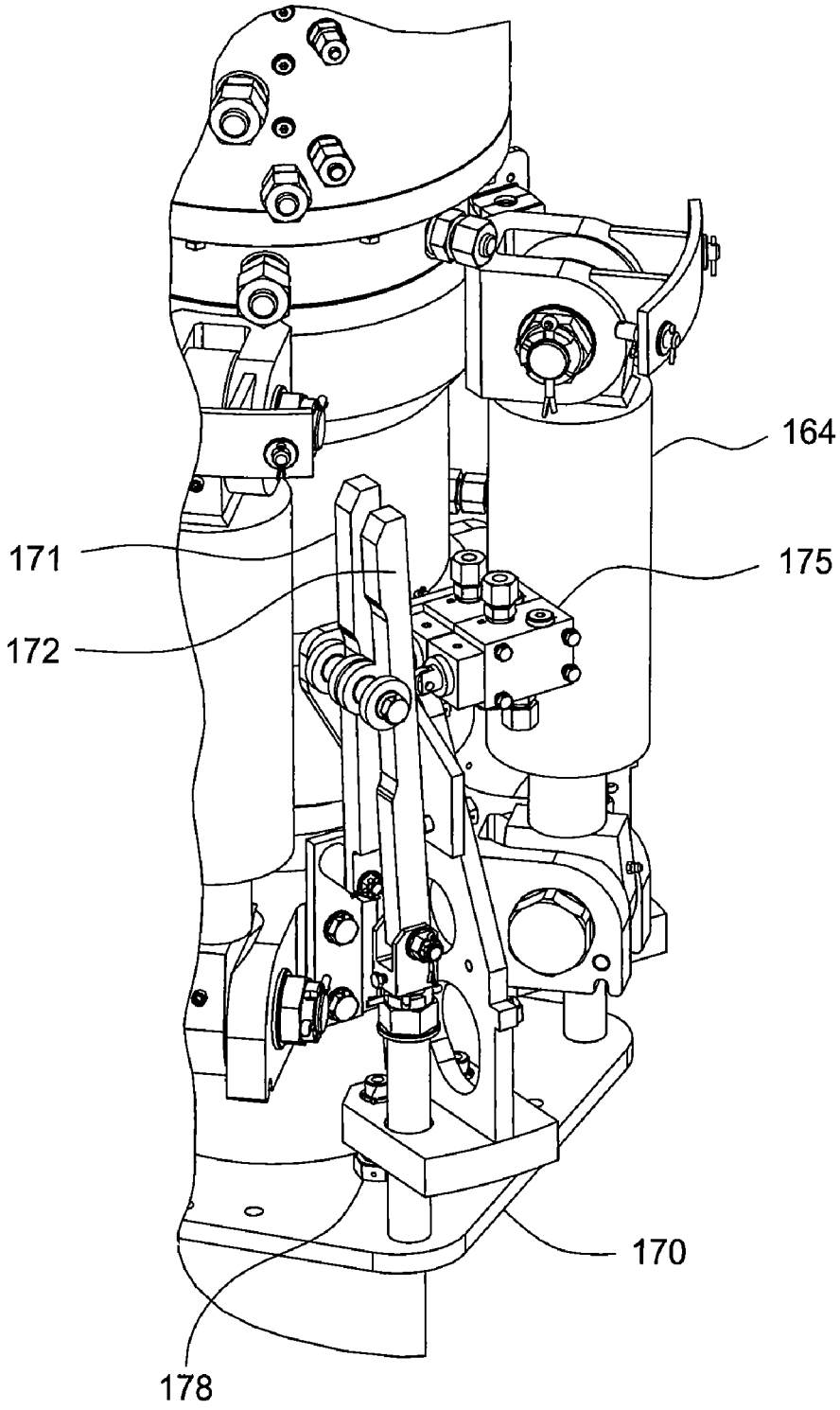
Figure 18:
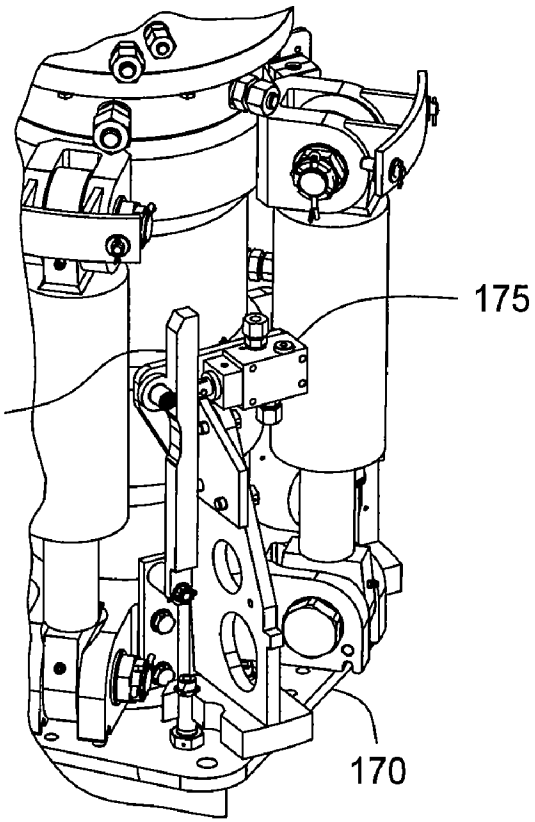
FIGS. 16-18 show sequential movement of the clamp indicator of the internal gripping tool of FIG. 1.
Figure 17:
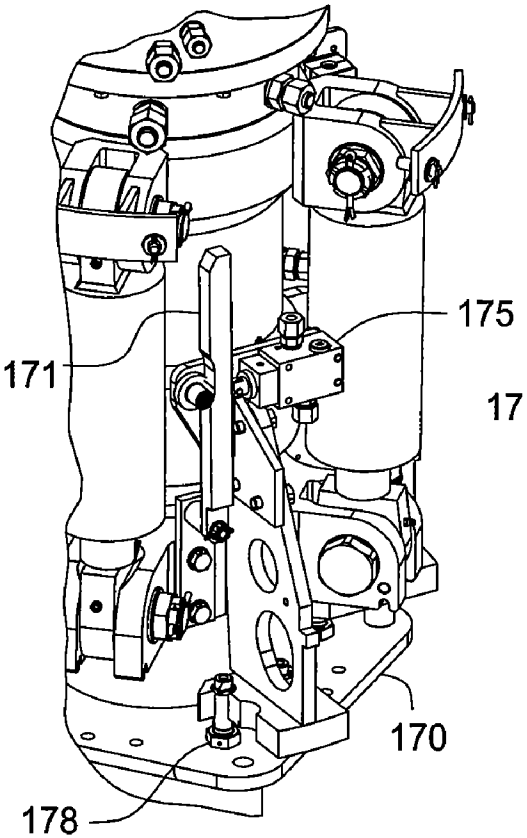
Figure 16:
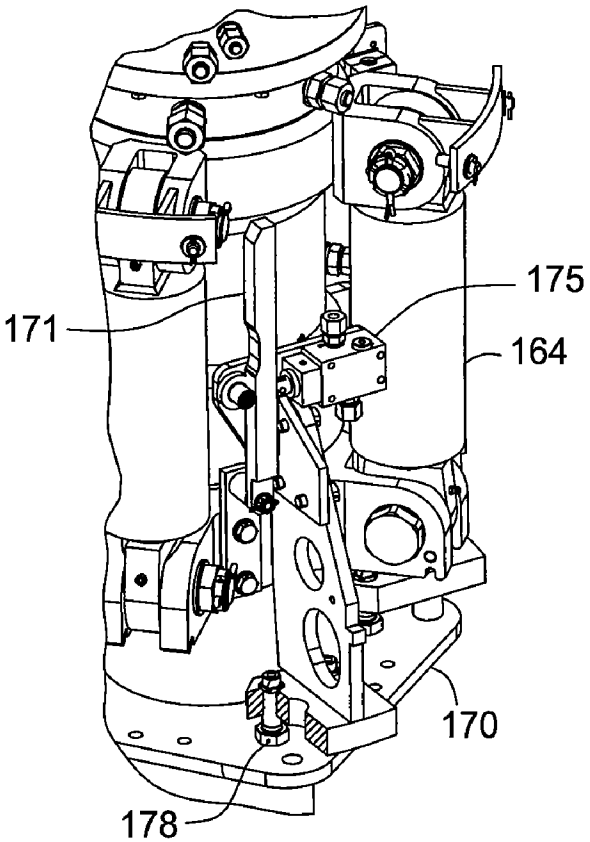

FIGS. 14-15 are partial views of an internal gripping tool provided with a clamp indicator 171 and a coupling indicator 172. In one embodiment, the clamp indicator 171 is an elongated member coupled to the actuator pipe 165 and movable therewith. The clamp indicator 171 has tapered portions along its body to indicate the position of the gripping elements 155. As shown, the clamp indicator 171 has an upper portion, a middle narrow portion, and a lower portion. A sensor 175 positioned adjacent the clamp indicator 171 is adapted to send a signal indicating the position of the gripping elements 155. In one embodiment, the sensor 175 may include a sensor head attached to a piston. The piston may move the sensor head relative to the contour of the indicator 171, thereby determining the position of the indicator 171. For example, when the lower portion is detected, the sensor 175 would send a signal indicating that the gripping elements 155 are in the retracted, open position, as shown in FIG. 14. As the gripping elements 155 are extended, the middle narrow portion is moved adjacent the sensor 175, which will indicate that the gripping elements 155 are clamped, as shown in FIG. 15. As long as the middle portion is adjacent the sensor 175, the sensor 175 will continue to indicate that the gripping elements 155 are clamped. FIGS. 16-18 show the sequence of movement of the clamp indicator 171 relative to the sensor as the gripping elements 155 are extended. In FIG. 16, the clamping indicator 171 shows the gripping elements are in the unclamped position. In FIG. 17, the clamping indicator shows the gripping elements are in the clamped position as indicated by the sensor 175. In FIG. 18, the upper portion is positioned adjacent the sensor 175, which indicates that the gripping elements 155 are clamped, but a tubular is not present.

Figure 19B:
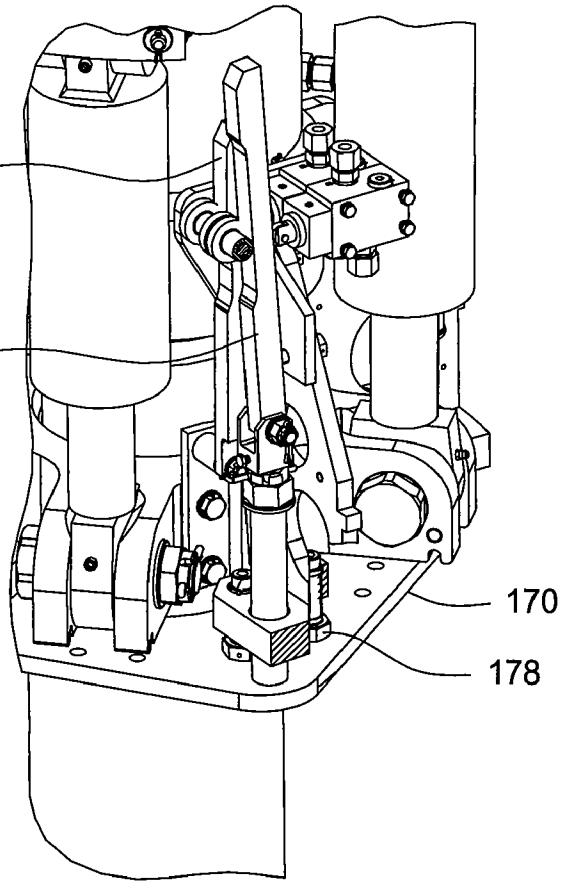
FIGS. 19A-19B show sequential movement of the coupling indicator of the internal gripping tool of FIG. 1.
Figure 19A:
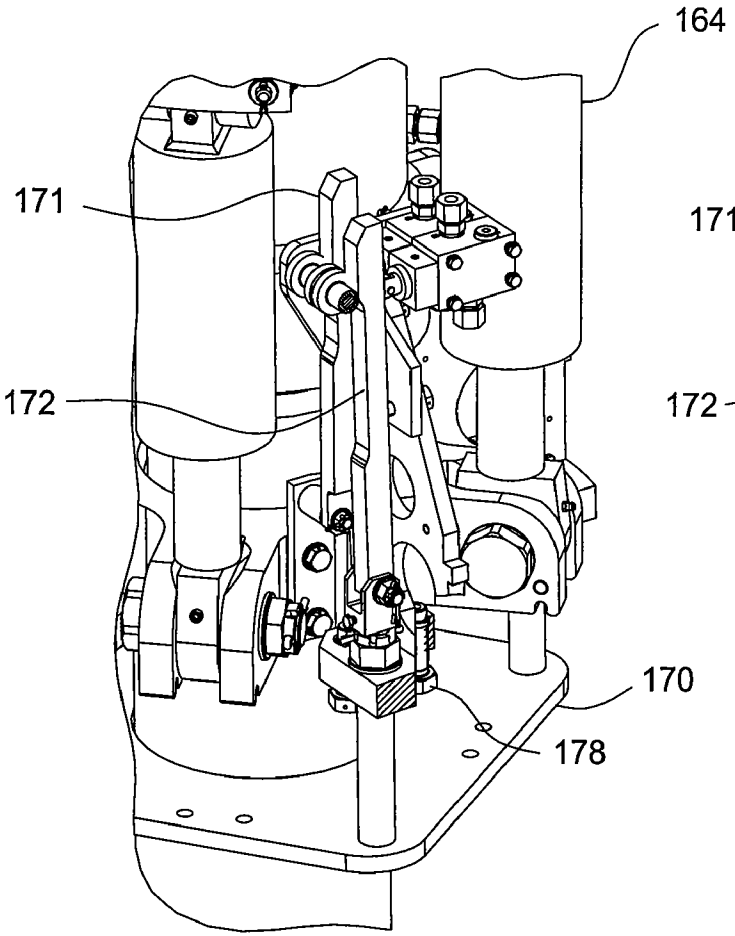
Figure 20:
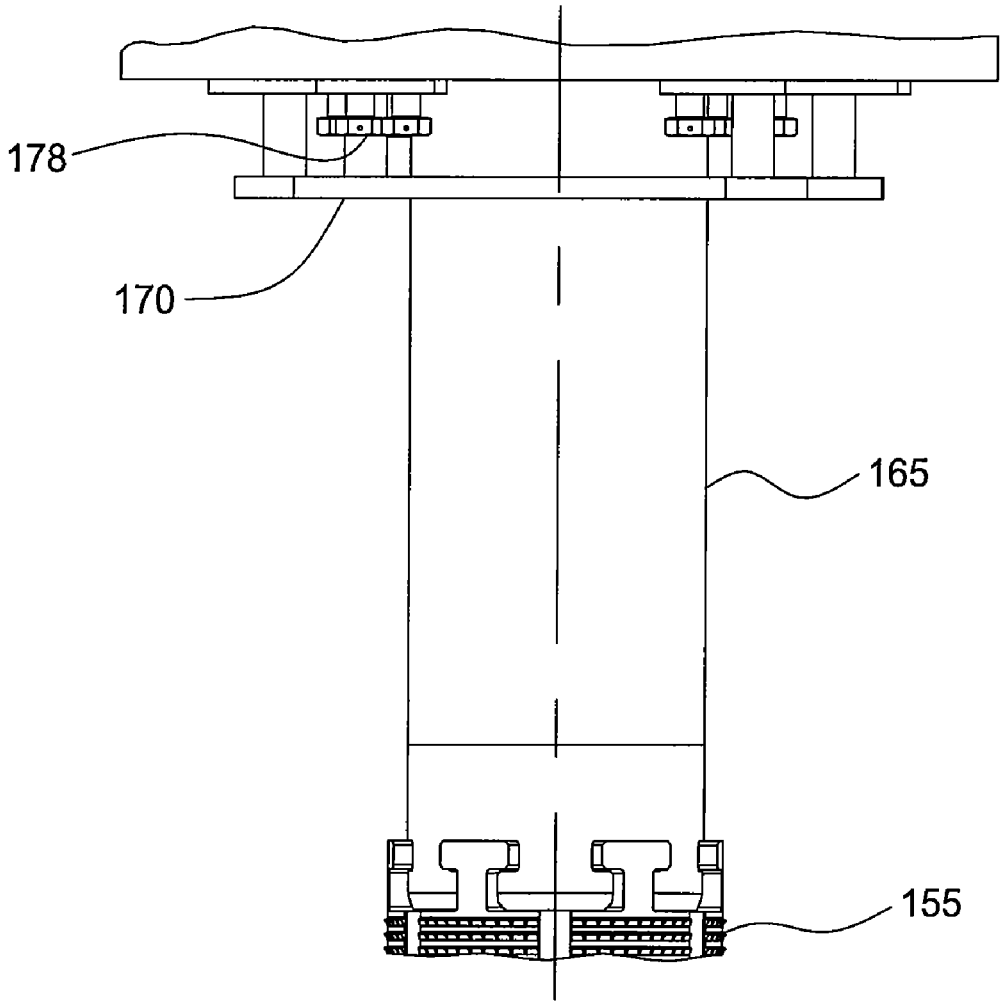
FIG. 20 is a perspective of an engagement plate of the internal gripping tool shown in FIG. 1.

The coupling indicator 172 may also be an elongated member having tapered portions to indicate the position of the tubular coupling. A lower end of the coupling indicator 172 is connected to the coupling engagement plate 170 and movable therewith. In one embodiment, the coupling indicator 172 has an upper narrow portion and a lower wide portion to indicate the absence or presence of the coupling. The sensor 175 for detecting clamp indicator 171 may be adapted to also detect the coupling indicator 172. When the upper narrow portion is detected, the sensor 175 will signal that the coupling has not been contacted, as shown in FIG. 19A. When the coupling engages the engagement plate 170 and causes the plate 170 to move, the lower wide portion will in turn be moved in position for detection by the sensor 175, which will signal that the coupling has been engaged, as shown in FIG. 19B. In one embodiment, a stop member 178 attached to the actuator housing 162 may limit the movement of the engagement plate 170. Additionally, the stop member 178 may be adapted to prevent or release a wedge lock situation. Embodiments of the wedge lock prevention are disclosed in a provisional patent application filed on the same date as the present application. The provisional patent application disclosing the wedge lock prevention methods and apparatus is herein incorporated by reference in its entirety. FIG. 20 is a perspective of the engagement plate 170 with respect to stop member 178.

In one embodiment, the signal from the coupling sensor may be used to prevent or allow movement of the gripping elements. For example, when the sensor 175 indicates the coupling has not contacted the engagement plate 170, the gripping elements may be prevented from actuation. In this respect, the gripping elements are prevented from gripping an improper location such as the coupling. In another example, when the sensor 175 indicates the coupling has contacted the engagement plate 170, the gripping elements will be allowed to grip the casing. In another embodiment, the signal from the clamping sensor may be used with an interlock system to ensure the tubular is not inadvertently released. For example, when the sensor indicates gripping elements are in the open position, the interlock system may prevent the spider from opening its slips. The interlock system will not allow the spider from opening until the clamping indicator sends a signal that the gripping elements have engaged the tubular.

Figure 21:
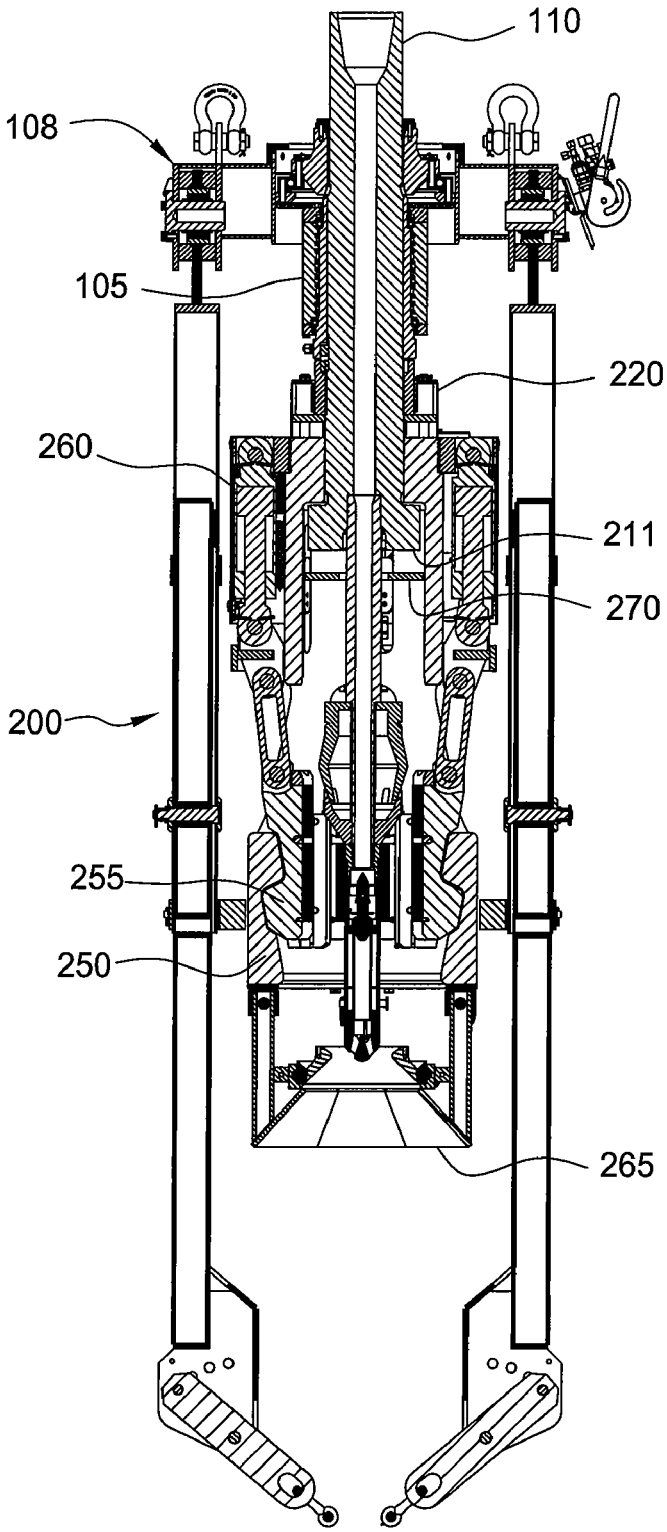
FIG. 21 is a cross-sectional view of an exemplary external gripping tool.

FIG. 21 is a cross-sectional view of the external gripping tool 200. The external gripping tool 200 includes a mandrel 110 coupled to a carrier 250. The mandrel 110 has a load collar 211 which may engage an interior shoulder of the carrier 250. The mandrel 110 may have a polygonal cross-section such as a square for transferring torque to the carrier 250. The external gripping tool 200 also includes a plurality of gripping elements 255 and a hydraulic actuator 260 for actuating the gripping elements 255. In one embodiment, the hydraulic actuator 260 includes a plurality of pistons pivotally coupled to the gripping elements 255. One or more links may be used to couple the gripping elements 255 to the pistons. The hydraulic actuator 260 may be attached to the carrier 250 using a threaded connection. In one embodiment, the gripping elements 255 are slips disposed in the carrier 250. Actuation of the hydraulic actuator 260 causes axial movement of the slips relative to the carrier 250. The gripping elements 255 have wedged shaped back surfaces that engage wedge shaped inner surfaces of the carrier 250. In this respect, axial movement of the gripping elements 255 relative to the wedge surfaces of the carrier 250 causes radial inward movement of the gripping elements. The gripping elements 255 may be detached from the actuator 260 and removed through a window of the carrier 250 or a lower end of the carrier 250. The lower end of the carrier 250 may include a guide cone 265 to facilitate insertion of the tubular. The external gripping tool 200 may optionally be equipped with a fill-up tool 158. Embodiments of the fill-up tool suitable for use with the external gripping tool or internal gripping tool are disclosed in a U.S. patent application Ser. No. 12/435,225, filed on May 4, 2009 by D. Olstad, et al., entitled "Fill Up and Circulation Tool and Mudsaver Valve,", which application incorporated herein by reference in its entirety. In one embodiment, the fill-up tool 158 is attached to a lower end of the mandrel 110 and is adapted to be inserted into the tubular. The fill-up tool 158 may include a valve for control fluid flow into or out of the tool 158.

Figure 22:
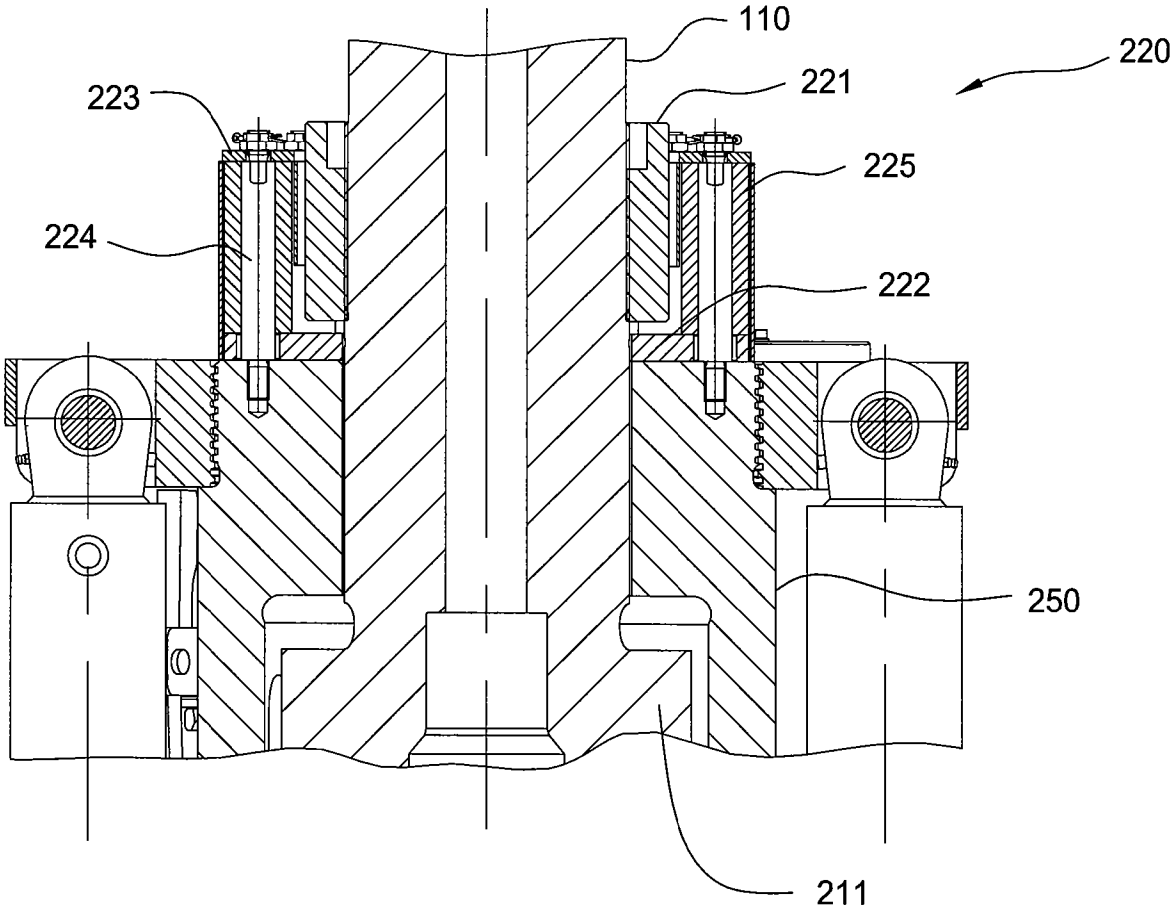
FIG. 22 is a cross-sectional view of an exemplary embodiment of a thread compensator.

A thread compensator 220 may be used to couple the carrier 250 to the mandrel 110. In FIG. 22, the thread compensator is a biased thread compensator 220 that allows the carrier 250 and its attachments to float independent of the mandrel 110. In one embodiment, the compensator 220 includes an attachment ring such as a nut 221 threadedly attached to the exterior of the mandrel 110 and a base plate 222 attached to the mandrel 110. In this respect, the nut 221 and the base plate 222 are fixed relative to the mandrel 110. A cover 223 is provided above the base plate 222 and around the nut 221 to support a plurality of pins 224 that extend through apertures in the base plate 222. Compression springs 225 are disposed around each pin 224 and between the cover 223 and the base plate 222. In this respect, the springs 225 may exert a biasing force between the cover 223 and the base plate 222. Alternatively, belleville washers may be used as the biasing member. Because the base plate 222 is fixed to the mandrel 110, the cover 223 is free to move up and down relative to the base plate 222 as dictated by the spring 225. The movement of the cover 223 is also referred to herein as floating relative to the base plate 222 or mandrel 110. The end of the pins 224 protruding from the base plate 222 is connected to the carrier housing 250. The pins 224 may be connected to the carrier 250 using a threaded connection. The pins 224 allow the carrier 250 to move with the cover 223, and therefore "float" in accordance with the biasing force applied by the springs 225. In other embodiments, springs may be replaced by hydraulic cylinders.

Figure 23:
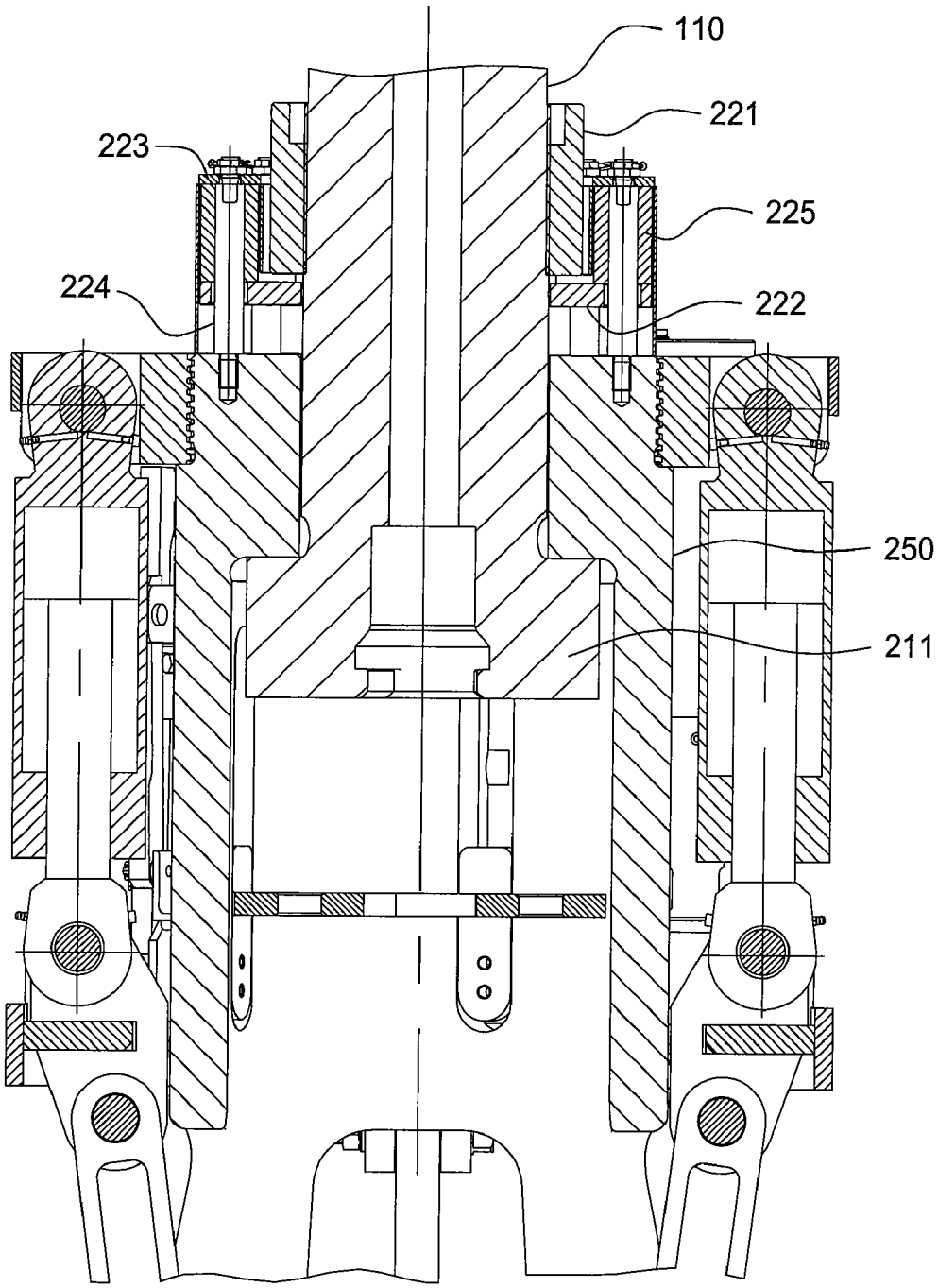
FIGS. 23-25 show various positions of the carrier of the external gripping tool of FIG. 21.
Figure 24:
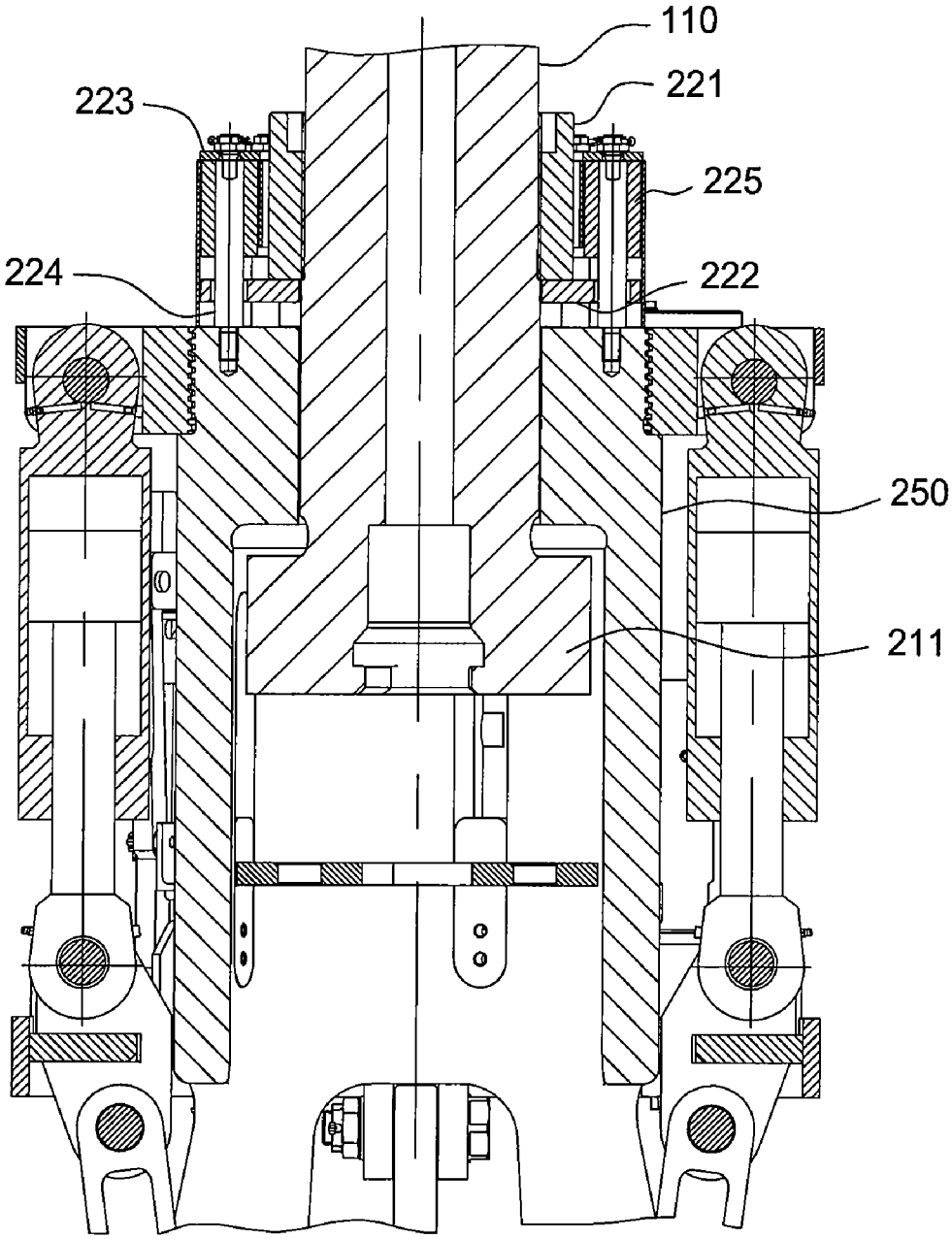
Figure 25:
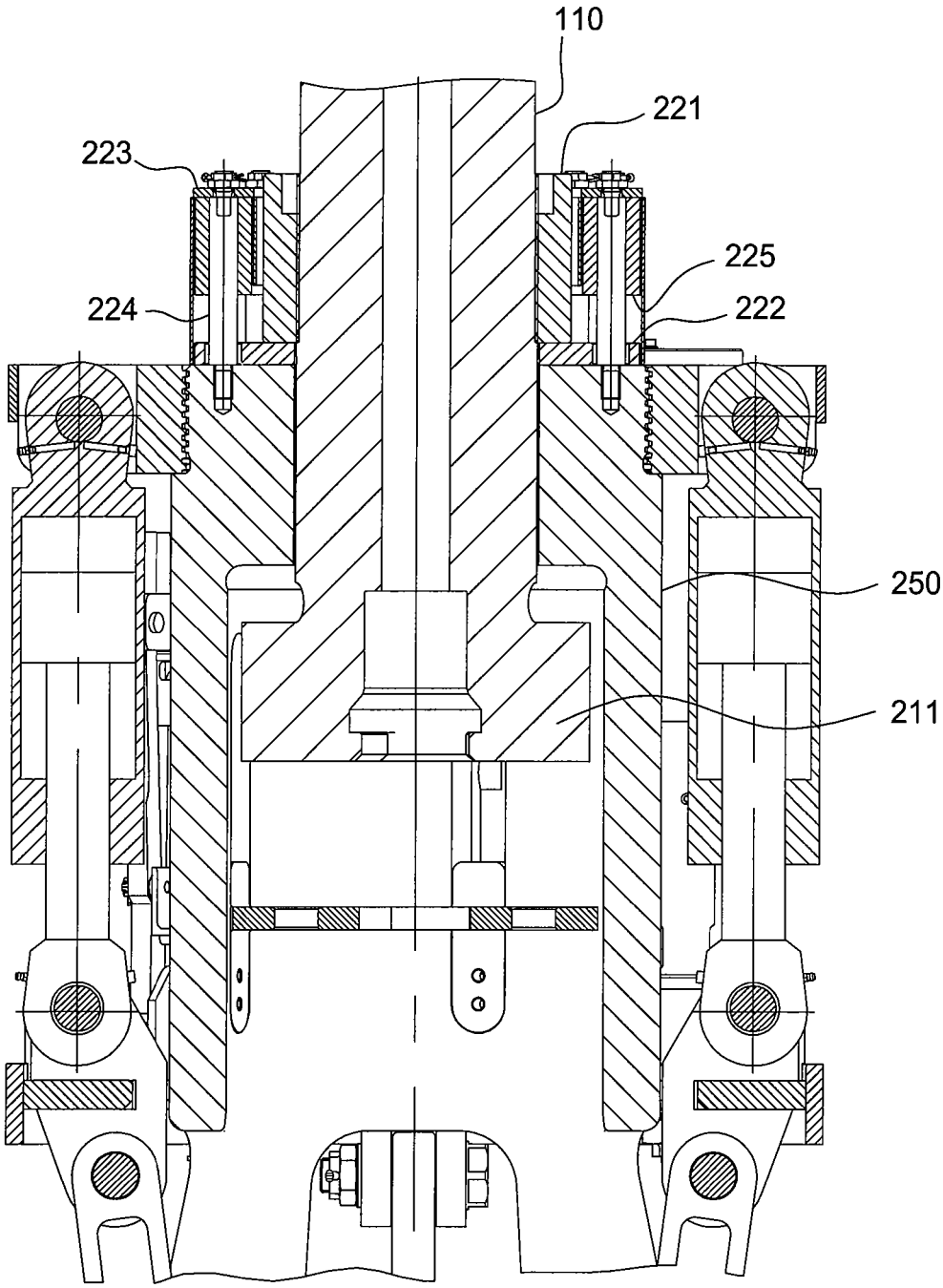

FIGS. 23-25 show the position of the carrier 250 relative to the mandrel 110 at different steps during operation. Under normal operations as shown in FIG. 24, the carrier 250 is not supported by the load collar 211 of the mandrel 110. It can be seen in FIG. 24 that a gap exists between the load collar and the carrier 250. Additionally, the weight of the carrier 250 and its attachments is sufficient application a compressive force on the springs 225, as illustrated by the gap between base plate 222 and the top of the carrier 250. FIG. 23 shows the carrier 250 during a pick up operation. During this operation, a lifting force is applied to the mandrel 110 which overcomes the biasing force of the springs 225. This allows the mandrel 110 to move relative to the carrier 250, thereby causing the load collar 211 to engage the shoulders of the carrier 250. It can be seen in FIG. 23 that the gap between the load collar 211 and the carrier 250 has been eliminated. FIG. 25 shows the carrier 250 when the external gripping tool 200 is on the ground. In this position, the springs 225 have biased the cover 223 away from the base plate 222 such that the carrier 250 is contacting the base plate 222. It can be seen in FIG. 25 that the gap between the load collar 211 and the carrier 250 has increased relative to the size of the gap under normal operations of FIG. 24.

Figure 26:
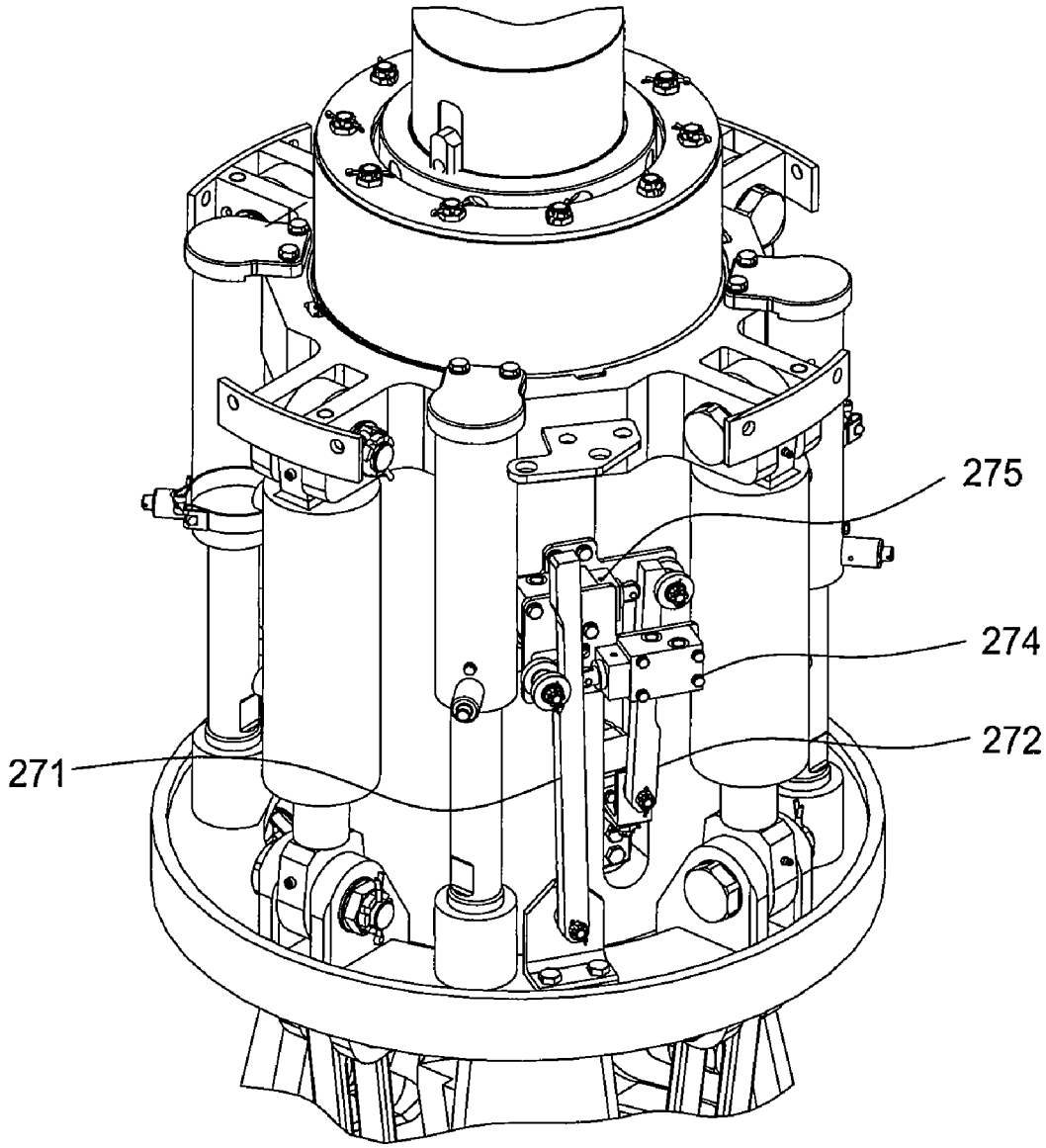
FIG. 26 is a partial perspective view of the hydraulic actuator of the external gripping tool of FIG. 21.
Figure 27:
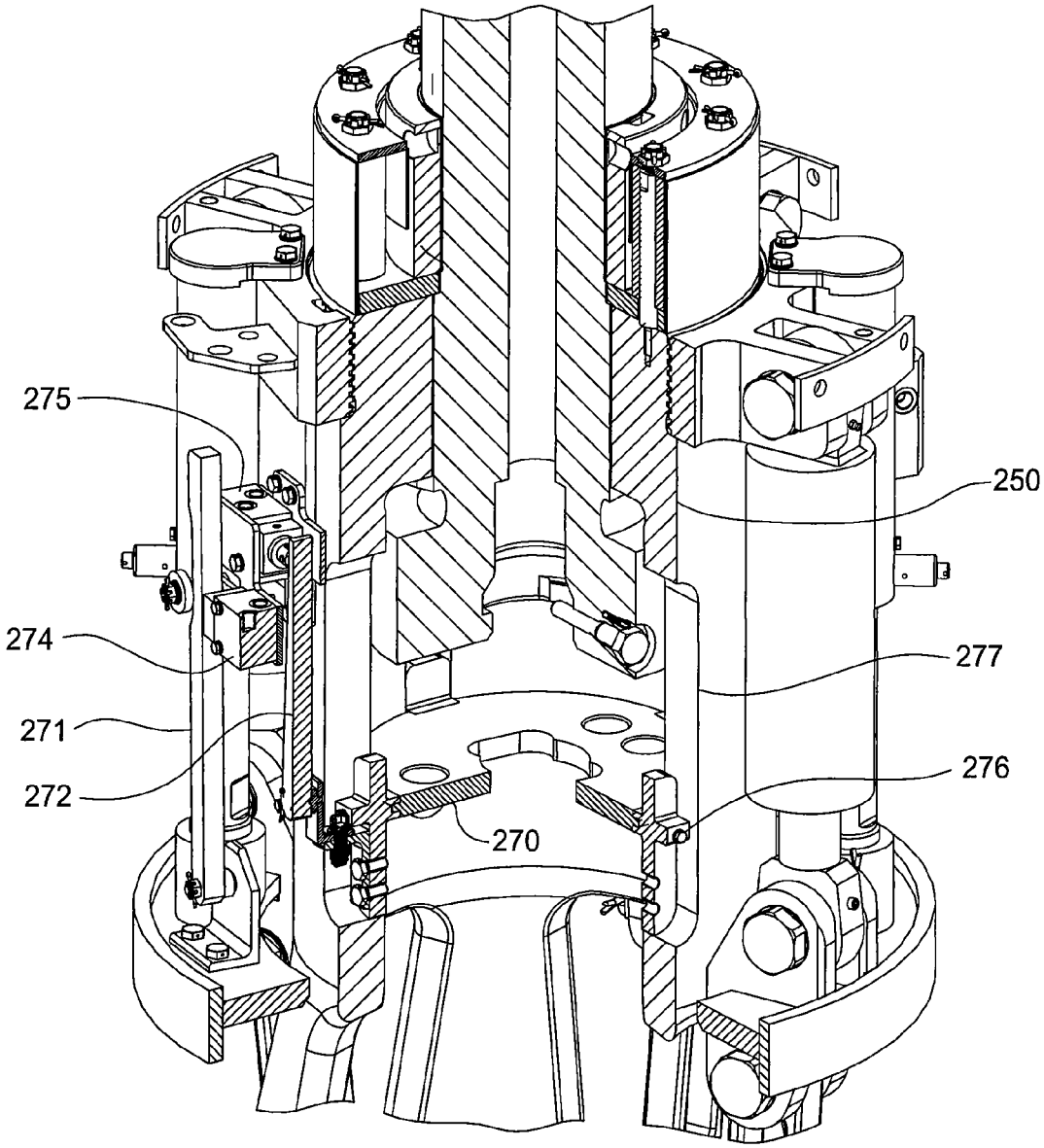
FIG. 27 is a partial cross-sectional view of the hydraulic actuator of the external gripping tool of FIG. 21.
Figure 29A:
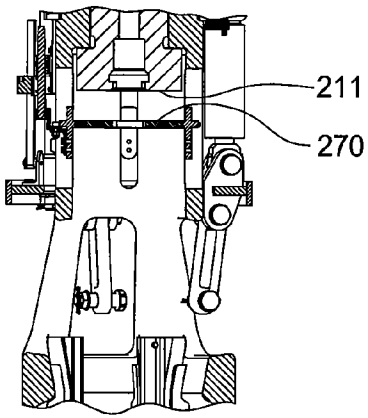
FIGS. 29 and 29A show the coupling indicator in the tubular engaged position.
Figure 29:
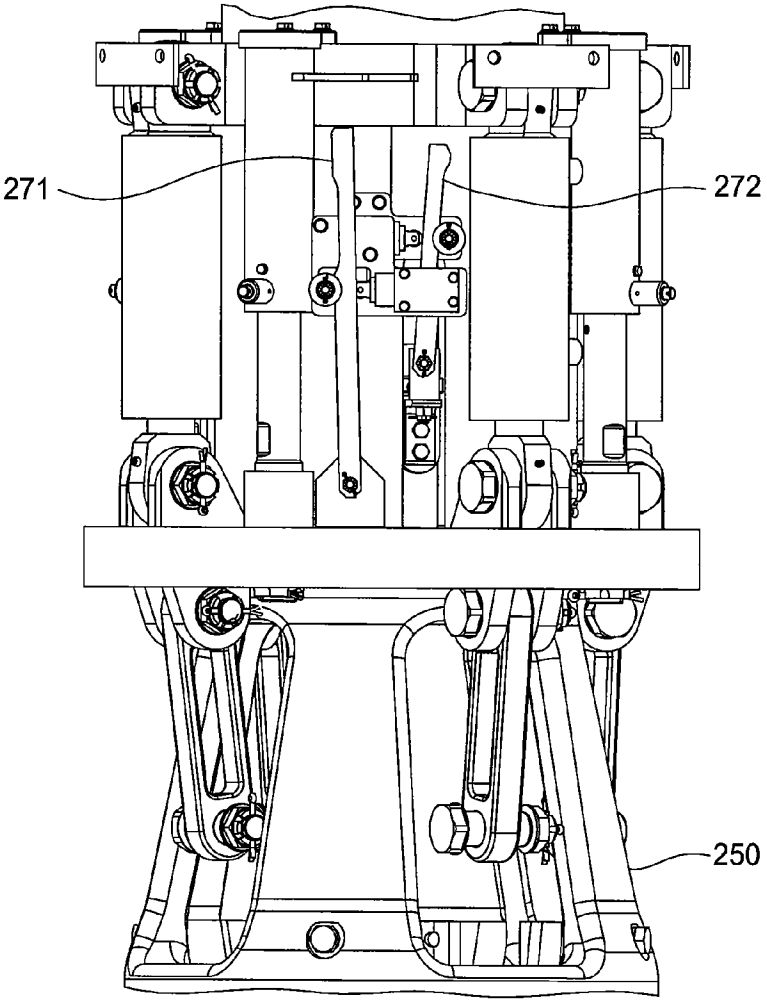

The external gripping tool 200 may also be equipped with a clamping indicator 271 and a coupling indicator 272. FIG. 26 is a perspective view of the indicators 271, 272 and their respective sensors 274, 275 on the external gripping tool 200. FIG. 27 is a cross-sectional view of the external gripping tool 200. The carrier 250 includes a coupling engagement plate 270 for engagement with the coupling of a tubular. The engagement plate 270 includes keys 276 that mate with the slots 277 in the carrier 250. The coupling indicator 272 is coupled to the engagement plate 270 and is movable therewith. The coupling indicator 272 may be an elongated member having tapered portions to indicate the position of the engagement plate 270. In one embodiment, the coupling indicator 272 has an upper narrow portion and lower wide portion to indicate the absence or presence of the coupling. A sensor 275 is provided to detect the position of the coupling indicator 272. When the upper narrow portion is detected, the sensor 275 will signal that the coupling has not been contacted. When the coupling engages the engagement plate 270 and causes the plate 270 to move toward the mandrel 110, the lower wide portion will in turn be moved in position for detection by the sensor 275, which will signal that the coupling has been engaged, as shown in FIG. 29. As seen in FIG. 29A, the bumper plate 270 has moved relative to the load collar 211.

Figure 28A:
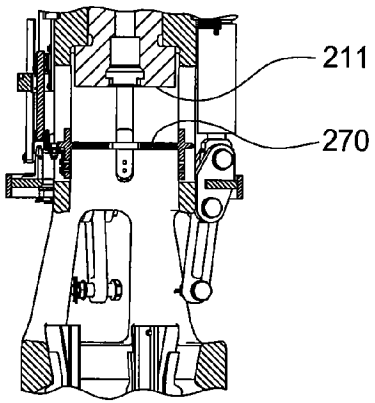
FIGS. 28 and 28A show the coupling indicator and the clamping indicator in the released position.
Figure 28:
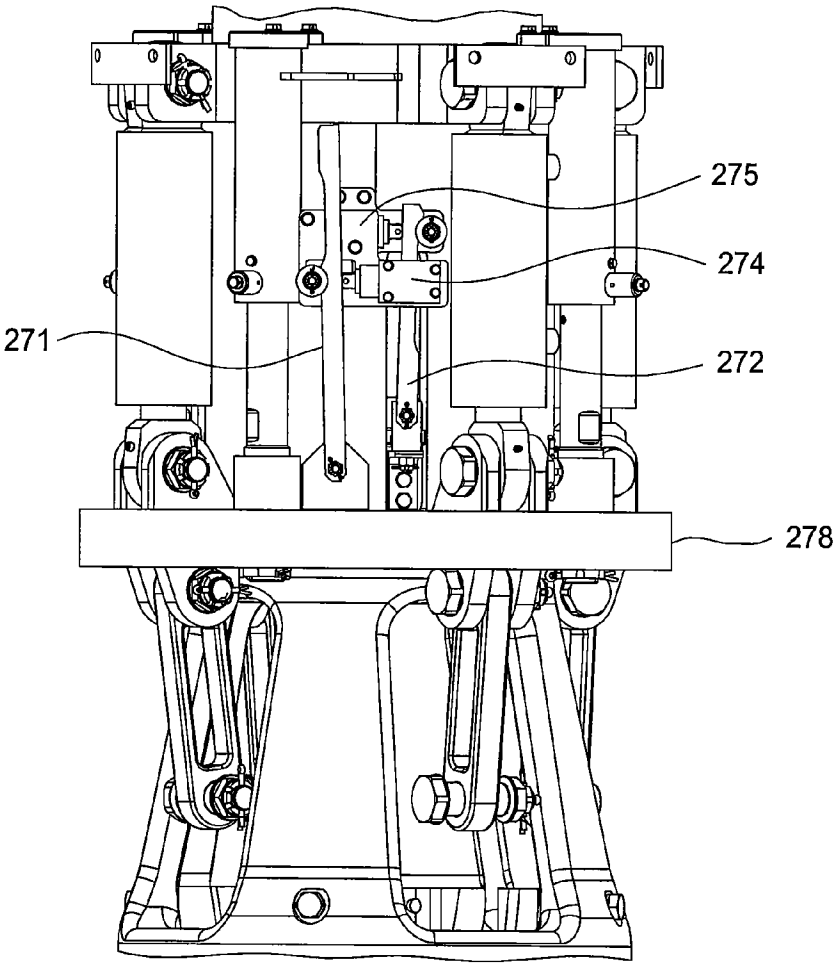
Figure 30:
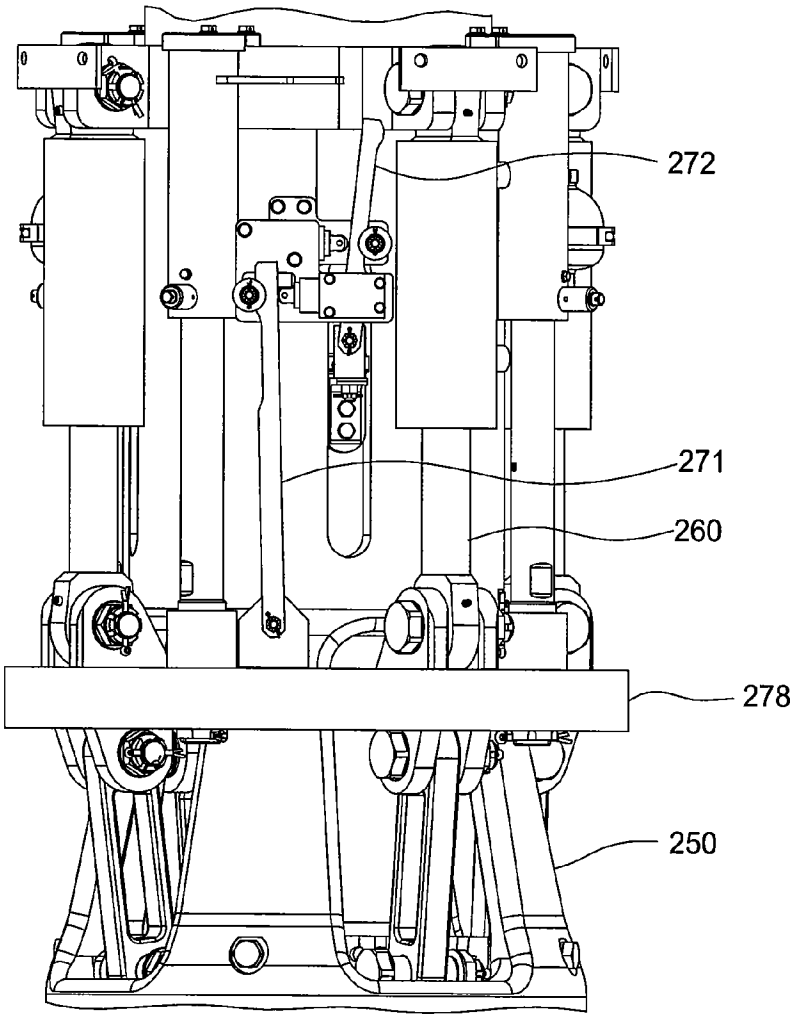
FIG. 30 shows the gripping elements in the clamped position.

FIGS. 28 and 28A show the coupling indicator 272 and the clamping indicator 271 in the released position. With reference to the clamp indicator 271, in one embodiment, the clamp indicator 271 is an elongated member coupled to the leveling ring 278 of the hydraulic actuator 260 and movable therewith. The leveling ring 278 is connected between the clamping cylinders and the gripping elements. The leveling ring 278 may be used to ensure that the gripping elements 255 move in unison. The clamp indicator 271 has tapered portions along its body to indicate the position of the gripping elements 255. As shown, the clamp indicator 271 has an upper wide portion and a lower narrow portion. A second sensor 274 positioned adjacent the clamp indicator 271 is adapted to send a signal indicating the position of the gripping elements 255. For example, from the release position shown in FIGS. 28 and 28A, the hydraulic actuator 260 may be activated to cause the leveling ring 278 and the gripping elements to move down. In turn, the upper wide portion is moved adjacent the sensor 275, which will indicate that the gripping elements 255 are clamped, as shown in FIG. 30.

Figure 31:
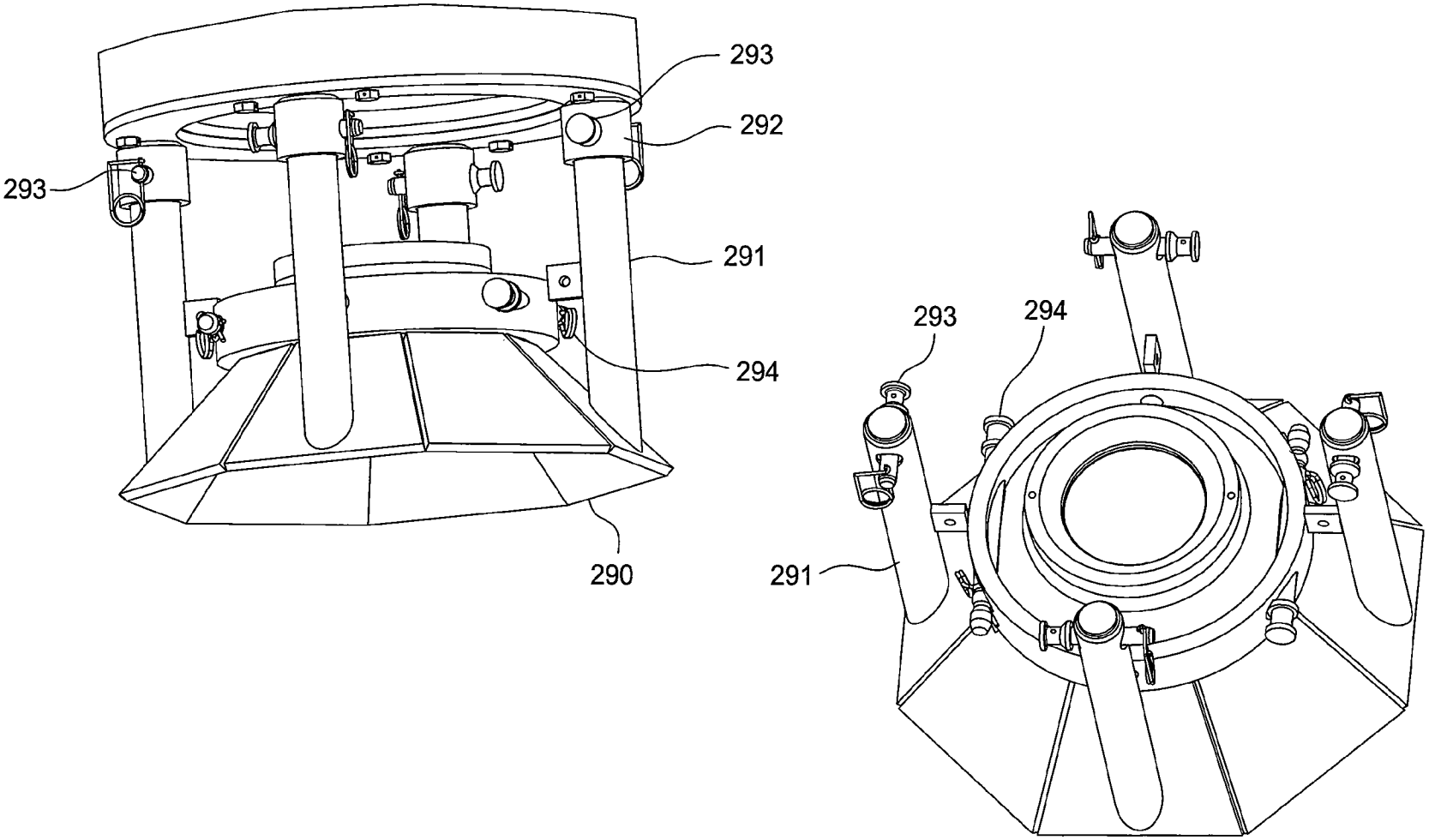
FIG. 31 shows a perspective of a tubular guide member.

FIG. 31 shows a perspective of a tubular guide member 290 attached to a lower portion of the external gripping tool 200. The tubular guide member 290 may be used to facilitate insertion of the tubular into the carrier 250. In one embodiment, the tubular guide member 290 is a cone shape guide member having one or more connection posts 291. The posts 291 are adapted to engage with an anchor 292 on the carrier 250. In one embodiment, pins 293 may be used to quickly attach or release the posts 291 from the anchors 292. The tubular guide member 290 may optionally a set of pins 294 for attachment of a smaller sized guide member 290 to accommodate smaller tubular sizes.

Figure 32A:
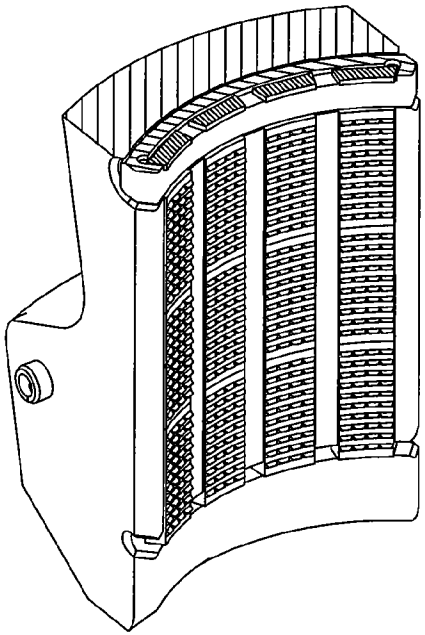
FIG. 32 illustrates an exemplary gripping element suitable for use with the external gripping tool.
Figure 32:
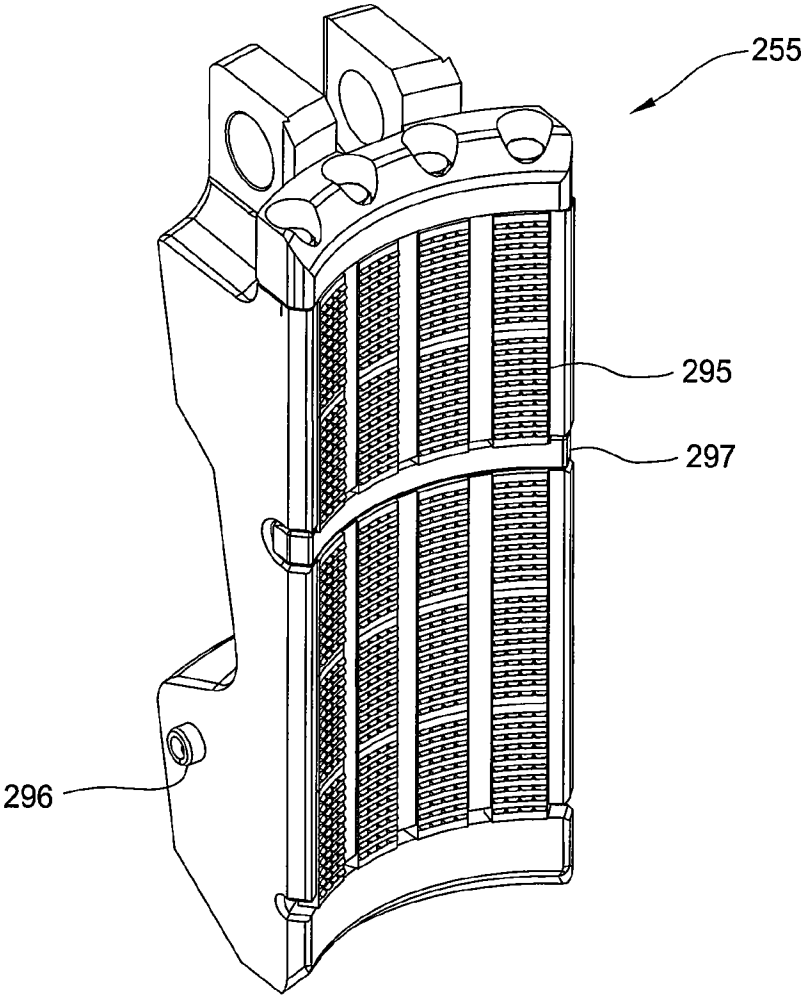

FIG. 32 illustrates an exemplary gripping element 255 suitable for use with the external gripping tool 200. The upper portion of the griping element 255 may have attachment members such as hooks or rings for coupling with the hydraulic actuator 260. The back surface of the gripping element may be wedge shaped for interacting with the wedge surface of the carrier 250. The engagement surface of the gripping element 255 may be provided with a plurality of dies 295. In one embodiment, a die spacer 297 may be provided to separate the upper die from the lower die. The die spacer 297 may have an "L" shape and has a thickness that is greater than the upper die. The upper die rests on the horizontal portion to hold the die spacer in position. The back portion of the die spacer 297 rests on the housing of the gripping element 255. In this respect, the die spacers 297 may transfer load from the upper die to the housing.

Figure 33:
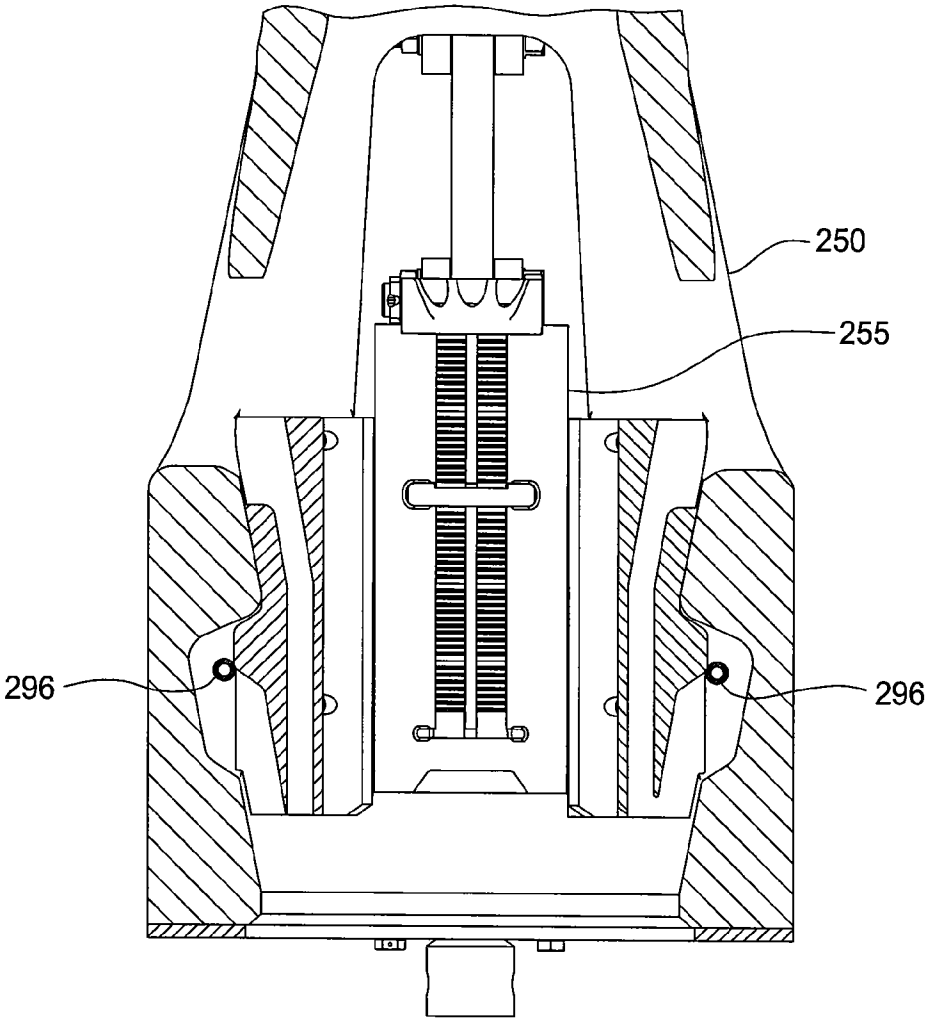
FIG. 33 shows the guide pins of the gripping element of FIG. 32 positioned in the carrier 250.
Figure 34B:
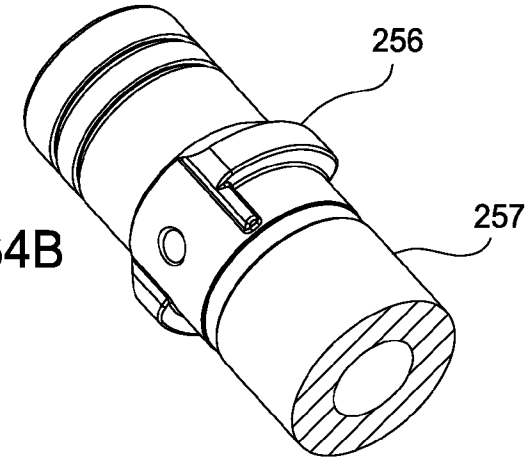
FIGS. 34A-34E illustrate an exemplary fill-up tool connection for connecting the fill-up tool to an external clamping tool.
Figure 34E:
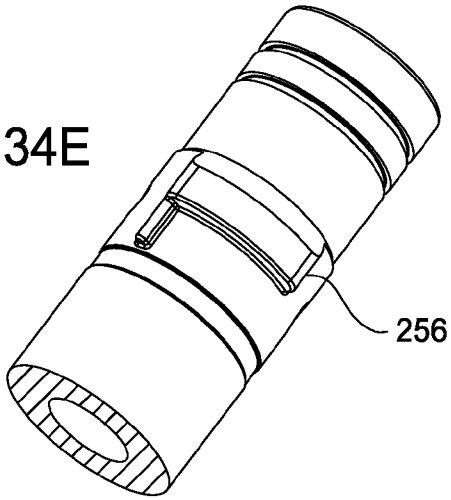
Figure 34A:
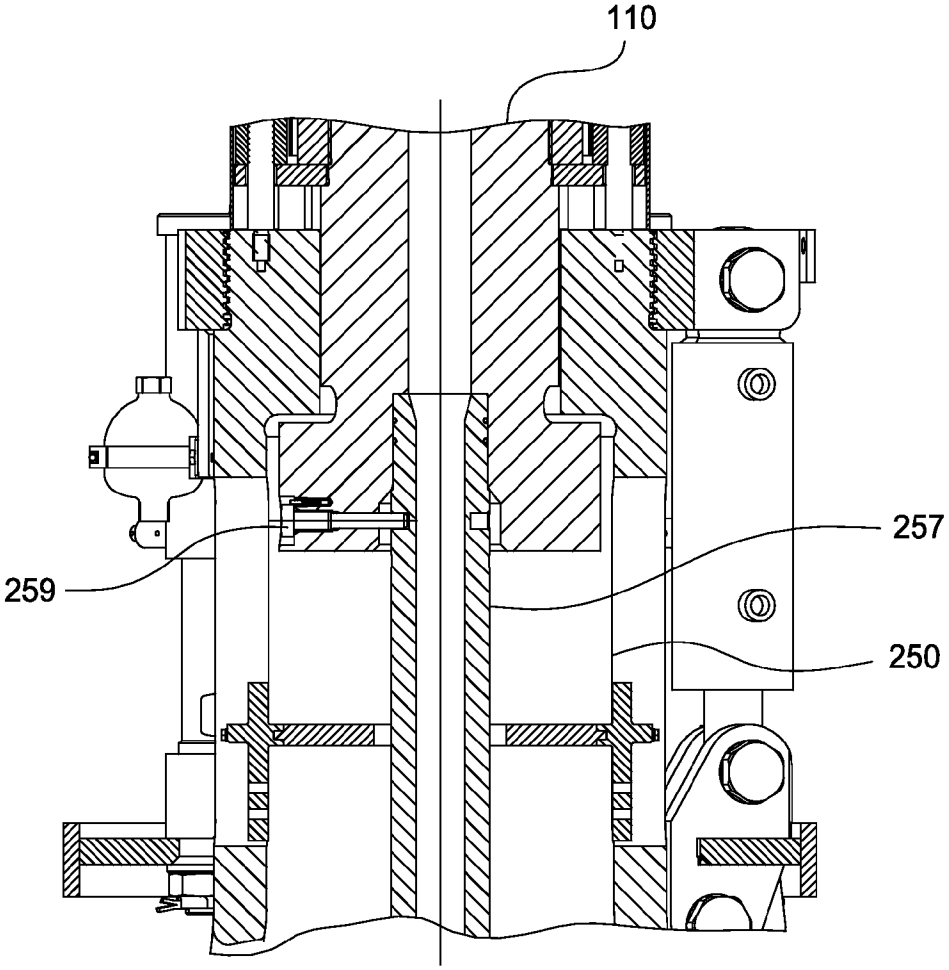
Figure 34D:
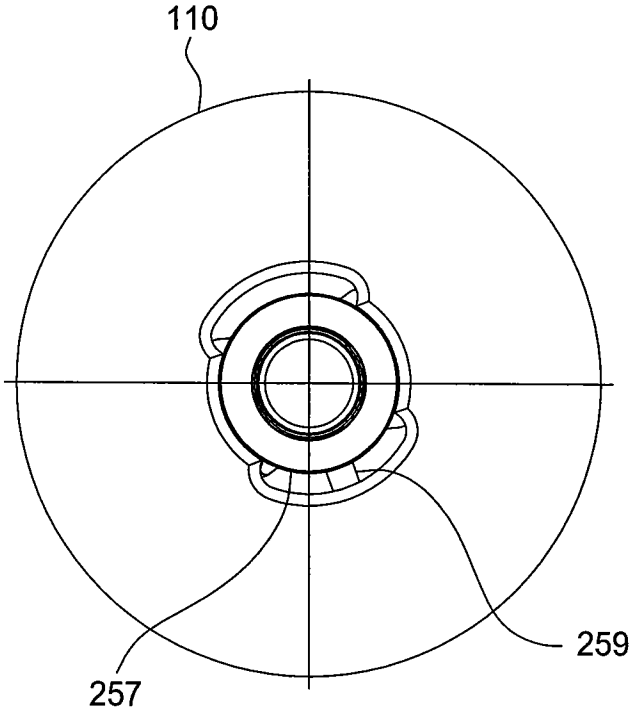
Figure 34C:
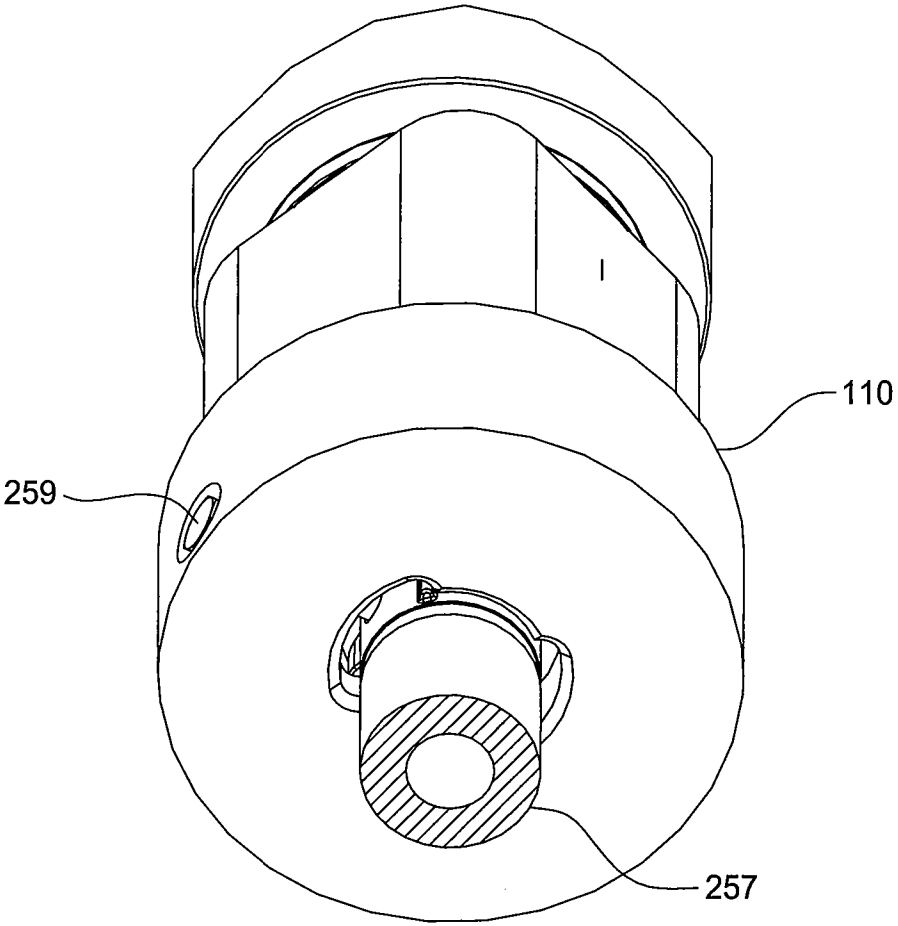

A guide pin 296 may be provided on the side wall of the housing to control the position of the gripping element 255 in the carrier 250. Referring to FIG. 33, the guide pins 296 may be disposed in grooves formed in the torque bars of the carrier 250. The torque bars are positioned between adjacent gripping elements 255. The guide pins 296 prevent the gripping elements 255 from pivoting inward, thereby maximizing the opening in the carrier 250 for receiving the tubular.

FIGS. 34A-34E illustrate an exemplary fill-up tool connection for connecting the fill-up tool to the mandrel 110 of the external clamping tool 200. The fill-up tool mandrel 257 may have keys 256 that provide a positive lock with a bore in the gripping tool mandrel 110. Additionally, a retention bolt 259 may be inserted radially through the gripping tool mandrel 110 and the fill-up tool mandrel 257.

Swivel

Figure 35B:
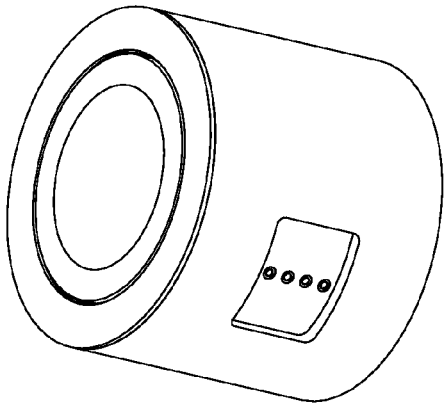
FIGS. 35 and 36 show an exemplary embodiment of a swivel.
Figure 35A:
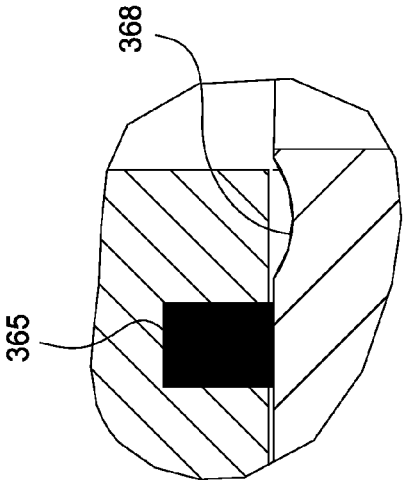
Figure 35:
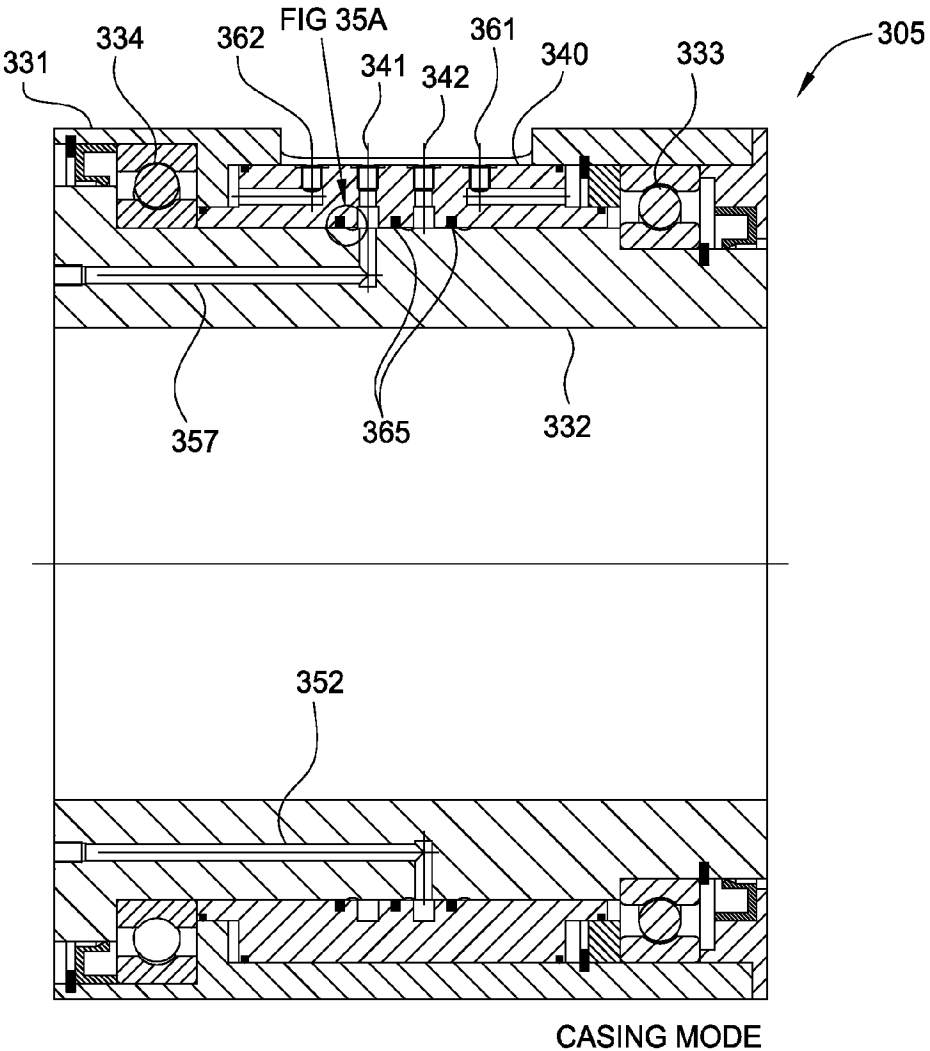
Figure 36B:
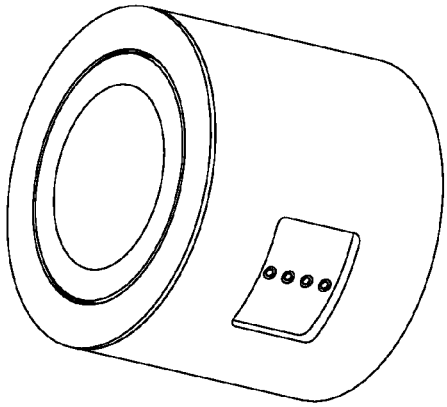
Figure 36A:
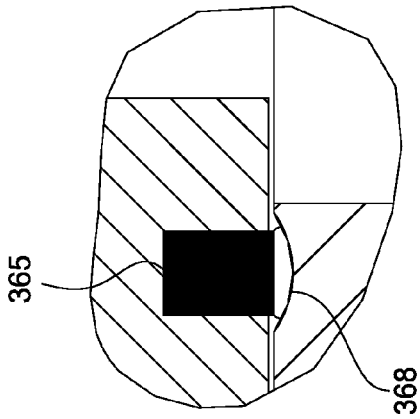
Figure 36:
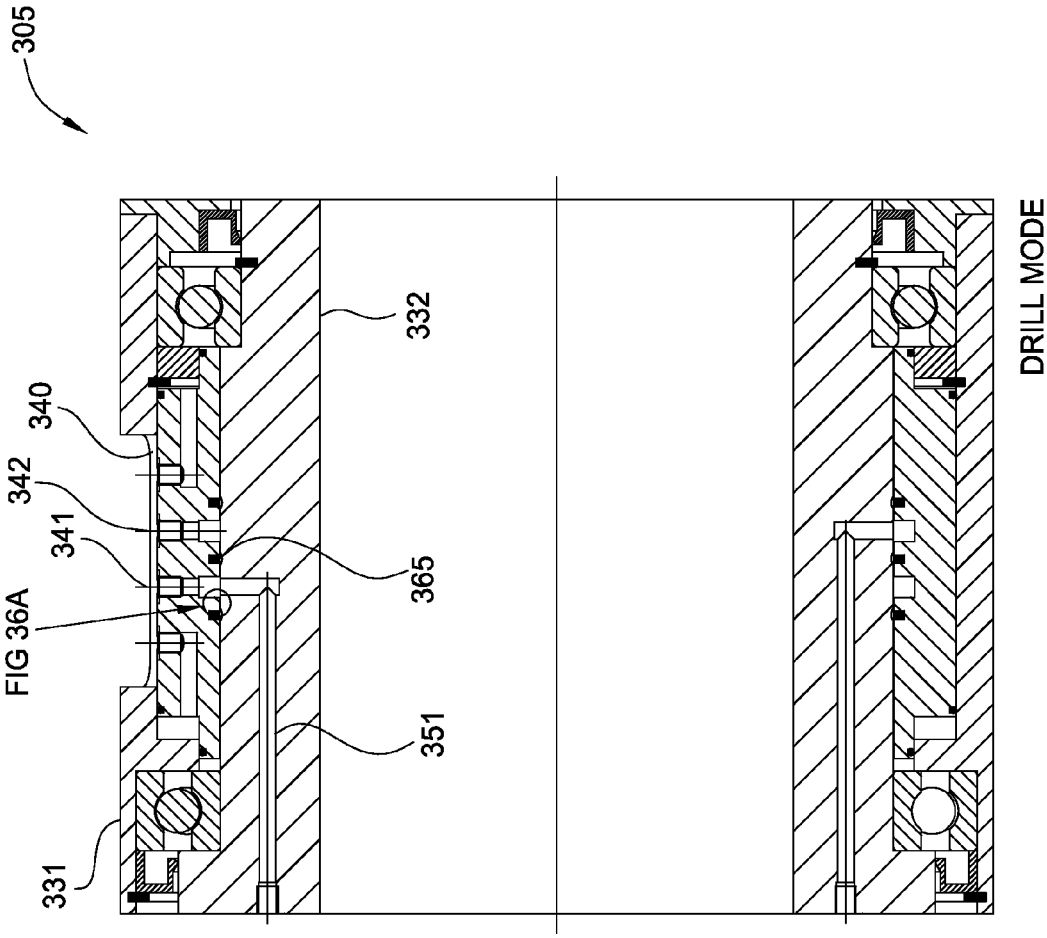

FIGS. 35 and 36 show another embodiment of a swivel 305. The swivel 305 is suitable for use with the tubular handling apparatus described herein and may replace the swivel 105 described with respect to FIGS. 7 and 8. The swivel 305 may be operable between a casing mode and a drilling mode. FIG. 35 shows the swivel 305 in the casing mode, and FIG. 36 shows the swivel 305 in the drilling mode. FIGS. 35B and 36B are perspective views of the swivel in the casing mode and the drilling mode, respectively.

The swivel 305 includes an outer body 331, an inner body 332, and upper and lower bearings 333, 334. The inner body 332 may be connected to the mandrel 110 using a spline connection 135. In this respect, the inner body 332 may rotate with the mandrel 110. Alternatively, the inner body 332 may be connected to the mandrel using a pin connection. The outer body 331 is coupled to the link support housing a connector such as a torque bolt. In this respect, the outer body 331 may remain stationary with the link support housing during rotation of the mandrel 110 and the inner body 332. In one embodiment, the swivel 305 may include one or more sensors for measuring the torque applied to the mandrel during its rotation.

The swivel 305 includes a seal bushing 340 disposed between the outer body 331 and the inner body 332. The seal bushing 340 includes one or more ports 341, 342 in selective fluid communication with one or more channels 351, 352 of the inner body 332. For example, a first port 341 may be in fluid communication with a first channel 351 to supply fluid to a connected tool such as the tubular handling apparatus, and a second port 342 may be in fluid communication with a second channel 352 to expel fluid from the tool.

The seal bushing 340 is axially movable relative to the inner body 332. FIG. 35 shows the seal bushing 340 in the lower position for operation in the casing mode. FIG. 36 shows the seal bushing 340 in the upper position for operation in the drilling mode. In one embodiment, movement of the seal bushing 340 is hydraulically actuated. However, electric, mechanic, or pneumatic actuations of the seal bushing 340 are also contemplated. The seal bushing 340 include a first actuation channel 361 for supplying fluid out of the top of the seal bushing 340 to urge the seal bushing 340 to move downward. The seal bushing 340 also includes a second actuation channel 362 for supplying fluid out of the bottom of the seal bushing 340 to urge the seal bushing 340 to move upward. In another embodiment, the seal bushing 340 may be moved using a manual switch, a piston and cylinder assembly, or any suitable switching mechanism. The seal bushing may also be remotely controlled. In one embodiment, the seal bushing 340 may be locked into position. For example, a ball and détente assembly may be used to maintain the seal bushing 340 in position. An optional indicator may be used to indicate the position of the seal bushing 340. Exemplary indicators include a color marker or a pin. In one embodiment, seals may be positioned between an exterior surface of the seal bushing 340 and the outer body 331.

The seal bushing 340 includes one or more seals 365 disposed on an inside surface. The one or more seals 365 engage or disengage from the inner body 332 depending on the position of the seal bushing 340. In one embodiment, the seal bushing 340 is in the casing (lower) mode when the inner body is at low rotational speeds or is stationary. In the casing mode, the seals 365 are engaged with an outside surface of the inner body 332 to prevent leakage of fluid at the interface between the port 341, 342 and the channel 351, 352, as illustrated in FIG. 35A. In this respect, fluid may be supplied to operate the tubular handling apparatus during casing mode. The seal bushing 340 may be placed in the drilling (upper) mode during higher rotational speeds. In the drilling mode, the seals 365 are positioned adjacent a respective groove on an outer surface of the inner body 332, whereby the seals 365 do not contact the inner body 332, as illustrated in FIG. 36A. In this respect, the seals 365 are disengaged from the inner body 332. When the seals are disengaged, the inner body 332 may rotate relative to the outer body 331 without contacting the seals 365, thereby prolonging the service life of the seals 365. During drilling, the tubular gripping apparatus typically remains in a gripped position such that fluid is not expected to be supplied fluid through the swivel 305 to operate the tubular gripping apparatus. In an alternative embodiment, the seals may be disposed on inner body 332 and the groove formed on the seal bushing 340. In one embodiment, a valve may be provided to ensure the fluid pressure of the tubular gripping apparatus in the gripped position in maintained. It must be noted that the swivel 305 may operate in the casing mode during drilling or higher rotational speed operations, even though the drilling mode is preferred at higher speeds to reduce wear on the seals 365. In one embodiment, the casing mode may be selected for operations at less than 50 rpm, and the drilling mode may be selected for operations at more than 50 rpm. In another embodiment, the mode of the swivel 305 may depend on the pending operation. For example, the swivel 305 may be in the casing mode during casing running operations and may switch to the drilling mode for drilling operations.

In another embodiment, movement of the seal bushing 340 may be linked to a controller. The controller may allow or prevent movement of the seal bushing 340 in response to certain conditions. In one embodiment, the controller may allow or prevent movement of the seal bushing 340 in response to the rotational speed of the inner body 332. For example, the controller may prevent the seal bushing 340 to move to the casing mode when the rotational speed is relatively high. In another example, the controller may allow the seal bushing 340 to move to the drilling mode when the rotational speed reaches a certain threshold level. In yet another example, the controller may prevent the seal bushing 340 from switching modes when there is pressure in the channels.

In operation, the swivel 305 may be used with tubular gripping apparatus for casing running and/or drilling operations. During casing running, the swivel 305 is operated in the casing mode such that fluid may be supplied through the ports 341, 342 of the seal bushing 340 to operate the tubular gripping apparatus. The tubular gripping apparatus may be operated between an open or closed position to grip or release a tubular such as casing. Initially, the tubular gripping apparatus may grip a casing and place in alignment with a casing string in the spider. The casing is rotated into threaded connection with the casing string. The casing is rotated by transferring rotation from the top drive through the inner body 332 to the tubular gripping apparatus. The swivel 305 may remain in the casing mode during rotation of the tubular gripping apparatus to connect the casing to the casing string. After connection, the swivel 305 may switch to the drilling mode in anticipation of the higher rotational speed. The seal bushing 340 is moved relative to the inner body 332 to place the seals 365 adjacent the grooves 368 of the inner body 332, whereby the seals 365 are disengaged. Thereafter, the tubular gripping apparatus may be rotated to urge the casing string into the formation. The seal bushing 340 may switch back to the drilling mode when rotation is completed. In another embodiment, the seal bushing 340 may operated in the casing mode through the casing running and drilling process.

Thread Compensation

Figure 37:
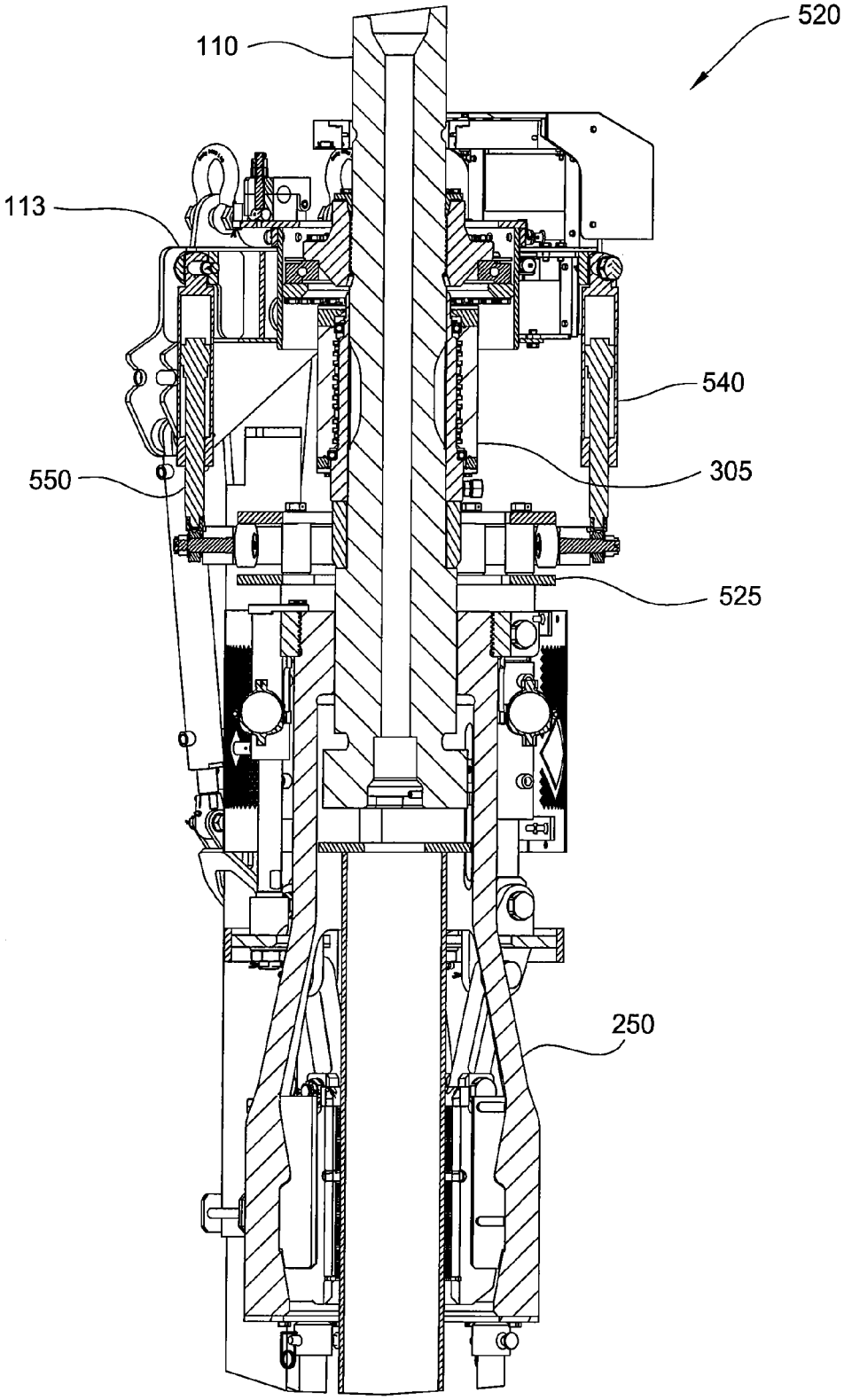
FIG. 37 show an embodiment of a thread compensator in the partially retracted position.

FIGS. 37-40 show another embodiment of a thread compensator 520. The thread compensator 520 is suitable for use with the tubular handling apparatus described herein and may replace the thread compensator 220 described with respect to FIG. 22. The tubular handling apparatus includes a mandrel 110 coupled to a carrier 250. A swivel 305 such as the swivel shown in FIGS. 35 and 36 disposed above the mandrel. A link support housing 113 of a link assembly 108 such as the link assembly shown in FIG. 3 is attached to the mandrel 110 above the swivel 305. In another embodiment, the tubular handling apparatus may be provided with a torque measuring device. An exemplary torque sub is disclosed in U.S. patent application Ser. No. 11/741,330, filed on Apr. 27, 2007 by M. Jahn et al., which application is incorporated herein by reference in its entirety, including FIGS. 6-6I and their respective description. In one embodiment, the torque measuring device includes a torque shaft rotationally coupled to the top drive, a strain gage disposed on the torque shaft for measuring a torque exerted on the torque shaft by the top drive, and an antenna in communication with the strain gage. As shown in FIG. 37, the mandrel 110 may serve as the torque shaft for the torque measuring device. The strain gage may be at least partially disposed in the recessed diameter portion of the mandrel 110. The torque measuring device may also include a turns counter for measuring rotation of the tubular and a stationary antenna in electromagnetic communication with the torque sub antenna. The turns counter and the stationary antenna may be located at a stationary position relative to the top drive. The torque measuring device may also include a computer is located at a stationary position relative to the top drive. The computer is in communication with the stationary antenna and the turns counter. The computer may be configured to monitor the torque and rotation measurements during rotation of the tubular; to determine acceptability of the threaded connection; and to stop rotation of the tubular when the threaded connection is complete or if the computer determines that the threaded connection is unacceptable.

Figure 38:
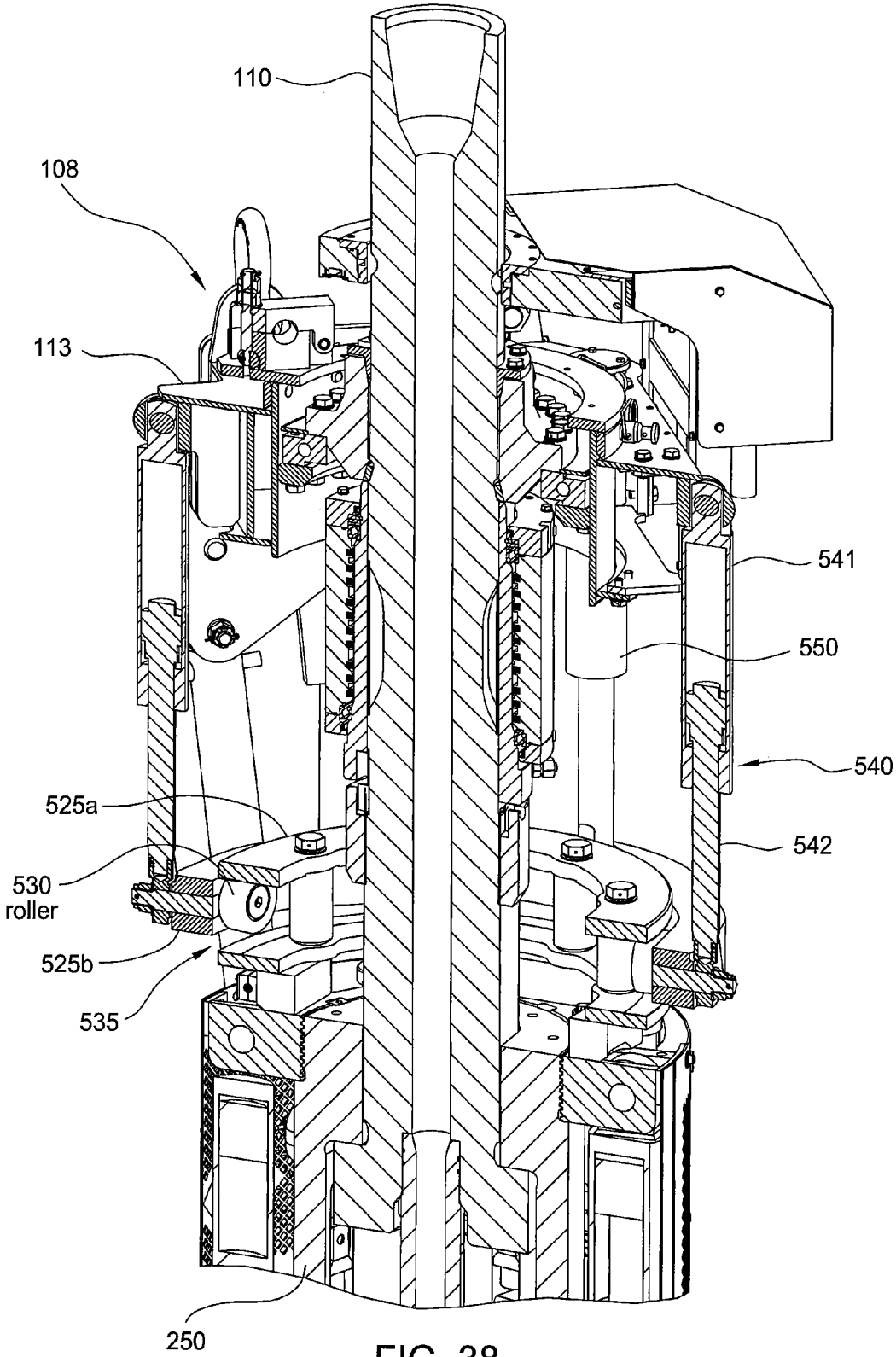
FIG. 38 shows the thread compensator of FIG. 37 in the extended position.
Figure 39:
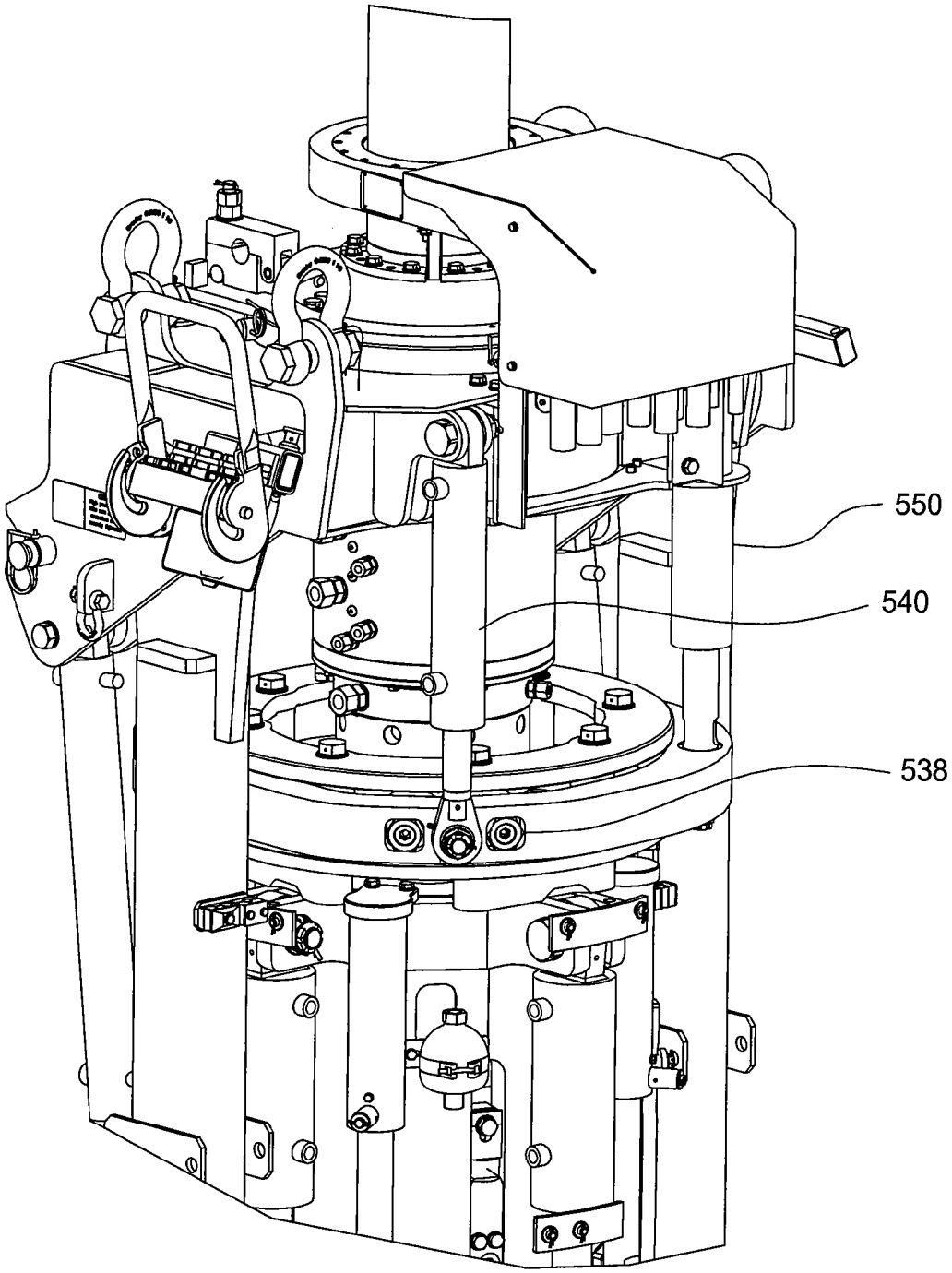
FIG. 39 shows a perspective view of the thread compensator of FIG. 37.

FIG. 37 show the thread compensator 520 in the partially retracted position, and FIG. 38 shows the thread compensator 520 in the extended (or drilling) position. The thread compensator 520 may be used to couple the carrier 250 to the mandrel 110. In one embodiment, the thread compensator 520 includes a lift ring 525 connected to an upper portion of the carrier 250. The lift ring 525 may include an inner lift ring 525*a* coupled to an outer lift ring 525*b*. The inner lift ring 525*a* includes a track 535 defined by an upper ring plate and a lower ring plate. The outer lift ring 525*b* includes one or more rollers 530 disposed inside the lift ring 525 and movable in the track 535. A rotational axis of the rollers 530 is directed along a radius of the inner lift ring 525*a*. The rollers 530 and the track 535 allow the inner lift ring 525*a* to rotate relative to the outer lift ring 525*b*. In one embodiment, the axle 535 of the roller 530 may include a port for injecting lubricant to the rollers 530, as illustrated in FIG. 39.

Referring to FIG. 38, the outer lift ring 525*b* is coupled to the link support housing 113 of the link assembly 108 using one or more compensation cylinders 540. In this respect, the compensation cylinders 540 do not rotate with the carrier 250. In one embodiment, each compensation cylinder 540 includes a cylinder housing 541 coupled to a cylinder piston 542. The cylinder housing 541 is connected to the link support housing 113 and the cylinder piston 542 is connected to the outer lift ring 525*b*. In one embodiment, the cylinder housing 541 and cylinder piston 542 connections may be pivotal or fixed. The cylinder 540 may be retracted to lift the lift ring 525 and the carrier 250 and extended to lower the lift ring 525 and the carrier 250. The pivotal connections allow the cylinder 540 to move in two dimensions relative to the link support housing 113 to help reduce the bending stress on the cylinder 540 during operation, such as when the lift ring tilts. The thread compensator 520 may include three, four, or any suitable number of cylinders 540 to facilitate the movement of the carrier 250. The thread compensator 520 may be equipped with any suitable number of rollers 530, such as six or eight rollers 530.

In one embodiment, the thread compensator 520 may optionally include one or more torque bars 550 disposed between the link support housing 113 and the outer lift ring 525*b*. The torque bars 550 may be adapted to retract or extend with the compensation cylinders 540. The torque bars 550 may be disposed circumferentially on the outer lift ring 525*b* and between two compensation cylinders 540. The torque bars 550 preferably do not use pivotal connections. In this respect, the torque bars 550 may limit the tilt the lift ring 525 may experience during movement. Also, the torque bars 550 may absorb reaction torque experienced by the outer lift ring 525*b* as a result of the rotation of the inner lift ring 525*a*. In another embodiment, the thread compensator 520 may optionally include compression springs to assist with maintaining the lift ring leveled.

Figure 40:
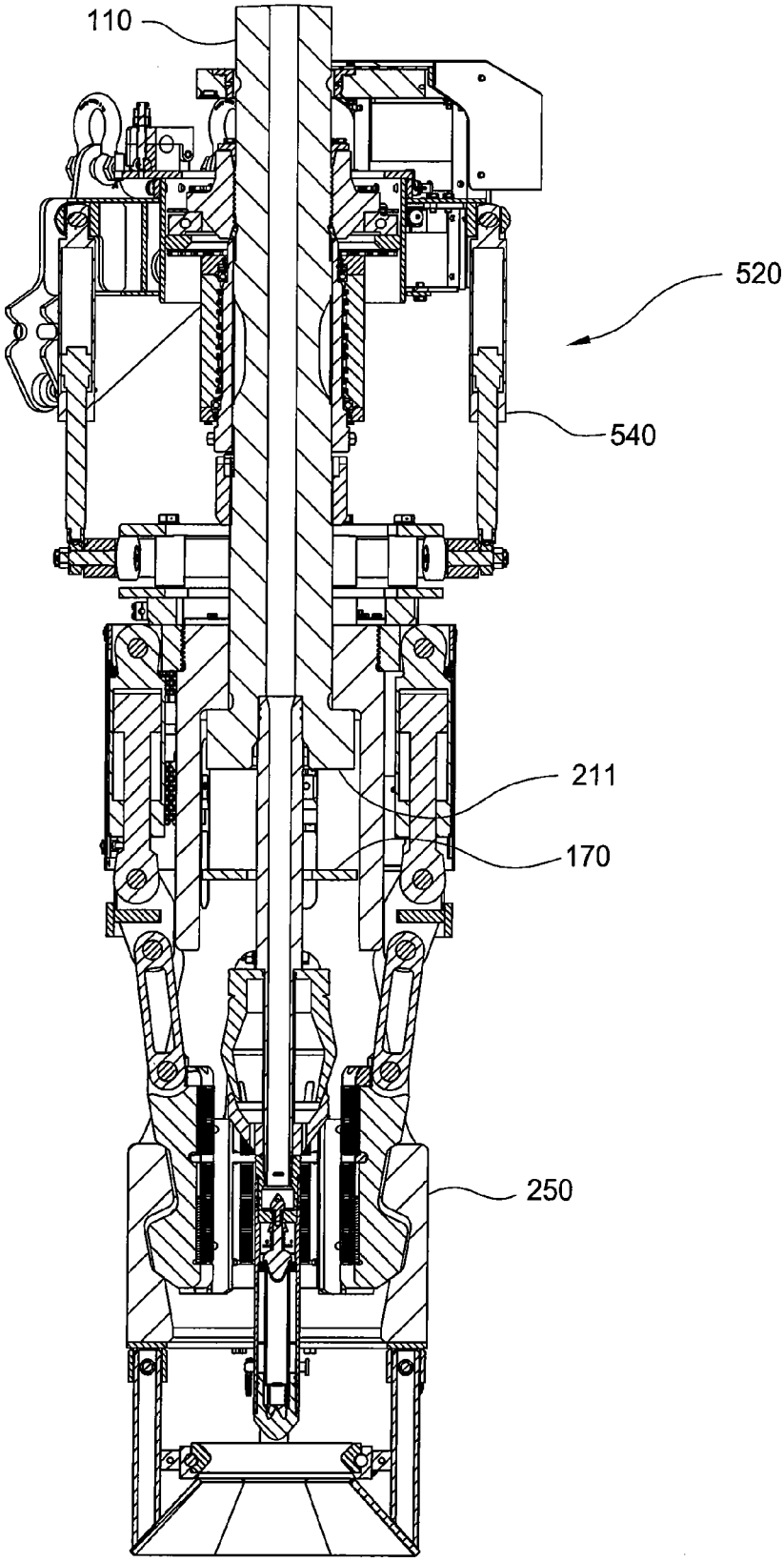
FIG. 40 shows the thread compensator in the extended position.
Figure 41:
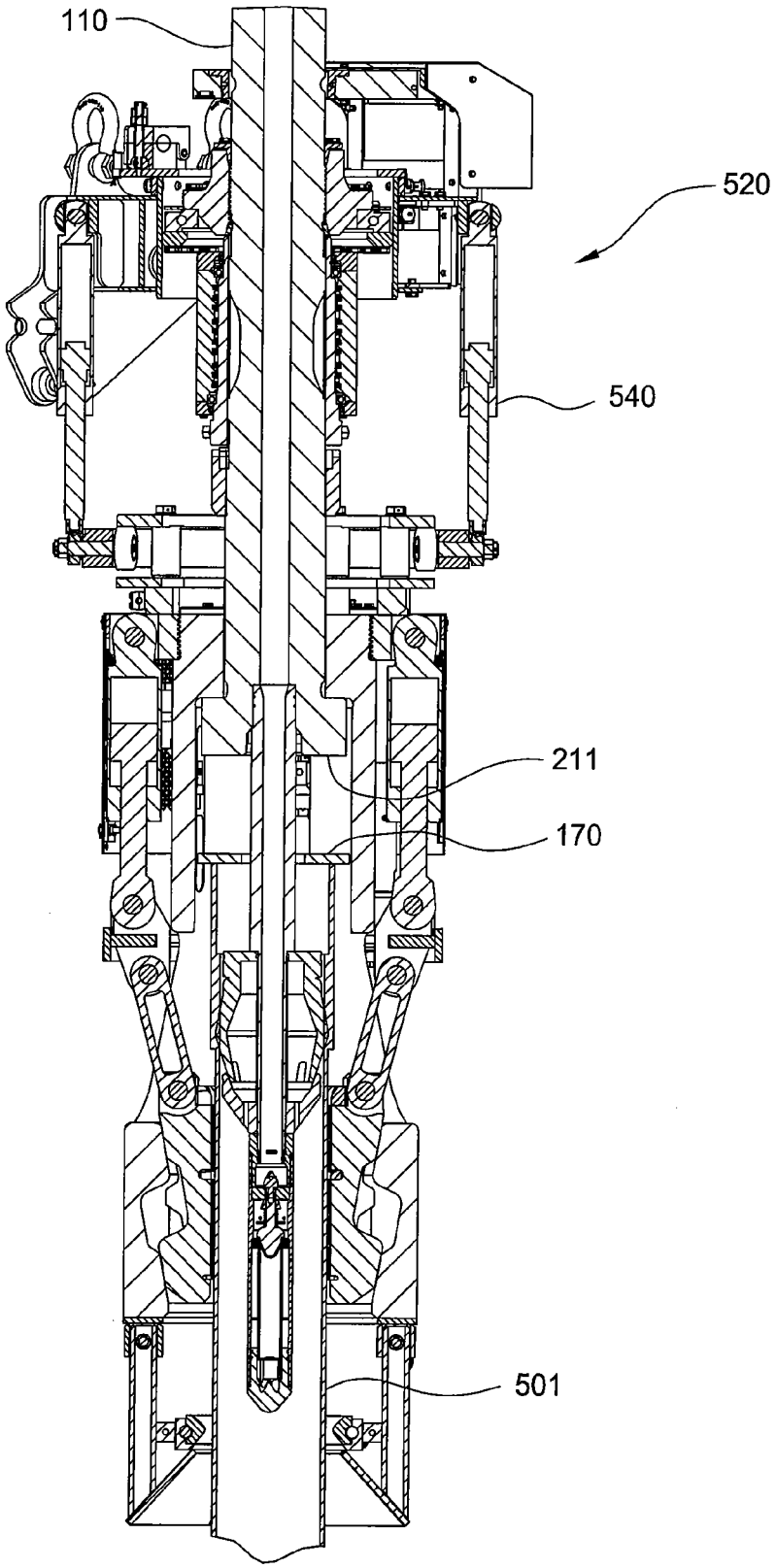
FIG. 41 shows the tubular positioned in the tubular gripping apparatus and gripped by the slips.

FIGS. 40-43 shows the thread compensator 520 in various stages of thread compensation. FIG. 40 shows the thread compensator 520 in the extended position and prior to receiving a tubular. In this position, carrier 250 is supported by the load collar 211 of the mandrel 110. The load collar 211 is at maximum separation distance from the bumper plate 170. The separation distance also represents the maximum stroke distance available for thread compensation. FIG. 41 shows the tubular 501 positioned in the tubular gripping apparatus and gripped by the slips. The tubular is in contact with the bumper plate 170 of the carrier 250. In this position, the compensator 520 is ready to retract the carrier 250 and the tubular in preparation for thread compensation.

Figure 42:
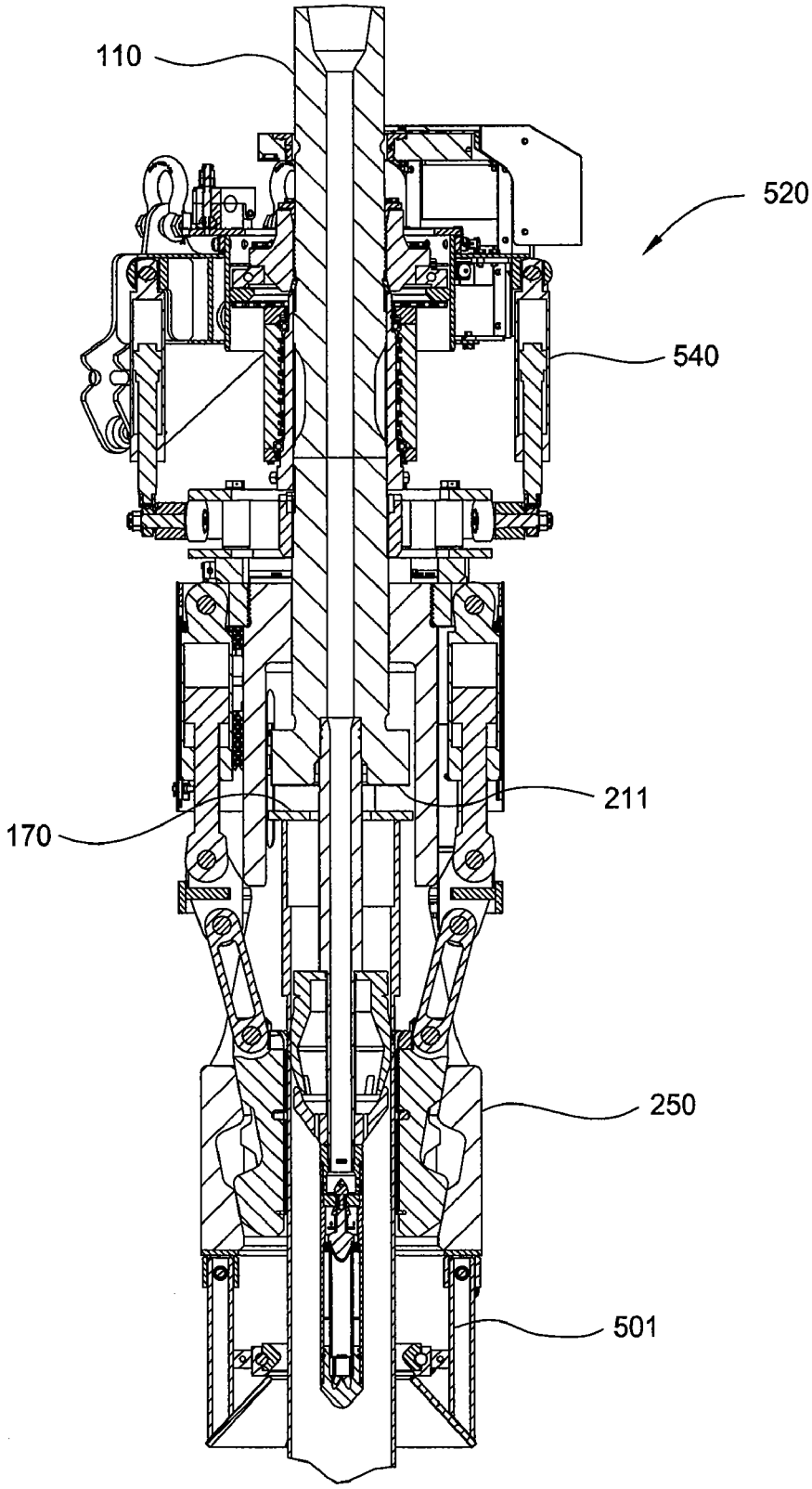
FIG. 42 shows the carrier in a retracted position relative to the mandrel.
Figure 42A:
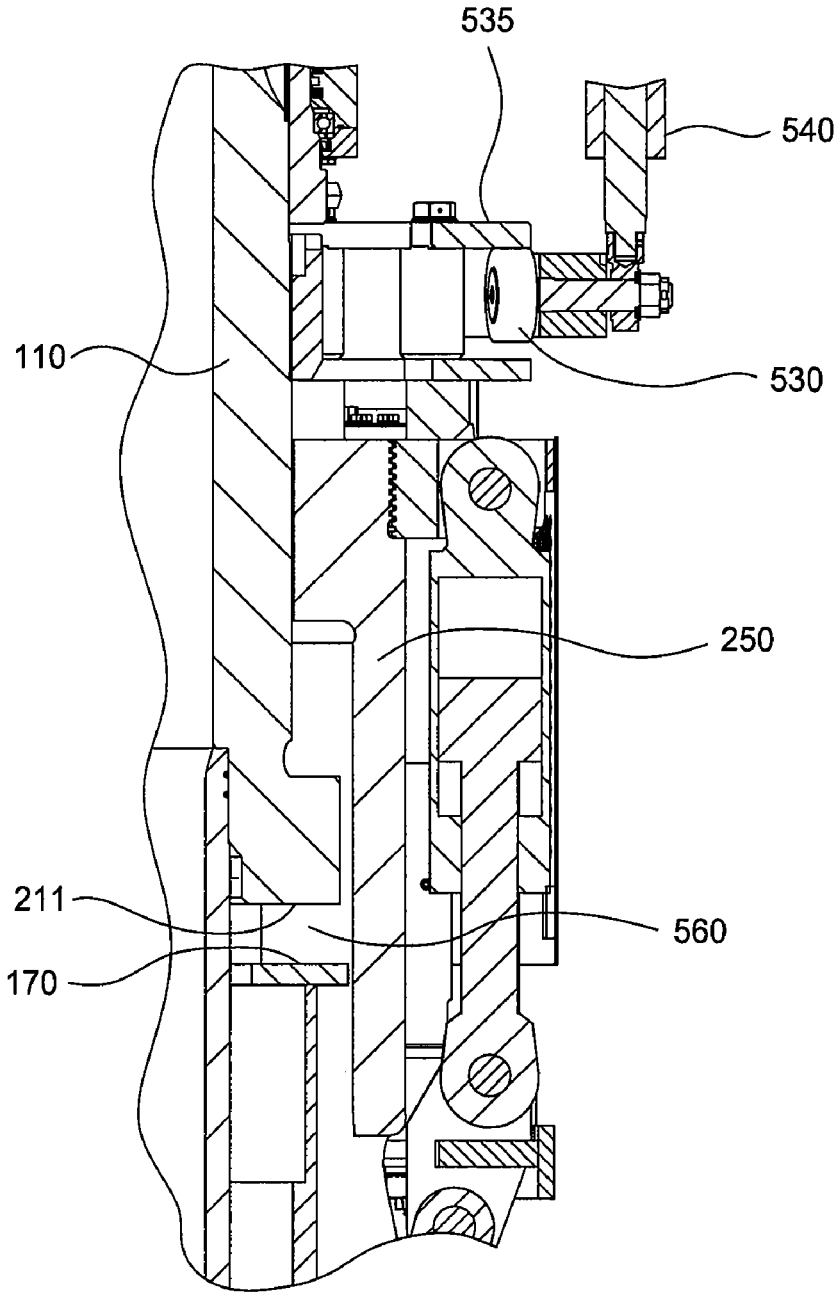
FIG. 42A is an enlarged view of the thread compensator in a partially retracted position.
Figure 42B:
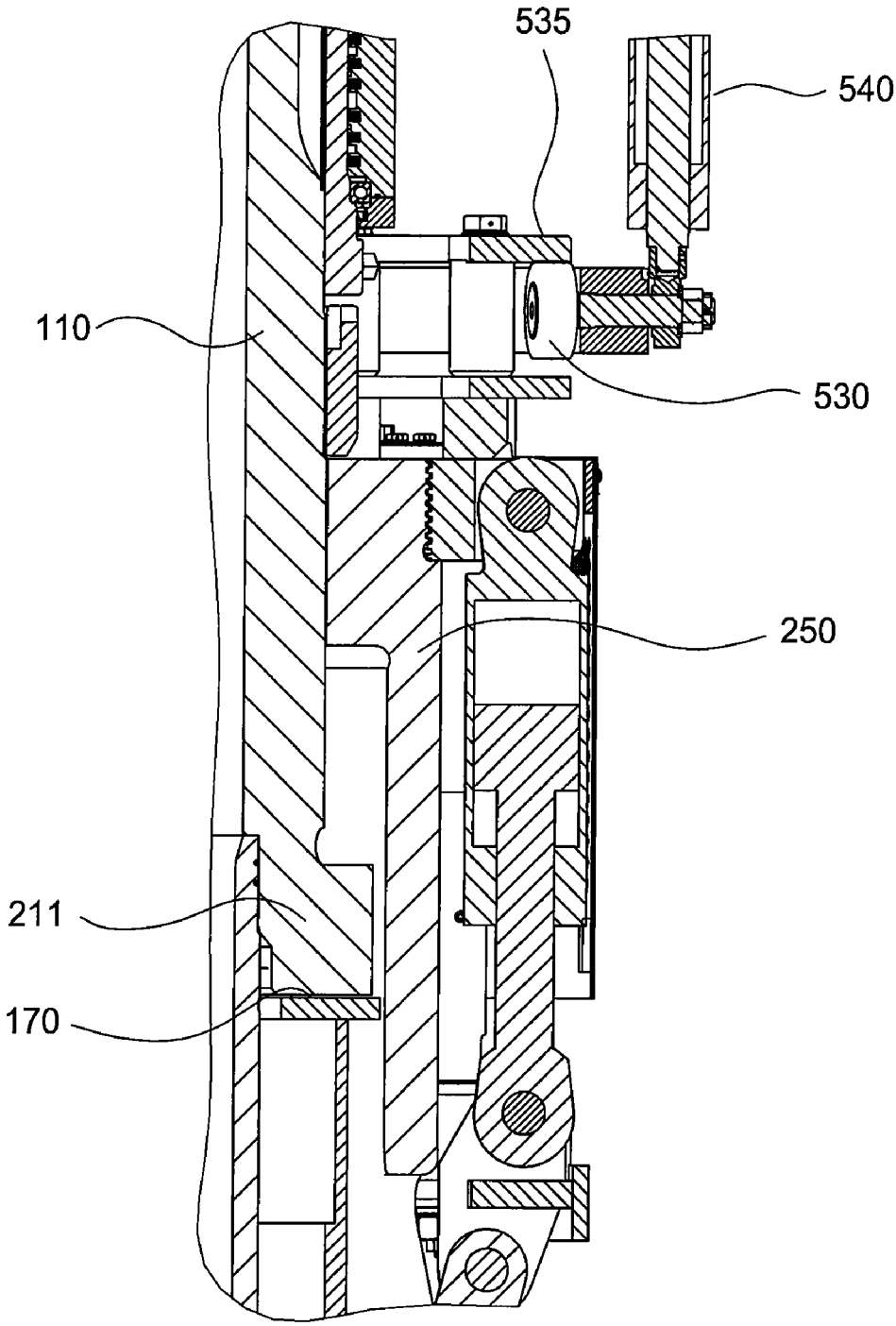
FIG. 42B is an enlarged view of the thread compensator in a fully retracted position.

FIG. 42 shows the carrier 250 in a retracted position relative to the mandrel 110. The carrier 250 is retracted by retracting the compensation cylinders 540 when the top drive is lowered toward the tubular 501. In this position, the load collar 211 is no longer supporting the carrier 250. Instead, the compensation cylinder 540 is now supporting the carrier 250 and the gripped tubular. The carrier 250 may be retracted a distance that is sufficient to allow the threaded connection to be completed. For example, the carrier 250 may be retracted for a distance that is at least equal to the length of the threaded connection. In one embodiment, the carrier 250 is partially retracted such that a gap still exists between the load collar 211 and the bumper plate 170. The gap allows the carrier 250 to move axially relative to the mandrel 110 to release tubular, if necessary, thereby avoiding a wedge lock condition. FIG. 42A is an exploded view of the thread compensator in a partially retracted position. It can be seen that the roller 530 is in contact with the upper portion of the track 535 such that the compensation cylinder 540 may exert a lifting force on the carrier 250 during tubular make-up. In one example, the compensation cylinder 540 may retract the carrier 250 a distance of about 50% to 95% of the stroke distance; preferably, about 65% to 85%. For example, if the stroke distance for retraction is 8 inches, then the compensation cylinder 540 may retract the carrier 250 a distance of 6 inches in preparation for the thread compensation. A gap 560 of about 2 inches remains between the collar 211 and the bumper plate 170. The retraction distance may be at least the length of the threads. If a torque bar 550 is used, the torque bar 550 will retract with the compensation cylinders 540. FIG. 42B is an exploded view of the thread compensator 520 in a fully retracted position. As shown, the load collar 211 of the mandrel 110 is in contact or close to contacting the bumper plate 170 in the carrier 250.

Figure 43:
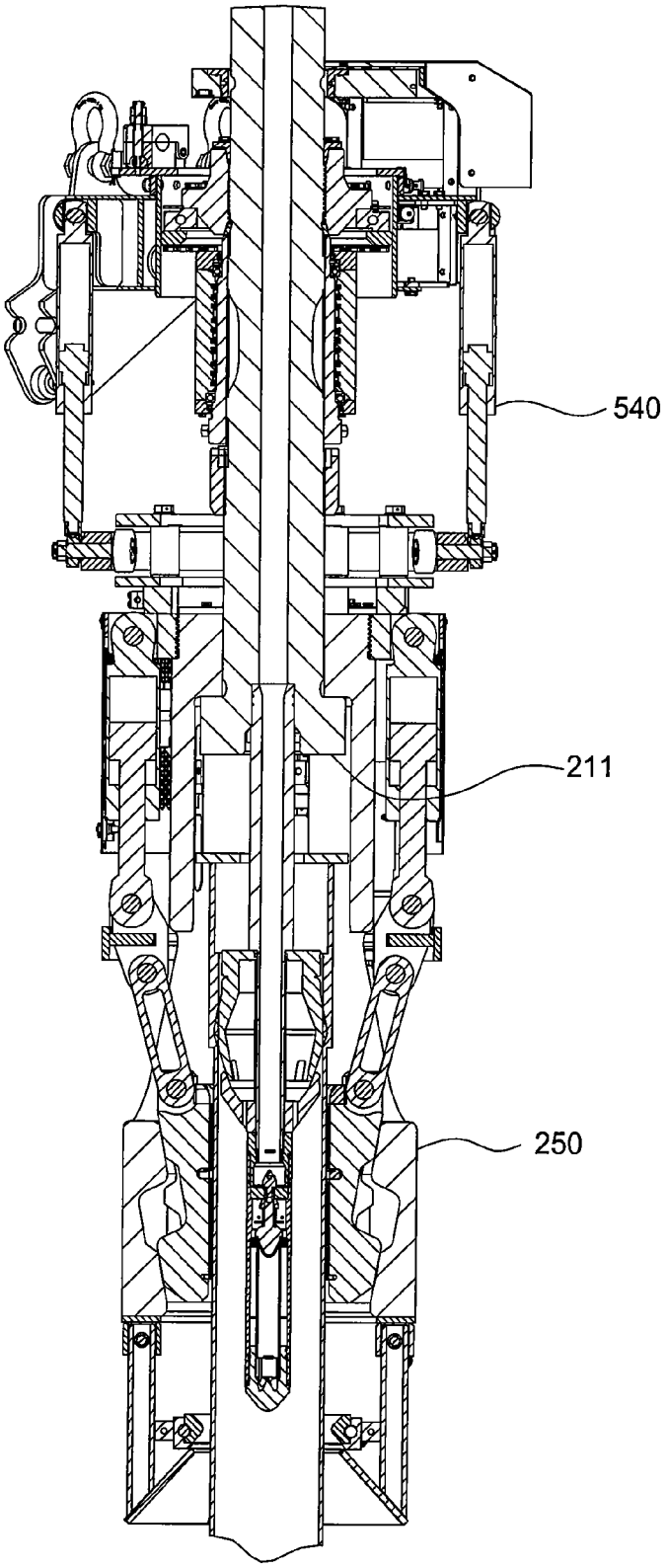
FIG. 43 shows the thread compensator in the drilling position.
Figure 43A:
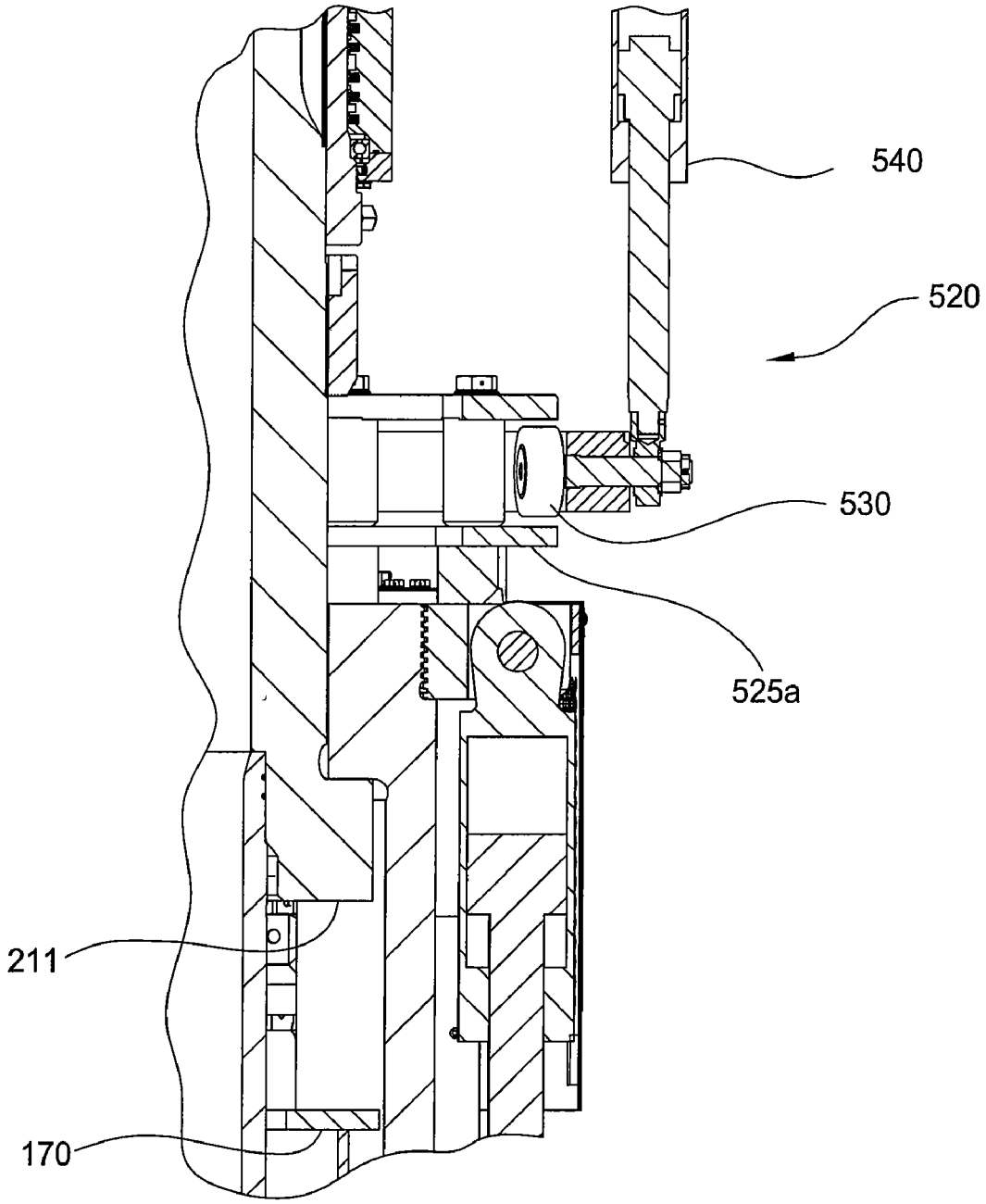
FIG. 43A is a partial exploded view of the thread compensator in the drilling position.

FIG. 43 shows the thread compensator 520 in the drilling position. In this position, the tubular thread connection has been completed. The thread compensator 520 has returned to the fully extended position where the carrier 250 is in contact with the collar 211. In this respect, the weight of the connected tubular string is supported by the collar 211. Also, torque from the top drive may be transferred to the carrier 250 to rotate the tubular string for drilling operations. FIG. 43A is a partial exploded view of the thread compensator 520 in the drilling position. In one embodiment, the compensation cylinder 540 is adapted to position the roller 530 in location where the roller 530 does not contact the upper portion of the inner lift ring 525*a*. This separation prevents overheating between the roller 530 and the inner lift ring 525*a* during rotation of the mandrel 110 and the carrier 250 while drilling. It is contemplated that the roller 530 may contact the inner lift ring 525*a* during drilling operations.

Wedge Lock Prevention

Figure 44:
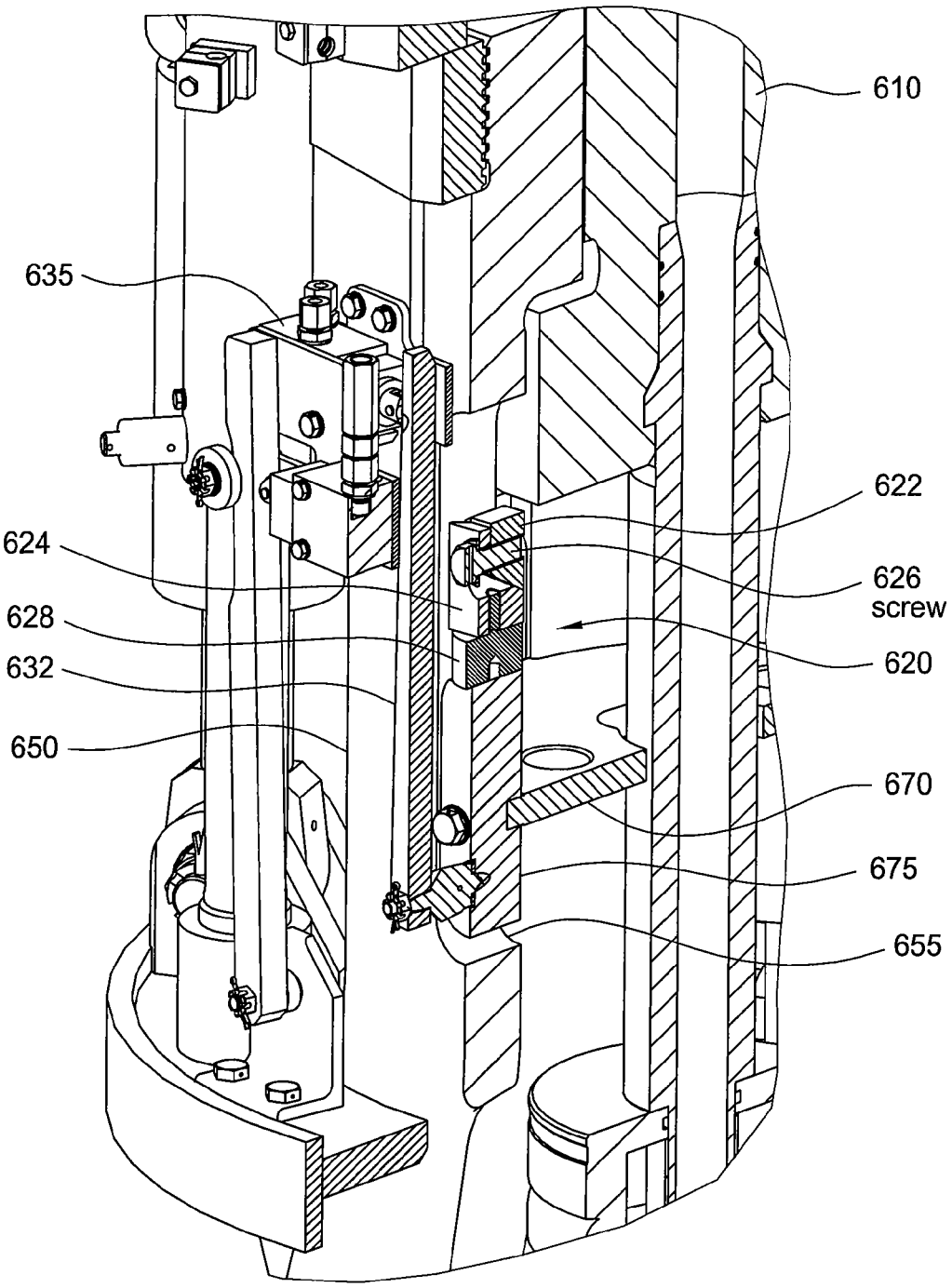
FIG. 44 shows a partial view of another embodiment of the tubular gripping apparatus equipped with a wedge lock release mechanism.

FIG. 44 shows a partial view of another embodiment of the tubular gripping apparatus equipped with a wedge lock release mechanism 620. The tubular gripping apparatus is shown with the mandrel 610 supporting the carrier 650. The bumper plate 670 is positioned inside the carrier 650 for engagement with the tubular. Engagement with the tubular may cause the bumper plate 670 to move axially relative to the carrier 650. In one embodiment, the bumper plate 670 is coupled to the carrier 650 using guiding elements 675 that are movable in a slot 655 of the carrier 650.

The release mechanism 620 acts as a stop member for limiting the upward movement of the guiding elements 655 and the bumper plate 670. In one embodiment, the release mechanism 620 includes an anchor 622 attached to the carrier 650. The anchor 622 may be attached using welding or other suitable methods of attachment. In another embodiment, the anchor 622 and the carrier 650 may be formed from one piece of steel or other suitable material. An engagement member 624 is coupled to the anchor 622 using a connection device 626 such as a screw. The engagement member 624 has a wedge surface that is movable along a wedge surface of the anchor 622. Movement of the engagement member 624 is controlled by releasing the screw 626. An optional rubber bumper 628 releasably attached to the engagement member 624 may be provided for engagement with the guiding element 675. The rubber bumper 628 may be exchanged as it wears down from use.

Figure 45:
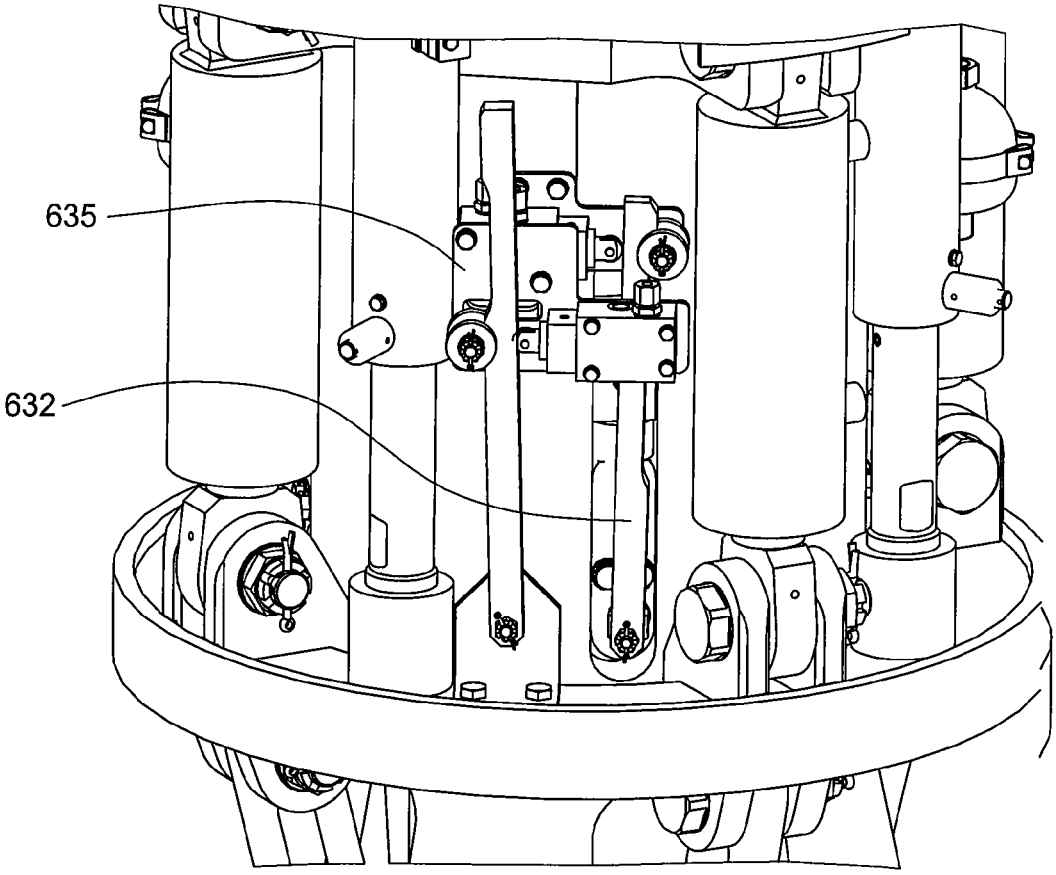
FIG. 45 shows the position of the coupling indicator when the guiding element is contacting the rubber bumper.
Figure 46:
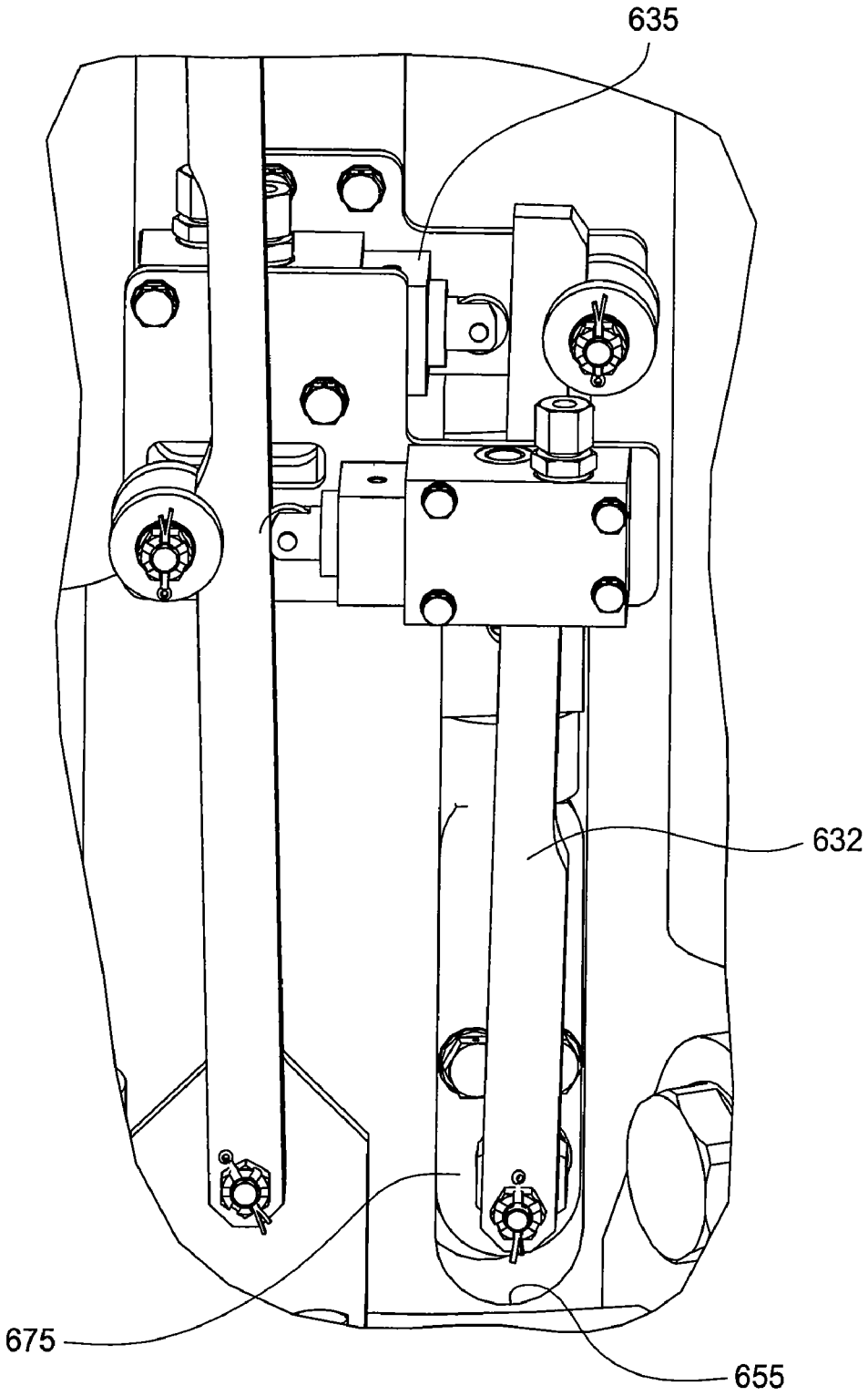
FIG. 46 is a partial exploded view of FIG. 45.

The tubular gripping apparatus may optionally include a coupling detection system for indicating presence of a coupling. The coupling detection system includes a coupling indicator 632 connected to the guiding elements. The coupling indicator 632 may be similar to the coupling indicator 632 described with respect with FIGS. 15-17. The coupling indicator 632 may be an elongated member having tapered portions to indicate the position of the tubular coupling. A lower end of the coupling indicator 632 is connected to the coupling engagement plate 670 and movable therewith. In one embodiment, the coupling indicator 632 has an upper narrow portion and a lower wide portion to indicate the absence or presence of the coupling. A sensor 635 may be adapted to read the coupling indicator 632 to determine the presence or absence of the coupling in a similar manner as the sensor 175. FIG. 45 shows the position of the indicator 632 when the guiding element is contacting the rubber bumper 628. FIG. 46 is a partial exploded view of FIG. 45.

Figure 47:
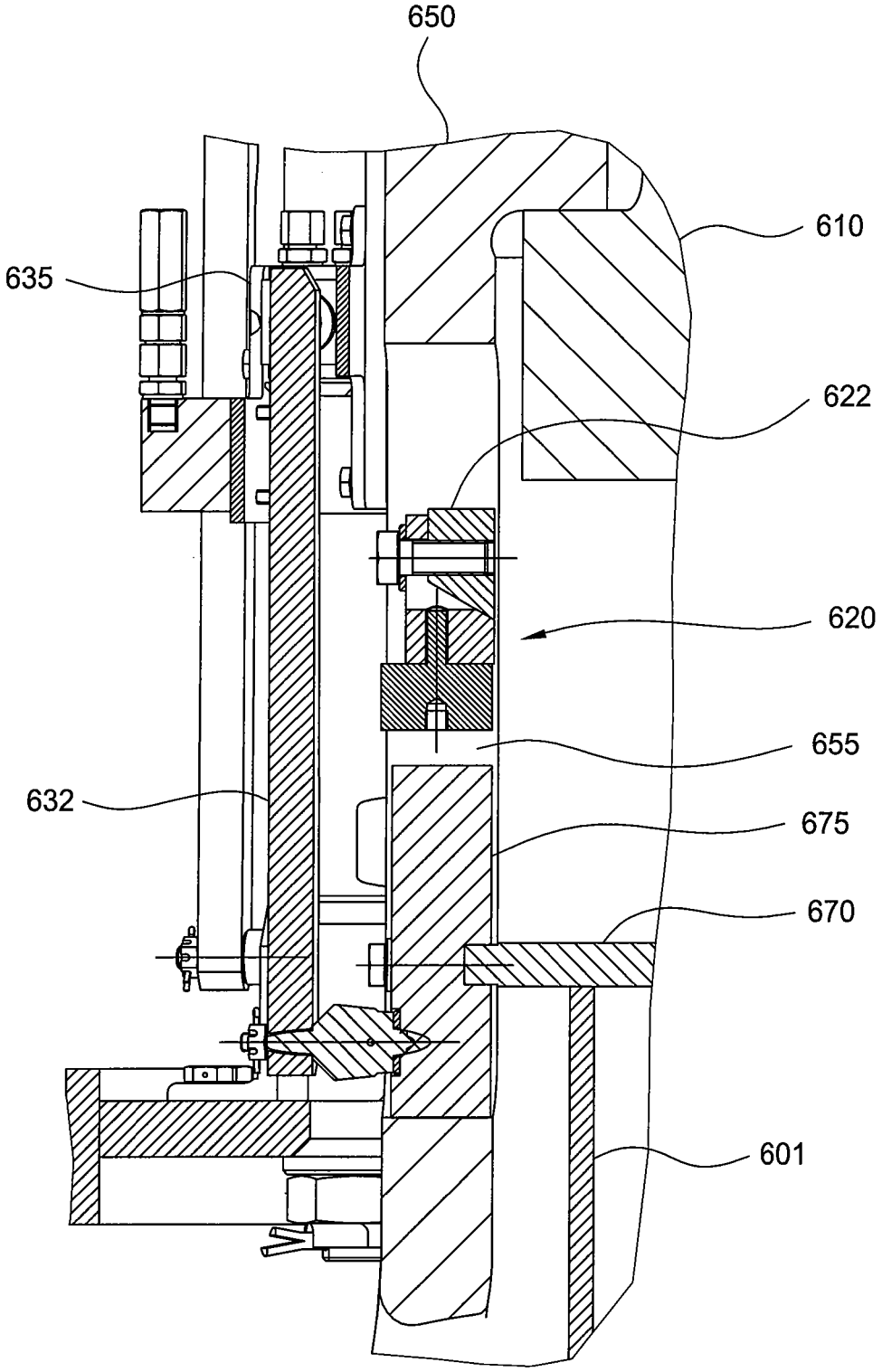
FIGS. 47-50 are partial exploded views of the tubular gripping apparatus in operation.

FIGS. 47-50 are partial exploded views of the tubular gripping apparatus in operation. In FIG. 47, the tubular gripping apparatus has been lowered until the bumper plate 670 engages the casing 601. In one embodiment, the tubular gripping apparatus is lowered with the thread compensator 520 activated. In this respect, a substantial portion of the weight of the carrier is borne by the thread compensator 520, while the remainder is borne by the shoulder of the mandrel 610. The thread compensator 520 may hold at least 85% of the weight; preferably, at least 95%. As shown, the bumper plate 670 is at the lower end of the slot 655 and has not engaged the release mechanism 620. In this position, further lowering of the apparatus will lower the carrier 650 relative to the bumper plate 670, which is resting on top of the casing 601.

Figure 48:
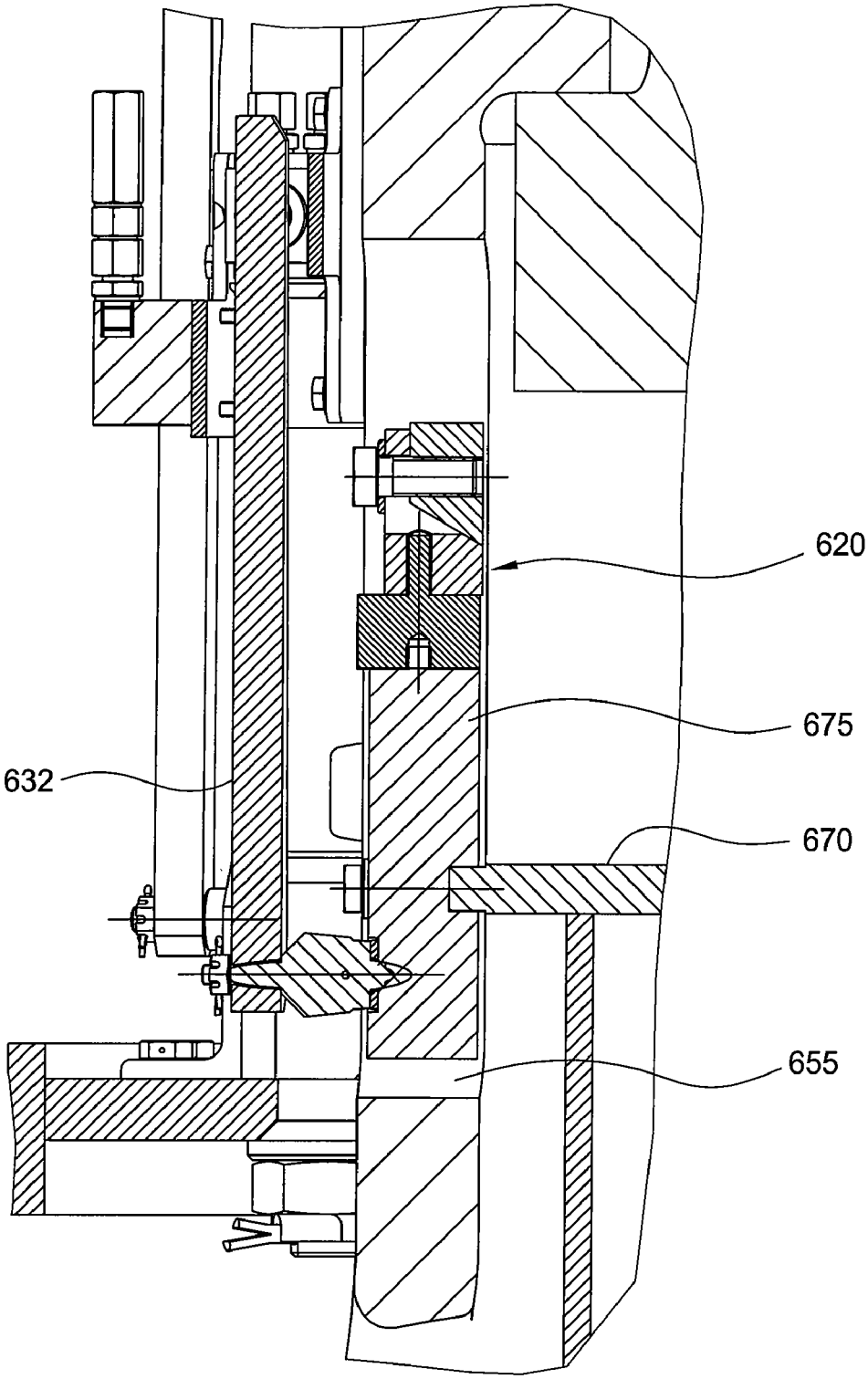

FIG. 48 shows the tubular gripping apparatus being lowered further. The carrier 650 has moved relative to the bumper plate 670, thereby causing the guiding elements 675 to engage rubber bumper 628 of the release mechanism 620. In this position, further lowering of the apparatus will lower the mandrel 610 relative to the carrier 650. Also, a substantial portion of the weight of the carrier continues to be borne by the thread compensator 520, while the remainder is now borne by the bumper plate 670. The thread compensator 520 may hold at least 85% of the weight; preferably, at least 95%. In addition, the coupling indicator 632 has moved up with the bumper plate 670, which movement is detected by the sensor 635.

Figure 49:
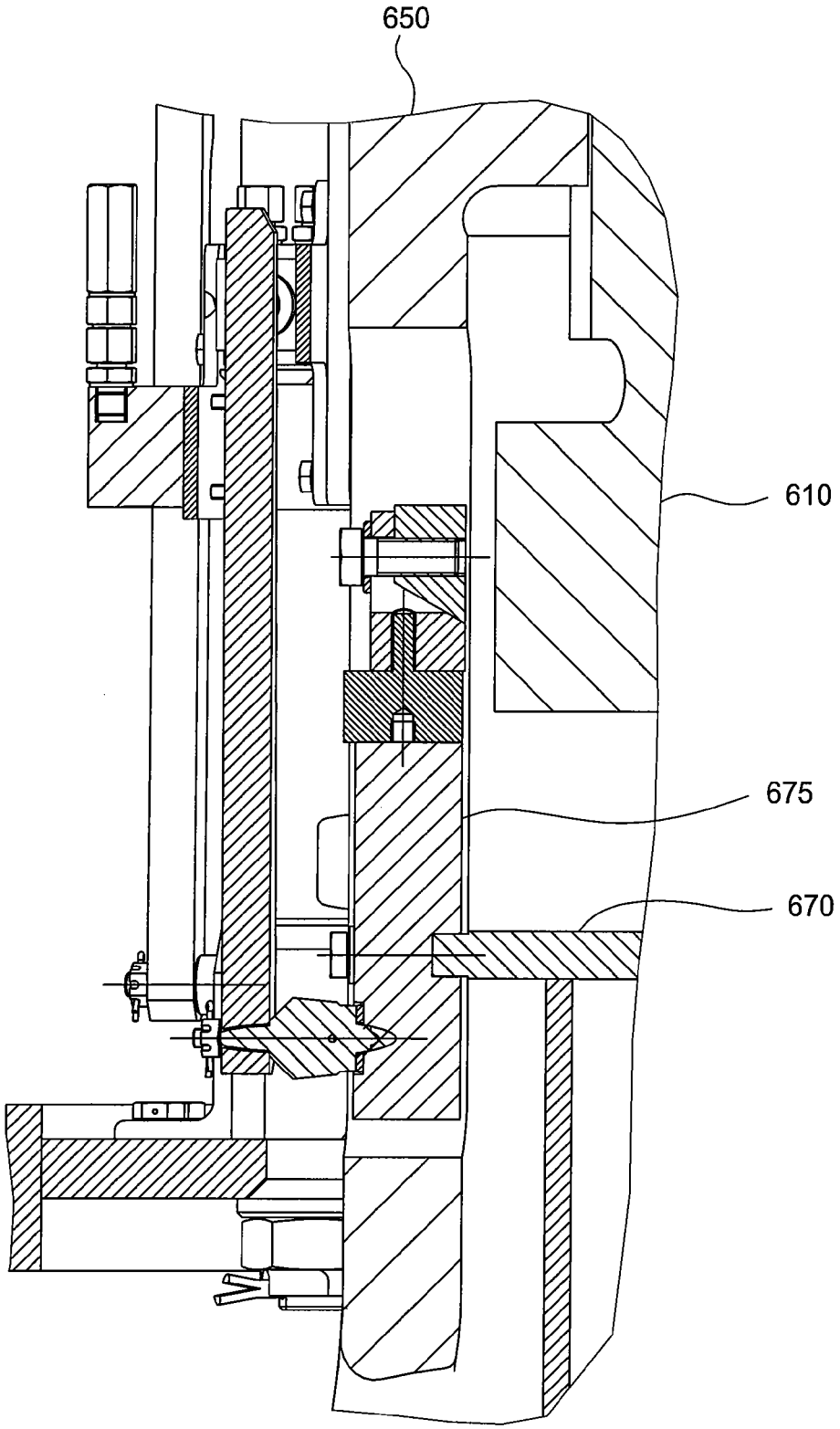

FIG. 49 shows the mandrel 610 relative to the carrier 650 after the lowering of the tubular gripping apparatus has stopped and in anticipation of the thread compensation. As shown, the mandrel 610 is not in contact with the bumper plate 670. The distance between the load shoulder of the mandrel 610 and the shoulder of the carrier 650 may be used for thread compensation. In one embodiment, a sensor may be provided to measure the optimal distance (i.e., the minimal distance required for thread compensation) has been reached. In another embodiment, a sensor may be provided to warn the distance is insufficient to avoid contact of the mandrel 610 with the bumper plate 670.

Figure 50:
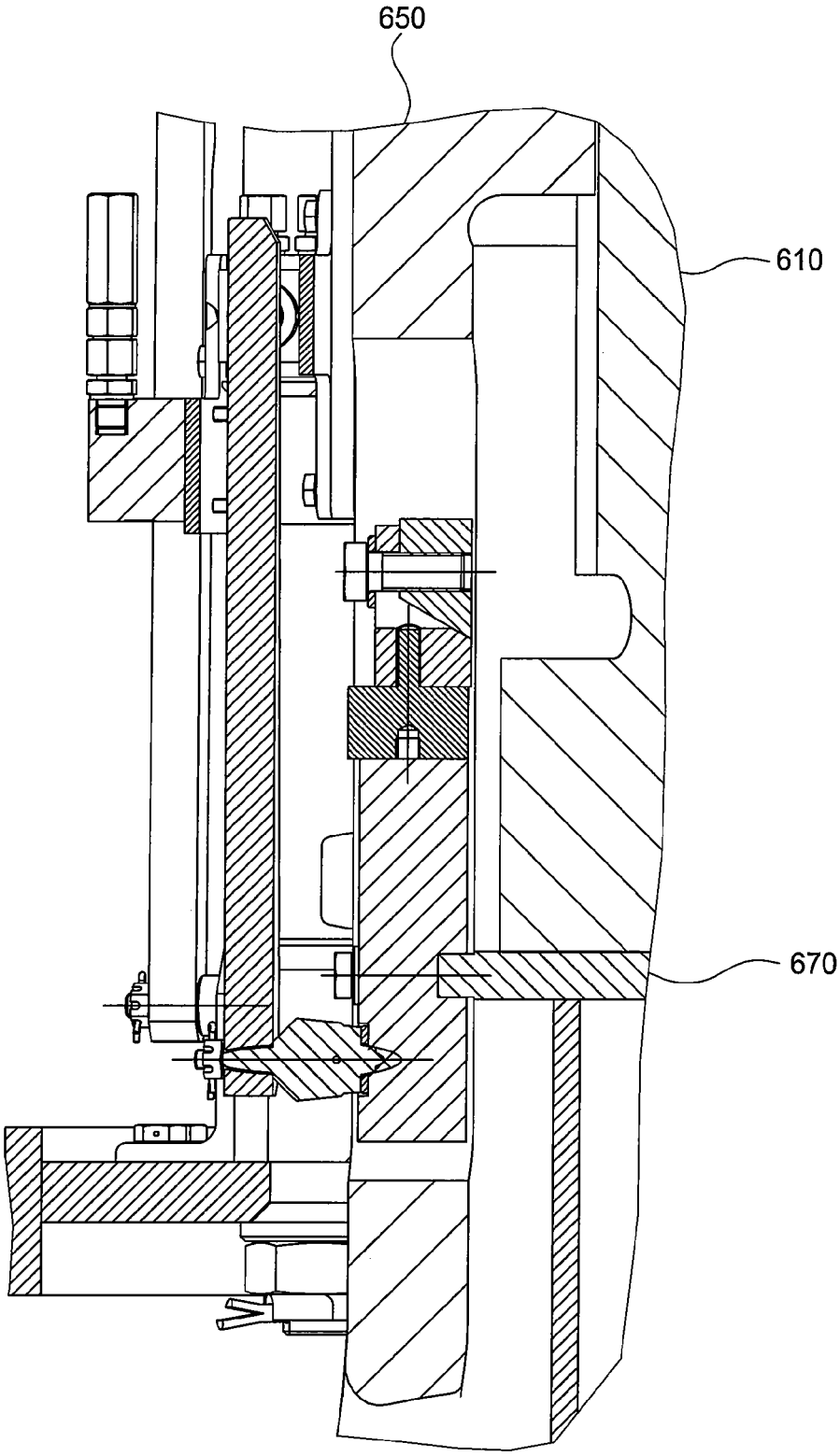

FIG. 50 shows the situation where the mandrel 610 is contacting the bumper plate 670. This may occur after the casing has been made up and when a push force is applied to the casing string using the tubular gripping apparatus. This position allows axial force to be applied to the casing string without loading the gripping elements.

Figure 51:
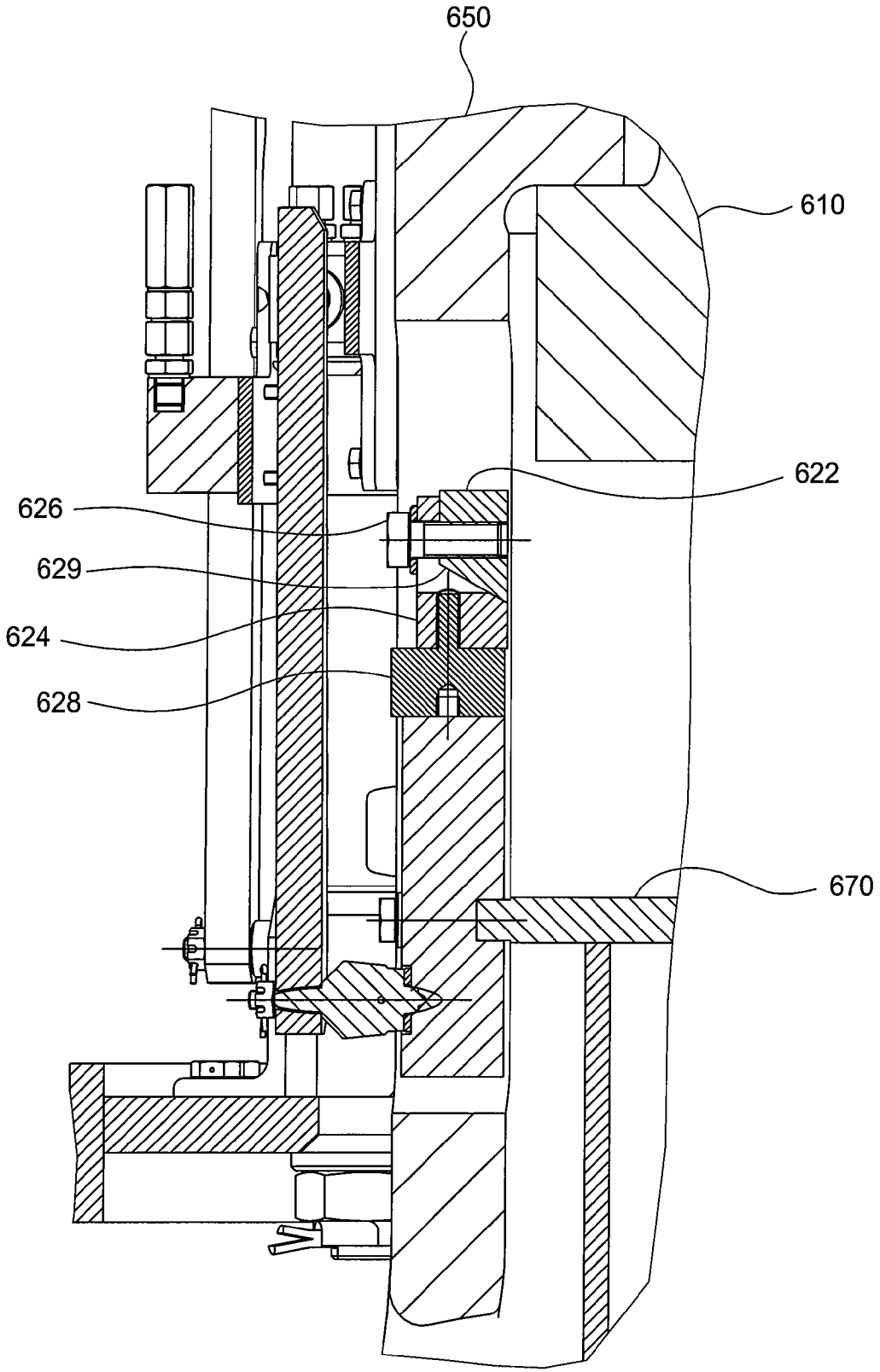
FIG. 51 shows an embodiment of a release mechanism in the unreleased position.
Figure 52:
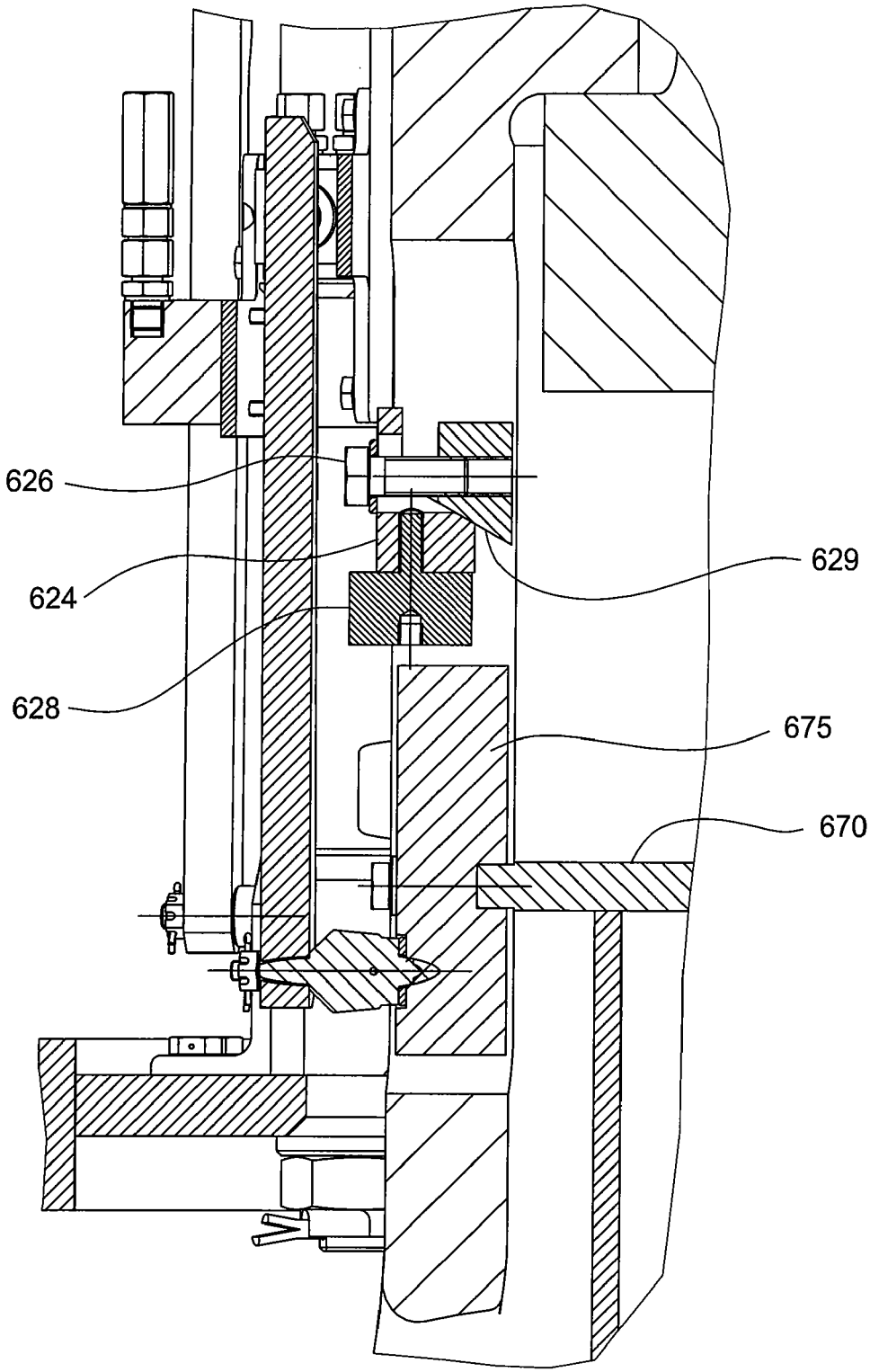
FIG. 52 shows the release mechanism of FIG. 51 in the released position.

When the situation shown in FIG. 50 occurs, the carrier 650 cannot move upward to release the gripping elements. This situation may be referred as a "wedge lock" condition. To remedy this situation, the screw 626 may be released from the anchor 622. FIG. 51 shows the screw 626 in the unreleased position. FIG. 52 shows the screw 626 in the released position. As the screw 626 is released from the anchor 622, the engagement member 624 is moved along the wedge surface and away from the guiding elements 675, thereby creating a space 660 between the rubber bumper 628 and guiding elements 675. The space 660 allows the carrier 650 to move axially relative to the gripping elements, thereby releasing the gripping elements from the casing.

In addition to casing, aspects of the present invention are equally suited to handle tubulars such as drill pipe, tubing, and other types of tubulars known to a person of ordinary skill in the art. Moreover, the tubular handling operations contemplated herein may include connection and disconnection of tubulars as well as running in or pulling out tubulars from the well.

In another embodiment, a swivel is provided for use with a top drive system. The swivel includes a mechanism to selectively engage and disengage the seals. When the seals are engaged, the swivel may transmit fluid between an inner body and an outer body. In one embodiment the seals are engaged during low rotational speed operations and disengage during high rotational speed operations. Disengagement of the seals during high speed rotations may extend the service life of the seals.

In another embodiment, a thread compensator is provided for use with a top drive system. The thread compensator is adapted to move the carrier relative to the mandrel of the tubular gripping apparatus. In one embodiment, the thread compensator uses one or more extendable cylinders for axial movement of the carrier. One end of the cylinders may be attached to stationary portion of the tubular gripping apparatus and another end of the cylinder may be attached to a rotatable portion of the tubular gripping apparatus.

In another embodiment, a wedge lock release mechanism is provided for use with the tubular gripping apparatus. In one embodiment, release mechanism is operable to create a space between the mandrel and the bumper plate to facilitate the release of the gripping element.

While the foregoing is directed to embodiments of the present invention, other and further embodiments of the invention may be devised without departing from the basic scope thereof, and the scope thereof is determined by the claims that follow.

We claim:

1. A thread compensator for use with a tubular gripping assembly having a non-rotating portion and a rotating portion, comprising:

an inner ring member rotatably coupled to an outer ring member; and a cylinder for coupling the outer ring member to the non-rotating portion of the tubular gripping assembly, wherein the inner ring member is rotatable with the rotating portion of the tubular gripping assembly.

2. The thread compensator of claim 1, further comprising rollers attached to the outer ring, wherein the rollers are engageable with the inner ring.

3. The thread compensator of claim 1, wherein extension or retraction of the cylinder compensates for axial movement of the tubular gripping assembly during makeup or breakout.

4. A tubular handling assembly, comprising:

a gripping tool having a carrier movably coupled to a mandrel, wherein the carrier includes a gripping element;

a link assembly coupled to the gripping tool; and a thread compensator having:

an inner ring member rotatably coupled to an outer ring member; and a cylinder for coupling the outer ring member to the link assembly, wherein the inner ring member is rotatable with the carrier.

5. The assembly of claim 4, further comprising a swivel.

6. The assembly of claim 5, wherein the swivel is coupled to the mandrel at a location above the carrier.

7. The assembly of claim 6, wherein the link assembly is coupled to the mandrel at a location above the swivel.

8. The assembly of claim 5, wherein the swivel comprises:

an outer housing;

an inner housing concentrically disposed within the outer housing;

a fluid channel for fluid communication between the outer housing and the inner housing;

a seal bushing coupled to the outer housing and axially movable between a first position and a second position relative to the inner housing;

a plurality of seals movable with the seal bushing and sealingly engageable with the inner housing for preventing leakage from the fluid channel; and a plurality of grooves disposed on the inner housing, wherein when the seal bushing is in the first position, the plurality of seals are sealingly engaged with the inner housing, and in the second position, the plurality of seals are aligned with the plurality of grooves, thereby disengaging from the inner housing.

9. The assembly of claim 4, further comprising a torque sub.

10. The assembly of claim 4, wherein the link assembly includes a link support housing rotatably connected to a coupling ring.

11. The assembly of claim 10, wherein the coupling ring is attached to the mandrel.

12. The assembly of claim 11, further comprising a swivel having an inner body attached to the mandrel and an outer body rotatable relative to the inner body.

13. The assembly of claim 12, wherein the outer body is coupled to the link support housing.

14. The assembly of claim 4, further comprising a turn counter having a turning member coupled to a rotating portion of the tubular handling assembly.

15. The assembly of claim 14, wherein the turn counter comprises a gear counter adapted to measure a rotation of the turning member.

16. The assembly of claim 4, further comprising a fill up tool connected to the mandrel.

17. The assembly of claim 4, further comprising:

a clamping indicator coupled to the gripping element for indicating a position of the gripping element.

18. The assembly of claim 17, wherein the clamping indicator comprises a pin having at least two different widths.

19. The assembly of claim 18, further comprising a sensor for determining a position of the clamping indicator.

20. The assembly of claim 19, wherein a signal from the sensor is used to control movement of the gripping element.

21. The assembly of claim 4, further comprising a coupling indicator coupled to gripping tool for indicating a position of the tubular.

22. A method of handling a tubular, comprising:

providing a gripping assembly having:

a carrier movably coupled to a mandrel, wherein the mandrel has a load collar adapted to couple to a shoulder of the carrier;

a gripping element radially movable relative to the carrier;

a thread compensator adapted to move the carrier;

an engagement member adapted to contact an upper end of the tubular and movable relative to the carrier; and a stop member adapted to limit movement of the engagement member;

lowering the gripping assembly until the engagement member contacts the upper end of the tubular;

lowering the carrier relative to the engagement member until the engagement member contacts the stop member;

lowering the mandrel relative to the carrier such that a gap exists between the load collar and the shoulder;

threadedly connecting the tubular to a second tubular; and actuate the thread compensator to move the carrier to compensate for threaded connection.

23. The assembly of claim 12, wherein the engagement member comprises a plate.

* * * * *

UNITED STATES PATENT AND TRADEMARK OFFICE

CERTIFICATE OF CORRECTION

PATENT NO. : 8,365,834 B2
APPLICATION NO. : 12/435346
DATED : February 5, 2013
INVENTOR(S) : Liess et al.

It is certified that error appears in the above-identified patent and that said Letters Patent is hereby corrected as shown below:

In the Claims:

Column 20, Claim 23, Line 36, please delete "12" and insert -- 22 -- therefor.

Signed and Sealed this
Thirtieth Day of July, 2013

Teresa Stanek Rea
*Acting Director of the United States Patent and Trademark Office*